US009381764B2

(12) United States Patent
Ohta

(10) Patent No.: US 9,381,764 B2
(45) Date of Patent: Jul. 5, 2016

(54) INK RIBBON CASSETTE, INK RIBBON CARTRIDGE, PRINTING DEVICE AND CONTROL METHOD FOR PRINTING DEVICE

(71) Applicant: NIDEC SANKYO CORPORATION, Suwa-gun, Nagano (JP)

(72) Inventor: Keiji Ohta, Nagano (JP)

(73) Assignee: NIDEC SANKYO CORPORATION (JP)

( * ) Notice: Subject to any disclaimer, the term of this patent is extended or adjusted under 35 U.S.C. 154(b) by 0 days.

(21) Appl. No.: 14/422,503

(22) PCT Filed: Nov. 25, 2013

(86) PCT No.: PCT/JP2013/081645

§ 371 (c)(1),
(2) Date: Feb. 19, 2015

(87) PCT Pub. No.: WO2014/084169

PCT Pub. Date: Jun. 5, 2014

(65) Prior Publication Data

US 2015/0283834 A1 Oct. 8, 2015

(30) Foreign Application Priority Data

Nov. 30, 2012 (JP) ..... 2012-262098
Nov. 30, 2012 (JP) ..... 2012-262099
Nov. 30, 2012 (JP) ..... 2012-262100
Nov. 30, 2012 (JP) ..... 2012-262101

(51) Int. Cl.
*B41J 32/00* (2006.01)
*B41J 33/16* (2006.01)

(Continued)

(52) U.S. Cl.
CPC .. *B41J 32/00* (2013.01); *B41J 2/32* (2013.01); *B41J 2/325* (2013.01); *B41J 17/02* (2013.01);

(Continued)

(58) Field of Classification Search
USPC ..... 347/171–176, 101, 103–106, 212–215, 347/217; 400/234, 235
See application file for complete search history.

(56) References Cited

U.S. PATENT DOCUMENTS 6,307,583 B1 * 10/2001 Randolph ..... B41J 33/26 347/217
2007/0182807 A1 * 8/2007 Sawada ..... B41J 35/18 347/213

FOREIGN PATENT DOCUMENTS

JP S63170058 A 7/1988
JP H0255180 A 2/1990

(Continued)

OTHER PUBLICATIONS

International Search Report corresponding to International Application No. PCT/JP2013/081645; Date of Mailing: Feb. 18, 2014, with English translation.

*Primary Examiner* — Kristal Feggins
(74) *Attorney, Agent, or Firm* — Cantor Colburn LLP

(57) ABSTRACT

An ink ribbon cartridge may include a supply roll; a winding roll; and a power transmission mechanism to transmit power from a drive source to the supply roll and the winding roll. A direction in which an ink ribbon is wound by the winding roll is a ribbon winding direction and a direction in which the ink ribbon is wound by the supply roll is a ribbon rewinding direction. The power transmission mechanism may include a winding side one-way clutch to transmit a driving force in the ribbon winding direction to the winding roll and cut off transmission of the driving force in the ribbon rewinding direction to the winding roll; and a supply side one-way clutch to transmit the driving force in the ribbon rewinding direction to the supply roll and cuts off transmission of the driving force in the ribbon winding direction to the supply roll.

16 Claims, 16 Drawing Sheets

(51) Int. Cl.

| | |
|---|---|
| ***B41J 33/40*** | (2006.01) |
| ***B41J 2/325*** | (2006.01) |
| ***B41J 17/02*** | (2006.01) |
| ***B41J 17/32*** | (2006.01) |
| ***B41J 2/32*** | (2006.01) |
| ***B41J 17/24*** | (2006.01) |

(52) U.S. Cl.
CPC *B41J 17/24* (2013.01); *B41J 17/32* (2013.01); *B41J 33/16* (2013.01); *B41J 33/40* (2013.01); *B41J 2202/31* (2013.01)

(56) References Cited

FOREIGN PATENT DOCUMENTS

| | | | |
|---|---|---|---|
| JP | H05286196 | A | 11/1993 |
| JP | H0615904 | A | 1/1994 |
| JP | H11268387 | A | 10/1999 |
| JP | 2004243727 | A | 9/2004 |
| JP | 2008105291 | A | 5/2008 |
| JP | 2009078400 | A | 4/2009 |
| JP | 2010162736 | A | 7/2010 |

* cited by examiner

INK RIBBON CASSETTE, INK RIBBON CARTRIDGE, PRINTING DEVICE AND CONTROL METHOD FOR PRINTING DEVICE

CROSS REFERENCE TO PRIOR APPLICATIONS

This is the U.S. national stage of application No. PCT/JP2013/081645, filed on Nov. 25, 2013. Priority under 35 U.S.C. §119(a) and 35 U.S.C. §365(b) is claimed from Japanese Application No. 2012-262098, filed Nov. 30, 2012; Japanese Patent Application No. 2012-2622099, filed Nov. 30, 2012; Japanese Patent Application no. 2012-262100, filed Nov. 30, 2012; and Japanese Patent Application No. 2012-262101, filed Nov. 30, 2012; the disclosures of which are incorporated herein by reference.

FIELD OF THE INVENTION

The present invention relates to an ink ribbon cartridge including a supply roll and a winding roll around which an ink ribbon is wound, and relates to a printing device including the ink ribbon cartridge.

Further, the present invention relates to a printing device including a main body part to which an ink ribbon cartridge is detachably attached, and relates to a printing device including an ink ribbon cartridge and a housing to which the ink ribbon cartridge is detachably attached. Further, the present invention relates to a control method for a printing device including an ink ribbon cartridge and a housing to which the ink ribbon cartridge is detachably attached.

BACKGROUND

Conventionally, a thermal transfer type printing device has been known in which ink of a heated ink ribbon is transferred and printed on a card conveyed along a card conveying passage (see, for example, Patent Literature 1). The printing device described in Patent Literature 1 includes an ink ribbon cartridge having a supply roll for supplying an ink ribbon and a winding roll for winding the ink ribbon and a main body part to which the ink ribbon cartridge is detachably attached. In the printing device, an ink ribbon cartridge does not include a cover for covering the winding roll and, in the ink ribbon cartridge detached from the main body part, the used ink ribbon wound around the winding roll is exposed outside. Further, the main body part includes a housing structured of a first housing disposed on an upper side and a second housing disposed on a lower side. The first housing is turnably held by a fixed shaft attached to the second housing and is capable of turning with respect to the second housing.

In the printing device, the main body part includes a thermal head configured to heat an ink ribbon to transfer ink of the ink ribbon to a card, a ribbon feed roller which feeds the ink ribbon from a supply roll to a winding roll, and a motor for driving the ribbon feed roller. The motor is also connected with the winding roll and the winding roll is rotated by power of the motor. In other words, in the printing device, when the motor is rotated, the ribbon feed roller and the winding roll are rotated and the ink ribbon is fed from the supply roll to the winding roll.

Further, in a thermal transfer type printing device like the printing device described in Patent Literature 1, ink having a shape which is the same as an image printed on a card is peeled from the ink ribbon and thus, a peeled trace of ink having the same shape as the printed image on the card is left on the ink ribbon after printing has been performed (used ink ribbon). Therefore, when the peeled trace is observed, the image printed on the card can be recognized easily. Accordingly, it is not desirable from a viewpoint of security that, in the ink ribbon cartridge detached from the main body part, the used ink ribbon wound around the winding roll is exposed outside. In order to prevent this problem, an ink ribbon cartridge has been proposed which includes a cartridge main body in which the used ink ribbon wound around a winding roll is accommodated so as not to expose outside even when the ink ribbon cartridge is detached from its main body part (see, for example, Patent Literature 2).

Further, in a state that the ink ribbon cartridge is detached from the main body part, even when the used ink ribbon is not exposed outside, in a case that the used ink ribbon wound around a winding roll can be easily drawn out from the cartridge main body, the image printed on a card can be recognized easily. Therefore, the ink ribbon cartridge described in Patent Literature 2 is structured so that, even when detached from the main body part, the used ink ribbon wound around the winding roll is not easily drawn out from the cartridge main body.

Specifically, in the ink ribbon cartridge, a plurality of ribs is formed on an inner peripheral face of the winding roll formed in a cylindrical tube shape, and an inclined part which is inclined toward one of a rotating direction of the winding roll is formed at one end part of the rib in an axial direction of the winding roll. Further, the ink ribbon cartridge includes a reverse rotation prevention member which is relatively movable along an axial center of the winding roll with respect to the cartridge main body and an urging member which urges the reverse rotation prevention member toward the winding roll. The reverse rotation prevention member is formed with an opposing inclined part which is inclined in the same direction as the inclined direction of the inclined part formed in the rib of the winding roll.

In the ink ribbon cartridge, when the ink ribbon cartridge is not attached to the main body part of a printing device, the inclined part of the winding roll and the opposing inclined part of the reverse rotation prevention member are engaged with each other by an urging force of the urging member and thus the winding roll is capable of being rotated only in a direction where the ink ribbon is wound. Further, in the ink ribbon cartridge, when the ink ribbon cartridge is attached to the main body part of the printing device, the reverse rotation prevention member is pushed by a tip end part of a rotation shaft structuring the main body part and an engaging state of the inclined part of the winding roll with the opposing inclined part of the reverse rotation prevention member is released and thereby the winding roll is set to be capable of rotating in both directions.

As described above, in the ink ribbon cartridge described in Patent Literature 2, unless the reverse rotation prevention member is pushed by the tip end part of the rotation shaft to release the engaging state of the inclined part of the winding roll with the opposing inclined part of the reverse rotation prevention member, the winding roll is unable to be rotated in a direction that the ink ribbon is drawn out from the winding roll. Therefore, even in a state that the ink ribbon cartridge is detached from the main body part, the used ink ribbon which is wound around the winding roll cannot be easily drawn out from the cartridge main body.

Further, in the printing device, when the first housing covering an upper side of the second housing is turned to one direction, the ink ribbon cartridge can be detached from the housing toward the upper side. Further, in the printing device, the first housing which covers the upper side of the second housing is turned to one direction and, after the ink ribbon cartridge is attached to the second housing from the upper side, when the first housing is turned to the other direction to cover the ink ribbon cartridge from the upper side, the ink ribbon cartridge is attached to the housing.

As described above, in the printing device described in Patent Literature 1, an ink ribbon cartridge can be attached to and detached from the main body part from an upper side with respect to the printing device. Therefore, in the printing device, even when another device is adjacently disposed on a lateral side with respect to the printing device, an ink ribbon cartridge can be easily attached and detached. Accordingly, for example, in a case that the printing device is mounted on a host device and used, flexibility of layout of the printing device in the host device can be enhanced.

CITATION LIST

[PTL 1] Japanese Patent Laid-Open No. 2008-105291

[PTL 2] Japanese Patent Laid-Open No. 2004-243727

In the printing device described in Patent Literature 1, a motor for driving a ribbon feed roller is connected with a winding roll but is not connected with a supply roll. Therefore, in the printing device, the ink ribbon can be fed from the supply roll to the winding roll, but the ink ribbon cannot be fed from the winding roll to the supply roll.

SUMMARY

In view of the problem described above, at least an embodiment of the present invention provides an ink ribbon cartridge in which, while a structure of a printing device to be attached is simplified, an ink ribbon can be appropriately fed in both directions between a supply roll and a winding roll in the printing device, and to provide a printing device including the ink ribbon cartridge. Further, at least an embodiment of the present invention provides a printing device which is capable of appropriately feeding an ink ribbon in both directions between a supply roll and a winding roll while simplifying a structure of the printing device.

Further, in the ink ribbon cartridge described in Patent Literature 2, when the engaging state of the inclined part of the winding roll with the opposing inclined part of the reverse rotation prevention member is released by pushing the reverse rotation prevention member by using a certain member instead of the rotation shaft, the used ink ribbon wound around the winding roll can be drawn out from the cartridge main body in the ink ribbon cartridge detached from the main body part. Therefore, the security for the ink ribbon cartridge is not sufficient.

In view of the problem described above, at least an embodiment of the present invention provides an ink ribbon cassette in which, in a state detached from the main body part of a printing device, the used ink ribbon is more difficult to be drawn out from a winding side cover part which covers a substantially entire ink ribbon wound around the winding roll than a conventional technique. Further, at least an embodiment of the present invention provides an ink ribbon cartridge including the ink ribbon cassette, and to provide a printing device including the ink ribbon cartridge.

Further, in a case that the ink ribbon cartridge described in Patent Literature 2 is used in the printing device described in Patent Literature 1, even in a state that the ink ribbon cartridge is detached from the main body part in the printing device described in Patent Literature 1, the used ink ribbon wound around the winding roll can be prevented from being easily drawn out from the cartridge main body.

However, the ink ribbon cartridge described in Patent Literature 2 is attached to and detached from the main body part in an axial direction of the winding roll. In other words, the ink ribbon cartridge is attached to and detached from the main body part from a lateral side with respect to the printing device. Therefore, in a case that the ink ribbon cartridge described in Patent Literature 2 is used in the printing device described in Patent Literature 1, a space for exchanging the ink ribbon cartridge is required to provide on a lateral side with respect to the printing device in a host device on which the printing device is mounted and thus, flexibility of layout of the printing device is lowered.

Therefore, in view of the problem described above, at least an embodiment of the present invention provides a printing device in which flexibility of its layout can be enhanced in a host device on which the printing device is to be mounted while preventing the used ink ribbon from being easily drawn out from a cover part which covers a substantially entire ink ribbon wound around the winding roll in a state that the ink ribbon cartridge is detached from the main body part of the printing device.

Further, when the ink ribbon cartridge described in Patent Literature 2 is used in the printing device described in Patent Literature 1, even in a state that the ink ribbon cartridge is detached from the housing, an image printed on a card can be prevented from being easily acquired from a peeled trace which is left on the used ink ribbon. However, in the printing device, the ink ribbon cartridge may be detached from the housing in a state that the peeled trace left on the used ink ribbon is disposed between the supply roll and the winding roll (in other words, in a state that the peeled trace left on the used ink ribbon is not accommodated in the cartridge main body). In this case, the peeled trace left on the used ink ribbon is exposed to the outside of the cartridge main body and thus an image printed on a card can be acquired from the peeled trace left on the used ink ribbon.

Therefore, in view of the problem described above, at least an embodiment of the present invention provides a printing device which is capable of preventing an image printed on a printing medium from being acquired from the peeled trace of ink which is left on the used ink ribbon in a state that the ink ribbon cartridge is detached from a housing of the printing device. Further, at least an embodiment of the present invention is provides a control method for a printing device which is capable of preventing an image printed on a printing medium from being acquired from the peeled trace of ink which is left on the used ink ribbon in a state that the ink ribbon cartridge is detached from a housing of the printing device.

In order to attain the above, at least an embodiment of the present invention provides an ink ribbon cartridge including a supply roll around which an ink ribbon is wound, a winding roll around which the ink ribbon supplied from the supply roll is wound, and a power transmission mechanism configured to transmit power from a drive source to the supply roll and the winding roll. When a direction in which the ink ribbon is wound by the winding roll is defined as a ribbon winding direction and a direction in which the ink ribbon is wound by the supply roll is defined as a ribbon rewinding direction, the power transmission mechanism includes a winding side one-way clutch which transmits a driving force in the ribbon winding direction of the drive source to the winding roll and cuts off transmission of the driving force in the ribbon rewinding direction of the drive source to the winding roll, and a supply side one-way clutch which transmits the driving force in the ribbon rewinding direction of the drive source to the supply roll and cuts off transmission of the driving force in the ribbon winding direction of the drive source to the supply roll.

The ink ribbon cartridge in accordance with at least an embodiment of the present invention includes a power transmission mechanism which transmits power from a drive source to the supply roll and the winding roll. Therefore, according to at least an embodiment of the present invention, the ink ribbon can be fed in both directions between the supply roll and the winding roll even when only one drive source is provided in the printing device to which the ink ribbon cartridge is attached. Accordingly, in at least an embodiment of the present invention, the structure of the printing device to which the ink ribbon cartridge is attached is simplified and, in addition, the ink ribbon can be fed in both directions between the supply roll and the winding roll in the printing device.

Further, in at least an embodiment of the present invention, the power transmission mechanism includes a winding side one-way clutch which transmits a driving force in the ribbon winding direction of the drive source to the winding roll and cuts off transmission of the driving force in the ribbon rewinding direction of the drive source to the winding roll, and a supply side one-way clutch which transmits the driving force in the ribbon rewinding direction of the drive source to the supply roll and cuts off transmission of the driving force in the ribbon winding direction of the drive source to the supply roll. Therefore, in at least an embodiment of the present invention, when the ink ribbon is wound by the winding roll, transmission of a driving force of the drive source to the supply roll is cut off and the supply roll can be followed according to rotation of the winding roll. Further, when the ink ribbon is wound by the supply roll, transmission of a driving force of the drive source to the winding roll is cut off and the winding roll can be followed according to rotation of the supply roll. Therefore, according to at least an embodiment of the present invention, when the ink ribbon is fed between the supply roll and the winding roll in both directions, the ink ribbon is prevented from being excessively pulled or prevented from being excessively slackened. As a result, in at least an embodiment of the present invention, the ink ribbon can be appropriately fed between the supply roll and the winding roll in both directions.

In at least an embodiment of the present invention, it is preferable that the power transmission mechanism includes a winding side torque limiter which is disposed between the winding side one-way clutch and the winding roll in a power transmission path from the drive source to the winding roll, and a supply side torque limiter which is disposed between the supply side one-way clutch and the supply roll in a power transmission path from the drive source to the supply roll. According to this structure, for example, in a case that the printing device to which the ink ribbon cartridge is attached includes a ribbon feed roller connected with the drive source like the printing device described in Patent Literature 1, even when winding speeds of the ink ribbon by the supply roll and the winding roll are set to be faster than a feed speed of the ink ribbon by the ribbon feed roller, differences between the winding speeds of the ink ribbon by the supply roll and the winding roll and the feed speed of the ink ribbon by the ribbon feed roller can be adjusted by the winding side torque limiter and the supply side torque limiter. Therefore, excessive tension of the ink ribbon can be prevented while preventing slacking of the ink ribbon which is fed between the supply roll and the winding roll.

In at least an embodiment of the present invention, it is preferable that the power transmission mechanism includes a supply side connecting part which is connected with the supply roll, a supply side rotation shaft which is connected with the supply side connecting part through the supply side torque limiter, a rotational member which is relatively turnably held by the supply side rotation shaft, an urging member for urging the rotational member in the ribbon rewinding direction with the supply side rotation shaft as a center, a turning restriction mechanism which restricts a turnable range of the rotational member, and a second supply side one-way clutch which is disposed between the supply side rotation shaft and the rotational member and which transmits a rotating force in the ribbon winding direction of the supply side rotation shaft to the rotational member and cuts off transmission of the rotating force in the ribbon rewinding direction of the supply side rotation shaft to the rotational member.

According to this structure, slacking of the ink ribbon in the supply roll can be prevented by the urging member and the rotational member when the ink ribbon is wound by the winding roll. Further, according to this structure, even if the ink ribbon is slackened when the ink ribbon cartridge is detached from the printing device, slacking of the ink ribbon can be eliminated by the urging member and the rotational member. Therefore, damage and the like of the ink ribbon can be restrained and handling of the ink ribbon cartridge is also easy. Further, according to this structure, a rotating force in the ribbon rewinding direction of the supply side rotation shaft is not transmitted to the rotational member by operation of the second supply side one-way clutch and thus the urging member does not hinder winding of the ink ribbon by the supply roll.

In at least an embodiment of the present invention, for example, the power transmission mechanism includes a first pulley which is fixed to the supply side rotation shaft, a second pulley and a supply side gear which are connected with each other through the supply side one-way clutch, and a belt which is stretched over the first pulley and the second pulley. Further, in at least an embodiment of the present invention, for example, the power transmission mechanism includes a winding side rotation shaft and a winding side gear, which are connected with each other through the winding side one-way clutch, and a winding side connecting part which is connected with the winding roll, and the winding side rotation shaft and the winding side connecting part are connected with each other through the winding side torque limiter.

The ink ribbon cartridge in accordance with at least an embodiment of the present invention may be used in a printing device which includes a main body part to which the ink ribbon cartridge is detachably attached. In the printing device, for example, the main body part includes a medium conveying passage where a printing medium is conveyed, a thermal head configured to heat the ink ribbon supplied from the supply roll to transfer and print ink of the ink ribbon on the printing medium passing the medium conveying passage, a drive source and a ribbon feed roller which is rotated by power of the drive source to feed the ink ribbon. In the printing device, the ink ribbon can be appropriately fed between the supply roll and the winding roll in both directions while simplifying the structure of the device.

In order to attain the above, at least an embodiment of the present invention provides a printing device including a medium conveying passage where a printing medium is conveyed, a thermal head configured to heat an ink ribbon to transfer and print ink of the ink ribbon on the printing medium passing the medium conveying passage, a supply roll around which the ink ribbon supplied toward the thermal head is wound, a winding roll around which the ink ribbon after ink has been transferred to the printing medium by the thermal head is wound, a drive source for rotating the supply roll and the winding roll, and a power transmission mechanism configured to transmit power from the drive source to the supply roll and the winding roll. When a direction in which the ink ribbon is wound by the winding roll is defined as a ribbon winding direction and a direction in which the ink ribbon is wound by the supply roll is defined as a ribbon rewinding direction, the power transmission mechanism includes a winding side one-way clutch which transmits a driving force in the ribbon winding direction of the drive source to the winding roll and cuts off transmission of the driving force in the ribbon rewinding direction of the drive source to the winding roll, and a supply side one-way clutch which transmits the driving force in the ribbon rewinding direction of the drive source to the supply roll and cuts off transmission of the driving force in the ribbon winding direction of the drive source to the supply roll.

The printing device in accordance with at least an embodiment of the present invention includes a power transmission mechanism which transmits power from a drive source to the supply roll and the winding roll. Therefore, according to at least an embodiment of the present invention, the ink ribbon can be fed in both directions between the supply roll and the winding roll by one drive source. Accordingly, in at least an embodiment of the present invention, the structure of the printing device is simplified and, in addition, the ink ribbon can be fed in both directions between the supply roll and the winding roll.

Further, in at least an embodiment of the present invention, the power transmission mechanism includes a winding side one-way clutch which transmits a driving force in the ribbon winding direction of the drive source to the winding roll and cuts off transmission of the driving force in the ribbon rewinding direction of the drive source to the winding roll, and a supply side one-way clutch which transmits the driving force in the ribbon rewinding direction of the drive source to the supply roll and cuts off transmission of the driving force in the ribbon winding direction of the drive source to the supply roll. Therefore, in at least an embodiment of the present invention, when the ink ribbon is wound by the winding roll, transmission of a driving force of the drive source to the supply roll is cut off and the supply roll can be followed according to rotation of the winding roll. Further, when the ink ribbon is wound by the supply roll, transmission of a driving force of the drive source to the winding roll is cut off and the winding roll can be followed according to rotation of the supply roll. Therefore, according to at least an embodiment of the present invention, when the ink ribbon is fed between the supply roll and the winding roll in both directions, the ink ribbon is prevented from being excessively pulled or prevented from being excessively slackened. As a result, in at least an embodiment of the present invention, the ink ribbon can be appropriately fed between the supply roll and the winding roll in both directions.

In at least an embodiment of the present invention, it is preferable that the printing device includes a ribbon feed roller which is rotated by power of the drive source to feed the ink ribbon, and the power transmission mechanism includes a winding side torque limiter which is disposed between the winding side one-way clutch and the winding roll in a power transmission path from the drive source to the winding roll, and a supply side torque limiter which is disposed between the supply side one-way clutch and the supply roll in a power transmission path from the drive source to the supply roll. According to this structure, even when winding speeds of the ink ribbon by the supply roll and the winding roll are set to be faster than a feed speed of the ink ribbon by the ribbon feed roller, differences between the winding speeds of the ink ribbon by the supply roll and the winding roll and the feed speed of the ink ribbon by the ribbon feed roller can be adjusted by the winding side torque limiter and the supply side torque limiter. Therefore, excessive tension of the ink ribbon can be prevented while preventing slacking of the ink ribbon which is fed between the supply roll and the winding roll.

In at least an embodiment of the present invention, the drive source is, for example, a ribbon feed motor and, when the ribbon feed motor is rotated in one direction, the ink ribbon is fed in the ribbon winding direction and, when the ribbon feed motor is rotated in the other direction, the ink ribbon is fed in the ribbon rewinding direction.

Further, in order to attain the above, at least an embodiment of the present invention provides an ink ribbon cassette including a supply roll around which an ink ribbon is wound, a winding roll around which the ink ribbon supplied from the supply roll is wound, a case body in which the winding roll is accommodated and which includes a winding side cover part which covers a substantially entire ink ribbon wound around the winding roll. When a direction in which the ink ribbon is wound by the winding roll is defined as a ribbon winding direction and a direction in which the ink ribbon is wound by the supply roll is defined as a ribbon rewinding direction, the ink ribbon cassette includes a first rotation prevention mechanism which is provided on one end side in an axial direction of the winding roll and which prevents at least rotation of the winding roll in the ribbon rewinding direction, a second rotation prevention mechanism which is provided on the other end side in the axial direction of the winding roll and which prevents at least rotation of the winding roll in the ribbon rewinding direction, and a first urging member which urges the winding roll to one end side in the axial direction. The first rotation prevention mechanism includes a first roll side engaging part which is provided on a winding roll side, and a first case side engaging part which is provided on a case body side and which is configured to engage with the first roll side engaging part to prevent at least rotation of the winding roll in the ribbon rewinding direction. The second rotation prevention mechanism includes a second roll side engaging part which is provided on the winding roll side, and a second case side engaging part which is provided on the case body side and which is configured to engage with the second roll side engaging part to prevent at least rotation of the winding roll in the ribbon rewinding direction. In a case that a state that the first roll side engaging part and the first case side engaging part are engaged with each other is defined as a first engaging state, a state that engagement of the first roll side engaging part with the first case side engaging part is released is defined as a first engagement released state, a state that the second roll side engaging part and the second case side engaging part are engaged with each other is defined as a second engaging state, and a state that engagement of the second roll side engaging part with the second case side engaging part is released is defined as a second engagement released state, the first engaging state and the second engagement released state are maintained by an urging force of the first urging member and at least rotation of the winding roll in the ribbon rewinding direction is prevented and, when the winding roll is moved to the other end side in the axial direction against the urging force of the first urging member, the winding roll is set in a first state, which is the first engagement released state and the second engagement released state, in which the winding roll is capable of rotating in the ribbon winding direction and the ribbon rewinding direction, or a second state which is the first engagement released state and the second engaging state, in which at least rotation of the winding roll in the ribbon rewinding direction is prevented.

In the ink ribbon cassette in accordance with at least an embodiment of the present invention, the first rotation prevention mechanism provided on one end side in an axial direction of the winding roll includes a first roll side engaging part which is provided on the winding roll side, and a first case side engaging part which is provided on the case body side and which is configured to engage with the first roll side engaging part to prevent at least rotation of the winding roll in the ribbon rewinding direction, and the second rotation prevention mechanism provided on the other end side in the axial direction of the winding roll includes a second roll side engaging part which is provided on the winding roll side, and a second case side engaging part which is provided on the case body side and which is configured to engage with the second roll side engaging part to prevent at least rotation of the winding roll in the ribbon rewinding direction. Further, in the ink ribbon cassette in accordance with at least an embodiment of the present invention, the first engaging state that the first roll side engaging part and the first case side engaging part are engaged with each other is maintained by an urging force of the first urging member, and the second engagement released state that engagement of the second roll side engaging part with the second case side engaging part is released is maintained by the urging force of the first urging member. Therefore, in at least an embodiment of the present invention, when the ink ribbon cassette is detached from the main body part of the printing device to which the ink ribbon cassette is attached, the first roll side engaging part and the first case side engaging part are engaged with each other by the urging force of the first urging member and thus, the used ink ribbon wound around the winding roll cannot be drawn out from the inside of the winding side cover part.

Further, in at least an embodiment of the present invention, when the winding roll is moved to the other end side in its axial direction against the urging force of the first urging member, the winding roll is set in a first state, which is the first engagement released state and the second engagement released state, in which the winding roll is capable of rotating in the ribbon winding direction and the ribbon rewinding direction, or set in a second state which is the first engagement released state and the second engaging state, in which at least rotation of the winding roll in the ribbon rewinding direction is prevented. Therefore, in at least an embodiment of the present invention, in a state that the ink ribbon cassette has been detached from the main body part of the printing device, even when the winding roll is moved to the other end side in the axial direction by using a certain member, unless the winding roll is moved to be set in the first state, the used ink ribbon wound around the winding roll is unable to be drawn out from the inside of the winding side cover part. Accordingly, in at least an embodiment of the present invention, in a state that the ink ribbon cassette has been detached from the main body part of the printing device, the used ink ribbon wound around the winding roll is further difficult to be drawn out from the inside of the winding side cover part in comparison with a conventional technique. As a result, according to this embodiment, its security can be enhanced in comparison with a conventional technique.

In at least an embodiment of the present invention, it is preferable that the first rotation prevention mechanism is a ratchet mechanism and, when the first engaging state and the second engagement released state are maintained by the urging force of the first urging member, the winding roll is capable of rotating in the ribbon winding direction. According to this structure, even when the ink ribbon is slackened between the supply roll and the winding roll by some causes, slacking of the ink ribbon can be eliminated by turning the winding roll in the ribbon winding direction.

In at least an embodiment of the present invention, it is preferable that the ink ribbon cassette includes a third rotation prevention mechanism which is provided on one end side in an axial direction of the supply roll and which prevents at least rotation of the supply roll in the ribbon winding direction, a fourth rotation prevention mechanism which is provided on the other end side in the axial direction of the supply roll and which prevents at least rotation of the supply roll in the ribbon winding direction, and a second urging member which urges the supply roll to one end side in the axial direction, and the case body includes a supply side cover part which covers a substantially entire ink ribbon which is wound around the supply roll and the supply roll is accommodated in the case body. The third rotation prevention mechanism includes a third roll side engaging part which is provided on a supply roll side and a third case side engaging part which is provided on the case body side and which is configured to engage with the third roll side engaging part to prevent at least rotation of the supply roll in the ribbon winding direction, and the fourth rotation prevention mechanism includes a fourth roll side engaging part which is provided on the supply roll side and a fourth case side engaging part which is provided on the case body side and which is configured to engage with the fourth roll side engaging part to prevent at least rotation of the supply roll in the ribbon winding direction. In this case, when a state that the third roll side engaging part and the third case side engaging part are engaged with each other is defined as a third engaging state, a state that engagement of the third roll side engaging part with the third case side engaging part is released is defined as a third engagement released state, a state that the fourth roll side engaging part and the fourth case side engaging part are engaged with each other is defined as a fourth engaging state, and a state that engagement of the fourth roll side engaging part with the fourth case side engaging part is released is defined as a fourth engagement released state, the third engaging state and the fourth engagement released state are maintained by an urging force of the second urging member and at least rotation of the supply roll in the ribbon winding direction is prevented and, when the supply roll is moved to the other end side in the axial direction against the urging force of the second urging member, the supply roll is set in a third state, which is the third engagement released state and the fourth engagement released state, in which the supply roll is capable of rotating in the ribbon winding direction and the ribbon rewinding direction, or set in a fourth state which is the third engagement released state and the fourth engaging state, in which at least rotation of the supply roll in the ribbon winding direction is prevented.

According to this structure, when the ink ribbon cassette has been detached from the main body part of the printing device to which the ink ribbon cassette is attached, the third roll side engaging part and the third case side engaging part are engaged with each other by an urging force of the second urging member and thus, the ink ribbon wound around the supply roll cannot be drawn out from the inside of the supply side cover part. Therefore, slacking of the ink ribbon when the ink ribbon cassette is detached from the main body part can be prevented. Further, according to this structure, structural components on the supply roll side and structural components on the winding roll side of the ink ribbon cassette can be made in common. Therefore, the kinds of components structuring the ink ribbon cassette can be reduced.

The ink ribbon cassette in accordance with at least an embodiment of the present invention may be used in an ink ribbon cartridge which includes a cartridge main body part to which the ink ribbon cassette is detachably attached. In the ink ribbon cartridge, for example, the cartridge main body part includes a winding side engaging part which is engaged with the winding roll from one end side in an axial direction of the winding roll for rotating the winding roll and, when the ink ribbon cassette is attached to the cartridge main body part and the winding side engaging part is engaged with the winding roll, the ink ribbon cassette is set in the first state.

In the ink ribbon cartridge, in a state that the ink ribbon cassette has been detached from the cartridge main body part, the used ink ribbon wound around the winding roll is difficult to be drawn out from the inside of the winding side cover part in comparison with a conventional technique. Further, in the ink ribbon cartridge, when the ink ribbon cassette is attached to the cartridge main body part, the winding roll can be automatically set in the first state that the winding roll is capable of rotating in the ribbon winding direction and the ribbon rewinding direction. Further, in the ink ribbon cartridge, the winding roll can be set in the first state that the winding roll is capable of rotating in the ribbon winding direction and the ribbon rewinding direction by using the winding side engaging part for rotating the winding roll and thus, another member for setting the first state is not required to provide separately. Therefore, the structure of the ink ribbon cartridge can be simplified.

In at least an embodiment of the present invention, it is preferable that the cartridge main body part includes a fifth rotation prevention mechanism which prevents at least rotation of the winding roll in the ribbon rewinding direction. According to this structure, even if the winding roll is automatically set in the first state that the winding roll is capable to rotating in the ribbon winding direction and the ribbon rewinding direction by attaching the ink ribbon cassette to the cartridge main body part, the used ink ribbon wound around the winding roll can be prevented from being drawn out from the inside of the winding side cover part. In other words, even in a state that the ink ribbon cassette is attached to the cartridge main body part, the used ink ribbon is prevented from being drawn out from the inside of the winding side cover part.

The ink ribbon cassette in accordance with at least an embodiment of the present invention may be used in an ink ribbon cartridge including a cartridge main body part to which the ink ribbon cassette is detachably attached. In the ink ribbon cartridge, for example, the cartridge main body part includes a supply side engaging part which is engaged with the supply roll from one end side in the axial direction of the supply roll for rotating the supply roll and, when the ink ribbon cassette is attached to the cartridge main body part and the supply side engaging part is engaged with the supply roll, the ink ribbon cassette is set in the third state.

In the ink ribbon cartridge, in a state that the ink ribbon cassette has been detached from the cartridge main body part, the used ink ribbon wound around the winding roll is difficult to be drawn out from the inside of the winding side cover part in comparison with a conventional technique. Further, in the ink ribbon cartridge, when the ink ribbon cassette is attached to the cartridge main body part, the supply roll can be automatically set in the third state that the supply roll is capable of rotating in the ribbon winding direction and the ribbon rewinding direction. Further, in the ink ribbon cartridge, the supply roll can be set in the third state that the supply roll is capable of rotating in the ribbon winding direction and the ribbon rewinding direction by using the supply side engaging part for rotating the supply roll and thus, another member for setting the third state is not required to provide separately. Therefore, the structure of the ink ribbon cartridge can be simplified.

The ink ribbon cartridge including the ink ribbon cassette in accordance with at least an embodiment of the present invention may be used in a printing device which includes a main body part to which the ink ribbon cartridge is detachably attached. In the printing device, the main body part includes a medium conveying passage where a printing medium is conveyed, and a thermal head configured to heat the ink ribbon supplied from the supply roll to transfer and print ink of the ink ribbon on the printing medium passing the medium conveying passage. In the printing device, in a state that the ink ribbon cassette has been detached from the cartridge main body part, the used ink ribbon wound around the winding roll is difficult to be drawn out from the inside of the winding side cover part in comparison with a conventional technique.

In order to attain the above, at least an embodiment of the present invention provides a printing device including an ink ribbon cartridge having a supply roll around which an ink ribbon is wound and a winding roll by which the ink ribbon supplied from the supply roll is wound, and a main body part to which the ink ribbon cartridge is detachably attached. When a direction in which the ink ribbon is wound by the winding roll is defined as a ribbon winding direction and a direction in which the ink ribbon is wound by the supply roll is defined as a ribbon rewinding direction, the ink ribbon cartridge includes a winding side rotating part for rotating the winding roll, a supply side rotating part for rotating the supply roll, a case body having a cover part which covers a substantially entire ink ribbon wound around the winding roll, and a rotation prevention mechanism which prevents at least rotation of the winding roll in the ribbon rewinding direction. The rotation prevention mechanism includes a first engaging part which is provided on a winding side rotating part side, and a second engaging part which is engaged with the first engaging part to prevent at least rotation of the winding roll in the ribbon rewinding direction. The main body part includes a mounted part on which the ink ribbon cartridge is mounted from an upper side and a cover part which covers the ink ribbon cartridge mounted on the mounted part from the upper side and, when the ink ribbon cartridge has been detached from the main body part, the first engaging part and the second engaging part are engaged with each other, and at least one of the mounted part and the cover part is formed with an engagement release part which is contacted with the second engaging part when the ink ribbon cartridge is attached to the main body part and thereby engagement of the first engaging part with the second engaging part is released.

In the printing device in accordance with at least an embodiment of the present invention, the rotation prevention mechanism which prevents at least rotation of the winding roll in the ribbon rewinding direction includes a first engaging part which is provided on a winding side rotating part side and a second engaging part which is engaged with the first engaging part to prevent at least rotation of the winding roll in the ribbon rewinding direction and, when the ink ribbon cartridge is detached from the main body part, the first engaging part and the second engaging part are engaged with each other. Therefore, in at least an embodiment of the present invention, in a state that the ink ribbon cartridge has been detached from the main body part, the used ink ribbon wound around the winding roll can be prevented from being easily drawn out from the cover part of the case body. Accordingly, in at least an embodiment of the present invention, security of the printing device can be enhanced.

Further, in at least an embodiment of the present invention, the main body part includes a mounted part on which the ink ribbon cartridge is mounted from an upper side and a cover part which covers the ink ribbon cartridge mounted on the mounted part from the upper side, and at least one of the mounted part and the cover part is formed with an engagement release part which is contacted with the second engaging part when the ink ribbon cartridge is attached to the main body part and thereby engagement of the first engaging part with the second engaging part is released. Therefore, according to at least an embodiment of the present invention, even when the ink ribbon cartridge is attached to and detached from the main body part from an upper side of the printing device, engagement of the first engaging part with the second engaging part can be released. Accordingly, in at least an embodiment of the present invention, in a state that the ink ribbon cartridge has been detached from the main body part, the used ink ribbon wound around the winding roll is prevented from being easily drawn out from the cover part of the case body and, in addition, the ink ribbon cartridge can be attached to and detached from the main body part from an upper side of the printing device. As a result, in at least an embodiment of the present invention, in a state that the ink ribbon cartridge has been detached from the main body part, the used ink ribbon wound around the winding roll is prevented from being easily drawn out from the cover part of the case body and, in addition, in a host device on which the printing device is mounted, flexibility of layout of the printing device can be enhanced.

In at least an embodiment of the present invention, it is preferable that the engagement release part is formed in the cover part. According to this structure, unless an upper side of the ink ribbon cartridge is covered by the cover part, engagement of the first engaging part with the second engaging part is not released. Therefore, when the ink ribbon cartridge is mounted on the mounted part but an upper side of the ink ribbon cartridge is not covered by the cover part, the used ink ribbon wound around the winding roll can be prevented from being drawn out from the cover part.

In at least an embodiment of the present invention, it is preferable that the rotation prevention mechanism includes one piece of the first engaging part and a plurality of the second engaging parts. According to this structure, unless engaging states of each of a plurality of the second engaging parts with the first engaging part are released, in a state that the ink ribbon cartridge has been detached from the main body part, the used ink ribbon wound around the winding roll cannot be drawn out from the cover part. Therefore, the used ink ribbon is further hard to be drawn out from the cover part.

In at least an embodiment of the present invention, it is preferable that the rotation prevention mechanism includes two pieces of the second engaging part, the engagement release part is formed in each of the mounted part and the cover part, the engagement release part formed in the mounted part is contacted with one of two pieces of the second engaging part to release engagement of the one of two pieces of the second engaging part with the first engaging part, and the engagement release part formed in the cover part is contacted with the other of the two pieces of the second engaging part to release engagement of the other second engaging part with the first engaging part. According to this structure, unless an upper side of the ink ribbon cartridge is covered by the cover part, engagement of the first engaging part with the other second engaging part is not released. Therefore, when the ink ribbon cartridge is mounted on the mounted part but an upper side of the ink ribbon cartridge is not covered by the cover part, the used ink ribbon wound around the winding roll can be prevented from being drawn out from the cover part. Further, according to this structure, one engagement release part is required to be formed in each of the mounted part and the cover part and thus the engagement release part is easily formed.

In at least an embodiment of the present invention, it is preferable that the rotation prevention mechanism is a ratchet mechanism and, when the first engaging part and the second engaging part are engaged with each other, the winding roll is capable of rotating in the ribbon winding direction. According to this structure, even if the ink ribbon is slackened between the supply roll and the winding rolls due to some causes, slacking of the ink ribbon can be eliminated by rotating the winding roll in the ribbon winding direction.

In at least an embodiment of the present invention, for example, the first engaging part is a gear, the second engaging part is a pawl member which is engaged with the gear, the rotation prevention mechanism includes a fixed shaft which turnably supports the pawl member and an urging member which urges the pawl member to one side in a turning direction with the fixed shaft as a center, the pawl member is engaged with the gear by an urging force of the urging member and, when the engagement release part is contacted with the pawl member, the pawl member is turned to the other side in the turning direction with the fixed shaft as the center and an engaging state of the gear with the pawl member is released.

In order to attain the above, at least an embodiment of the present invention provides a printing device including an ink ribbon cartridge having a supply roll around which an ink ribbon is wound and a winding roll by which the ink ribbon supplied from the supply roll is wound, a housing to which the ink ribbon cartridge is detachably attached, a ribbon feed mechanism for feeding the ink ribbon between the supply roll and the winding roll, and a thermal head configured to heat the ink ribbon supplied from the supply roll to transfer and print ink of the ink ribbon on a printing medium. The ink ribbon cartridge includes a case body having a cover part which covers a substantially entire ink ribbon wound around the winding roll and, when a direction in which the ink ribbon is wound by the winding roll is defined as a ribbon winding direction and a direction in which the ink ribbon is wound by the supply roll is defined as a ribbon rewinding direction, after printing is finished on one piece of the printing medium by the thermal head, the ribbon feed mechanism feeds the ink ribbon in the ribbon winding direction until a peeled trace of ink of the ink ribbon transferred to the printing medium at the time of printing on the printing medium is entered into the cover part and, when a next one piece of the printing medium is to be printed, the ink ribbon is fed in the ribbon rewinding direction by a feed amount not more than a feed amount which is fed after printing on the former one piece of the printing medium is finished.

In the printing device in accordance with at least an embodiment of the present invention, after printing on one piece of the printing medium by the thermal head is finished, the ribbon feed mechanism feeds the ink ribbon in the ribbon winding direction until a peeled trace of ink of the ink ribbon transferred to the printing medium at the time of printing on the printing medium is entered into the cover part. Therefore, according to at least an embodiment of the present invention, when the ink ribbon cartridge is detached from the housing, a peeled trace of ink left on the used ink ribbon is entered into the cover part and thus, in the ink ribbon cartridge detached from the housing, the peeled trace left on the ink ribbon cannot be confirmed by visual observation. Accordingly, in at least an embodiment of the present invention, in a state that the ink ribbon cartridge has been detached from the housing, an image printed on the printing medium is prevented from being acquired from the peeled trace of ink left on the used ink ribbon.

Further, in at least an embodiment of the present invention, when a next one piece of the printing medium is to be printed, the ink ribbon is fed in the ribbon rewinding direction by a feed amount not more than the feed amount which has been fed after printing on the former one piece of the printing medium is finished and thus, a used amount of the ink ribbon can be reduced. In other words, in at least an embodiment of the present invention, in a state that the ink ribbon cartridge has been detached from the housing, an image printed on the printing medium is prevented from being acquired from the peeled trace of ink left on the used ink ribbon and, in addition, a used amount of the ink ribbon can be reduced.

In at least an embodiment of the present invention, it is preferable that, when a region of the ink ribbon required to print on one piece of the printing medium is referred to as one printing region, after printing is finished on one piece of the printing medium, the ribbon feed mechanism feeds the ink ribbon in the ribbon winding direction by a feed amount which is not less than a length of the one printing region and, when the next one piece of the printing medium is to be printed, the ribbon feed mechanism feeds the ink ribbon in the ribbon rewinding direction so that a reference position of the next printing medium and a reference position of the one printing region are coincided with each other. Further, in this case, it is further preferable that, when the next one piece of the printing medium is to be printed, the ribbon feed mechanism feeds the ink ribbon in the ribbon rewinding direction so that the reference position of the next printing medium is coincided with a reference position of a next unused one printing region to the one printing region having been used when the former one piece of the printing medium has been printed. According to this structure, printing can be performed on a printing medium by using one printing region arranged in a longitudinal direction of the ink ribbon in order. Therefore, a used amount of the ink ribbon can be reduced effectively.

In at least an embodiment of the present invention, it is preferable that the ink ribbon cartridge includes a winding side rotating part for rotating the winding roll, a supply side rotating part for rotating the supply roll, and a rotation prevention mechanism which prevents at least rotation of the winding roll in the ribbon rewinding direction. The rotation prevention mechanism includes a first engaging part which is provided on a winding side rotating part side and a second engaging part which is engaged with the first engaging part to prevent at least rotation of the winding roll in the ribbon rewinding direction and, when the ink ribbon cartridge has been detached from the housing, the first engaging part and the second engaging part are engaged with each other and, when the ink ribbon cartridge is attached to the housing, engagement of the first engaging part with the second engaging part is released. According to this structure, in a state that the ink ribbon cartridge has been detached from the housing, the used ink ribbon wound around the winding roll can be prevented from being easily drawn out from the cover part of the case body. Therefore, in a state that the ink ribbon cartridge has been detached from the housing, an image printed on the printing medium is prevented from being acquired from the peeled trace of ink which is left on the used ink ribbon.

In order to attain the above, at least an embodiment of the present invention provides a control method for a printing device including an ink ribbon cartridge having a supply roll around which an ink ribbon is wound and a winding roll by which the ink ribbon supplied from the supply roll is wound, a housing to which the ink ribbon cartridge is detachably attached, a ribbon feed mechanism for feeding the ink ribbon between the supply roll and the winding roll, a thermal head configured to heat the ink ribbon supplied from the supply roll to transfer and print ink of the ink ribbon on a printing medium, and the ink ribbon cartridge includes a case body having a cover part which covers a substantially entire ink ribbon wound around the winding roll. When a direction in which the ink ribbon is wound by the winding roll is defined as a ribbon winding direction and a direction in which the ink ribbon is wound by the supply roll is defined as a ribbon rewinding direction, the control method includes a ribbon forward feeding step in which, after printing is finished on one piece of the printing medium by the thermal head, the ink ribbon is fed in the ribbon winding direction until a peeled trace of ink of the ink ribbon transferred to the printing medium at the time of printing on the printing medium is entered into the cover part, and a ribbon backward feeding step in which, when a next one piece of the printing medium is to be printed, the ink ribbon is fed in the ribbon rewinding direction by a feed amount not more than a feed amount in the ribbon forward feeding step.

In the control method for a printing device in accordance with at least an embodiment of the present invention, in the ribbon forward feeding step, after printing is finished on one piece of the printing medium by the thermal head, the ink ribbon is fed in the ribbon winding direction until a peeled trace of ink of the ink ribbon transferred to the printing medium at the time of printing on the printing medium is entered into the cover part. Therefore, according to at least an embodiment of the present invention, when the ink ribbon cartridge is detached from the housing, a peeled trace of ink which is left on the used ink ribbon is entered into the cover part and thus, in the ink ribbon cartridge detached from the housing, the peeled trace left on the ink ribbon cannot be confirmed by visual observation. Accordingly, in the printing device controlled in the control method in accordance with at least an embodiment of the present invention, in a state that the ink ribbon cartridge has been detached from the housing, an image printed on the printing medium is prevented from being acquired from the peeled trace of ink which is left on the used ink ribbon.

Further, in at least an embodiment of the present invention, when a next one piece of the printing medium is to be printed, in the ribbon backward feeding step, the ink ribbon is fed in the ribbon rewinding direction by a feed amount not more than the feed amount in the ribbon forward feeding step and thus, a used amount of the ink ribbon can be reduced. In other words, in the printing device controlled in the control method in accordance with at least an embodiment of the present invention, in a state that the ink ribbon cartridge has been detached from the housing, an image printed on the printing medium is prevented from being acquired from the peeled trace of ink which is left on the used ink ribbon and, in addition, a used amount of the ink ribbon can be reduced.

As described above, in the ink ribbon cartridge in accordance with at least an embodiment of the present invention, the structure of the printing device to which the ink ribbon cartridge is attached is simplified and, in addition, in the printing device, the ink ribbon can be fed in both directions between the supply roll and the winding roll. Further, in the printing device in accordance with at least an embodiment of the present invention, the structure of the device is simplified and, in addition, the ink ribbon can be fed in both directions between the supply roll and the winding roll.

Further, in at least an embodiment of the present invention, in a state that the ink ribbon cassette has been detached from the main body part of the printing device or from the cartridge main body part, the used ink ribbon is difficult to be drawn out from the winding side cover part in comparison with a conventional technique.

Further, according to at least an embodiment of the present invention, in a state that the ink ribbon cartridge has been detached from the main body part of the printing device, the used ink ribbon is prevented from being easily drawn out from the cover part which covers a substantially entire ink ribbon wound around the winding roll and, in addition, in a host device on which the printing device is mounted, flexibility of layout of the printing device can be enhanced.

Further, in the printing device in accordance with at least an embodiment of the present invention, in a state that the ink ribbon cartridge has been detached from the housing of the printing device, an image printed on the printing medium is prevented from being acquired from the peeled trace of ink which is left on the used ink ribbon. Further, in the printing device controlled in the control method in accordance with at least an embodiment of the present invention, in a state that the ink ribbon cartridge has been detached from the housing of the printing device, an image printed on the printing medium is prevented from being acquired from the peeled trace of ink which is left on the used ink ribbon.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DESCRIPTION OF EMBODIMENTS

Embodiments of the present invention will be described below with reference to the accompanying drawings.

(Schematic Structure of Printing Device)

Figure 1:
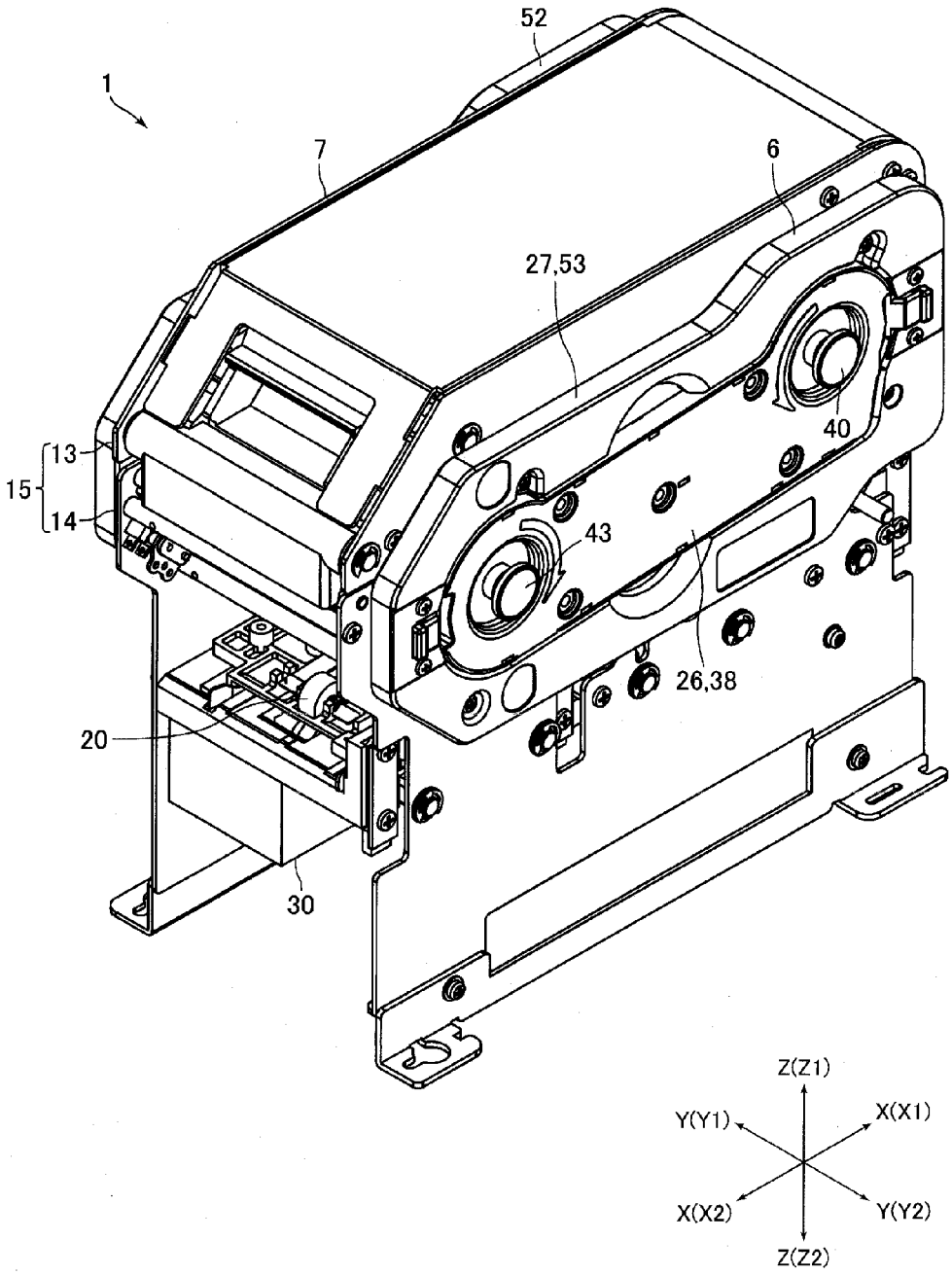
FIG. 1 is a perspective view showing a printing device in accordance with an embodiment of the present invention.
Figure 2:
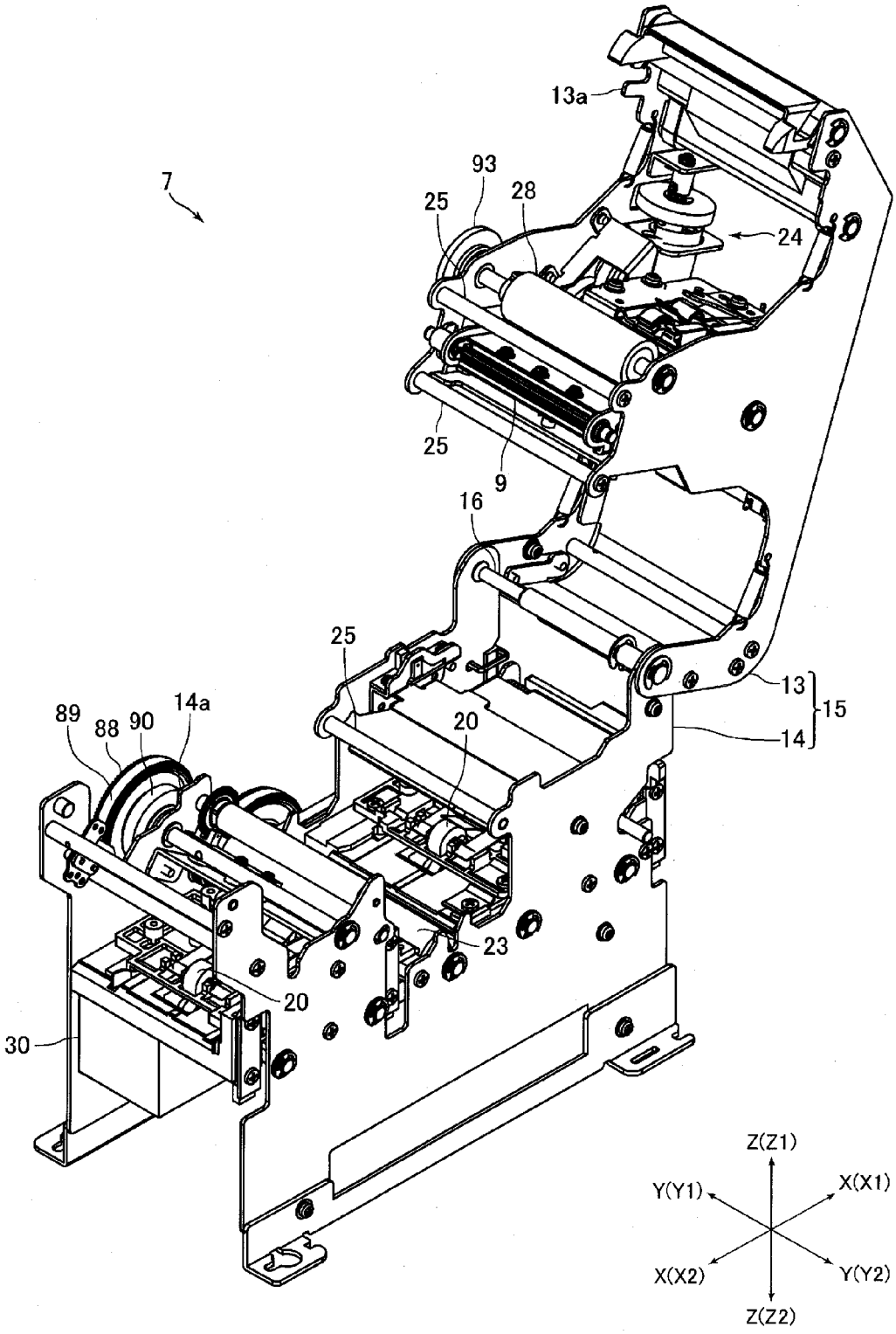
FIG. 2 is a perspective view showing a state that an ink ribbon cartridge has been detached from the printing device shown in FIG. 1.
Figure 3:
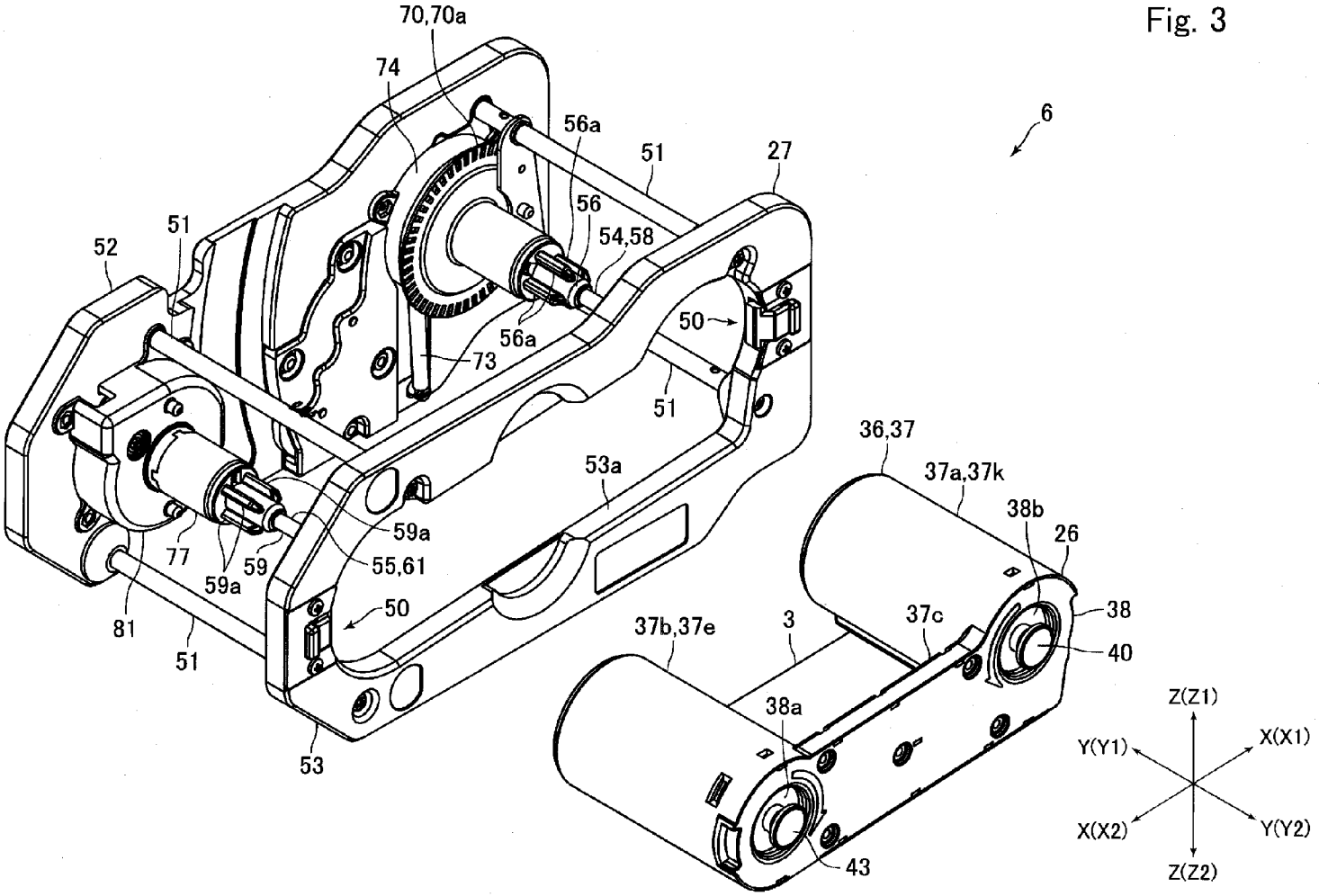
FIG. 3 is an exploded perspective view showing an ink ribbon cartridge in FIG. 1.
Figure 4:
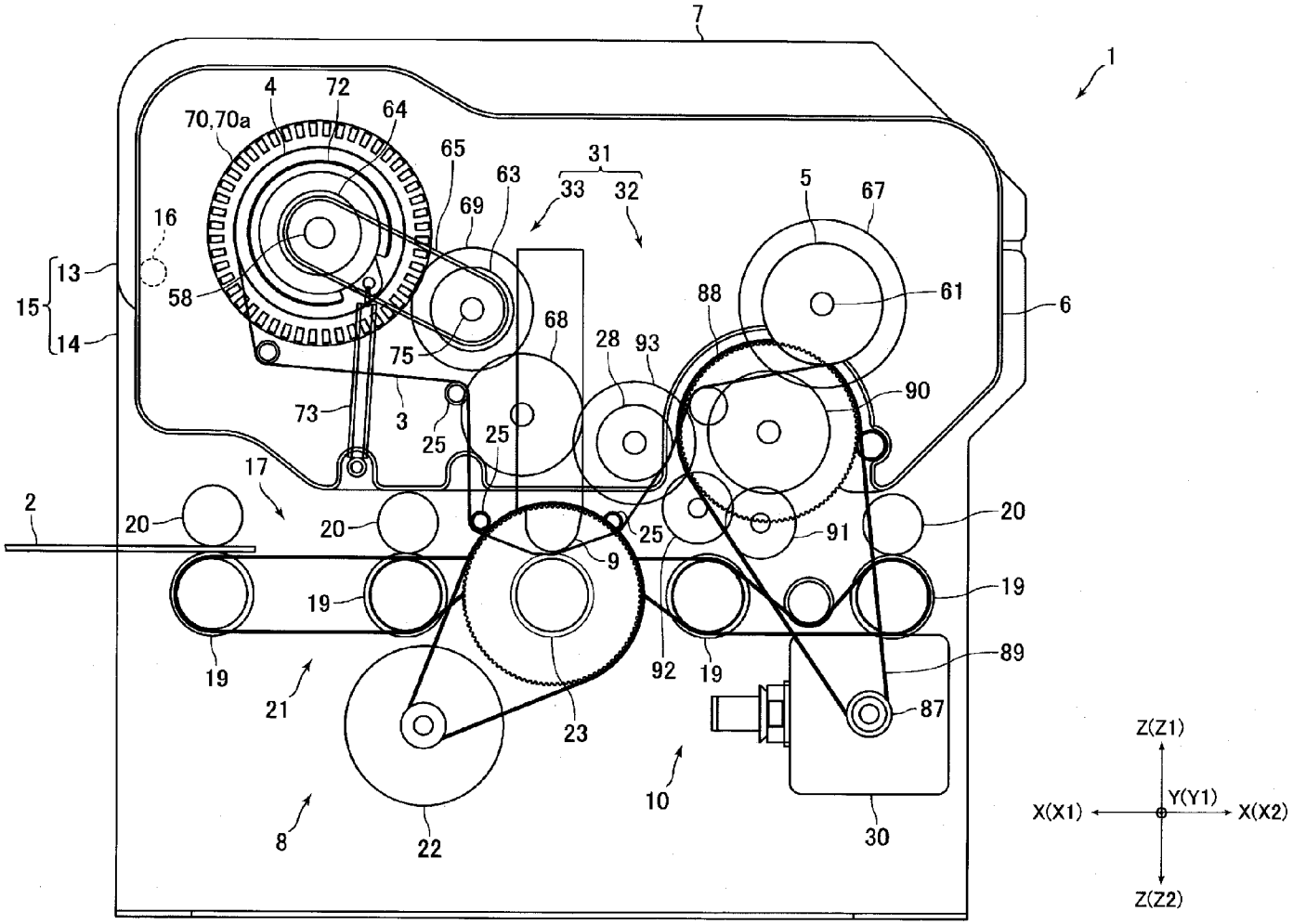
FIG. 4 is an explanatory side view showing an internal structure of the printing device shown in FIG. 1.
Figure 5:
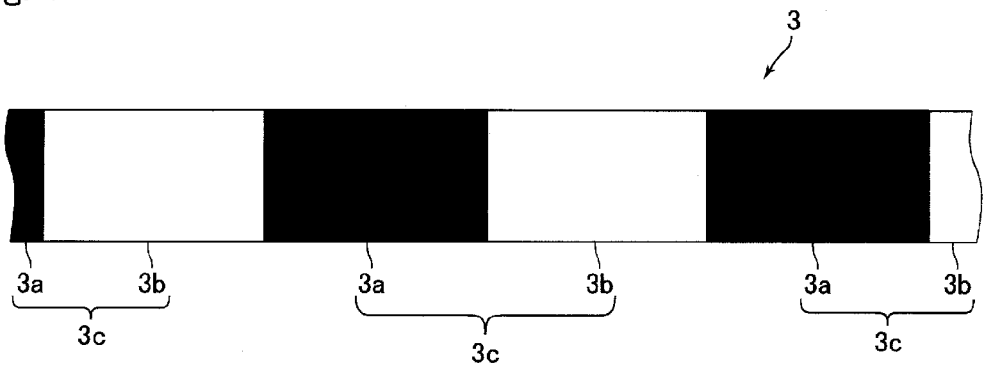
FIG. 5 is a plan view showing a part of an ink ribbon shown in FIG. 4.

FIG. 1 is a perspective view showing a printing device 1 in accordance with an embodiment of the present invention. FIG. 2 is a perspective view showing a state that an ink ribbon cartridge 6 has been detached from the printing device 1 shown in FIG. 1. FIG. 3 is an exploded perspective view showing an ink ribbon cartridge 6 in FIG. 1. FIG. 4 is an explanatory side view showing an internal structure of the printing device 1 shown in FIG. 1. FIG. 5 is a plan view showing a part of an ink ribbon 3 shown in FIG. 4.

A printing device 1 in this embodiment is a device for printing an image such as a character, a symbol and a figure on a card 2 (see FIG. 4) which is a printing medium. Specifically, the printing device 1 is a thermal transfer type printing device with the use of an ink ribbon 3 formed of a film in a strip shape on which ink is applied and the ink of the ink ribbon 3 is transferred and printed on a card 2 by heating the ink of the ink ribbon 3. The printing device 1 is, for example, mounted for use on a host device such as a card issuing device.

The printing device 1 is, as shown in FIG. 4, structured of an ink ribbon cartridge 6 (hereinafter, referred to as a "cartridge 6") having a supply roll 4 and a winding roll 5 around which an ink ribbon 3 is wound, and a main body part 7 to which the cartridge 6 is detachably attached. Further, the printing device 1 includes a card conveying mechanism 8 for conveying a card 2, a thermal head 9 for heating an ink ribbon 3 to transfer and print ink of the ink ribbon 3 on the card 2, and a ribbon feed mechanism 10 for feeding the ink ribbon 3 between the supply roll 4 and the winding roll 5.

A card 2 is, for example, a card made of vinyl chloride whose thickness is about 0.7-0.8 mm and is formed in a substantially rectangular shape. A surface of the card 2 is, for example, formed with a magnetic stripe in which magnetic data are recorded. An IC chip and an antenna for communication may be built in an inside of the card 2. Further, the card 2 may be a PET (polyethylene terephthalate) card whose thickness is about 0.18-0.36 mm and may be a paper card having a predetermined thickness.

An ink ribbon 3 is, as shown in FIG. 5, provided with an ink region 3*a* formed with an ink layer which is a layer of ink to be transferred to a card 2, and an overcoat region 3*b* formed with an overcoat layer which is a layer of overcoat material for covering the surface of the ink transferred to the card 2. The ink region 3*a* and the overcoat region 3*b* are alternately arranged in a longitudinal direction of the ink ribbon 3 which is formed in a strip shape. A width of the ink region 3*a* in the longitudinal direction of the ink ribbon 3 is substantially equal to a width of the overcoat region 3*b*. Further, a width of the ink region 3*a* and a width of the overcoat region 3*b* in the longitudinal direction of the ink ribbon 3 is substantially equal to a width in a longitudinal direction of a card 2.

In this embodiment, printing is performed on one card 2 by using one ink region 3*a* and one overcoat region 3*b*. In other words, in this embodiment, one printing region 3*c* which is a region of an ink ribbon 3 required for printing on one card 2 is structured of one ink region 3*a* and one overcoat region 3*b*. Further, the ink ribbon 3 in this embodiment is capable of performing print of a single color (for example, black).

In the following descriptions, respective three directions perpendicular to each other in FIG. 1 are set to be an "X" direction, a "Y" direction and a "Z" direction. Further, the "X" direction is set in a "front and rear direction", the "Y" direction is set in a "right and left direction", and the "Z" direction is in an "upper and lower direction". Further, an "X1" direction side is referred to as a "front" side, an "X2" direction side is referred to as a "rear" (back) side, a "Y1" direction side is a "left" side, a "Y2" direction side is a "right" side, a "Z1" direction side is an "upper" side, and a "Z2" direction side is a "lower part" side. Further, a clockwise direction in FIG. 4 is referred to as a "clockwise direction" and a counterclockwise direction in FIG. 4 is referred to as a "counterclockwise direction". In this embodiment, a card 2 is conveyed from a front side toward a rear side by the card conveying mechanism 8 so that a longitudinal direction of the card 2 formed in a substantially rectangular shape is substantially coincided with the front and rear direction ("X" direction) and that a thickness direction of the card 2 is substantially coincided with the upper and lower direction ("Z" direction).

A main body part 7 includes a housing 15 which is structured of a first housing 13 disposed on an upper side and a second housing 14 disposed on a lower side. A shaft 16 (see FIGS. 2 and 4) which is disposed with the right and left direction as an axial direction is attached on a front upper end side of the second housing 14. The front end side of the first housing 13 is turnably held by the shaft 16 and the first housing 13 is capable of turning with respect to the second housing 14 in a counterclockwise direction (counterclockwise direction in FIG. 4) from a state shown in FIG. 1 with the shaft 16 as a turning center. When the first housing 13 is turned in the counterclockwise direction from the state shown in FIG. 1 with the shaft 16 as a center, the cartridge 6 can be taken out toward an upper side from the housing 15. Further, in a state shown in FIG. 2, when a cartridge 6 is mounted on the second housing 14 from an upper side and the first housing 13 is turned in a clockwise direction to cover the cartridge 6 from an upper side, the cartridge 6 is attached to the housing 15. The second housing 14 in this embodiment is a mounted part on which the cartridge 6 is mounted from an upper side, and the first housing 13 is a cover part for covering the cartridge 6 from an upper side which is mounted on the second housing 14 that is a mounted part.

The card conveying mechanism 8 and the thermal head 9 are attached to the housing 15. In other words, the main body part 7 includes the card conveying mechanism 8 and the thermal head 9. Further, a card conveying passage 17 as a medium conveying passage where a card 2 is conveyed is formed in an inside of the main body part 7. The card conveying passage 17 is formed in a straight shape so as to penetrate through the printing device 1 in the front and rear direction.

The card conveying mechanism 8 includes a plurality of card conveying rollers 19 which are abutted with a card 2 to convey the card 2 and pad rollers 20 which are oppositely disposed to the card conveying rollers 19. The card conveying rollers 19 are disposed so as to face the card conveying passage 17 from a lower side. A plurality of the card conveying rollers 19 is connected with a card conveyance motor 22 through a power transmission mechanism 21 which is structured of a pulley, a timing belt and the like. The pad roller 20 faces the card conveying roller 19 from an upper side and is urged toward the card conveying roller 19.

The thermal head 9 is disposed at a substantially center in the front and rear direction of the printing device 1 and on an upper side with respect to the card conveying passage 17. A platen roller 23 is disposed on a lower side with respect to the thermal head 9. The platen roller 23 is connected with the card conveyance motor 22 through the power transmission mechanism 21 and is rotated together with the card conveying rollers 19. Further, the thermal head 9 is connected with a head moving mechanism 24 (see FIG. 2) which moves the thermal head 9 in a direction approaching a card 2 passing through the card conveying passage 17 and in a direction separated from the card 2.

A card 2 and the ink ribbon 3 are passed between the thermal head 9 and the platen roller 23 in the upper and lower direction. Further, the thermal head 9 is moved up and down with respect to the card conveying passage 17 (specifically, with respect to the platen roller 23) by power transmitted from the head moving mechanism 24. The thermal head 9 is abutted with an upper face of a card 2 with a predetermined abutting force through an ink ribbon 3 to perform printing on the upper face of the card 2 passing through the card conveying passage 17.

Guide shafts 25 for guiding the ink ribbon 3 in an inside of the printing device 1 are disposed on both sides with respect to the thermal head 9 in the front and rear direction. The guide shaft 25 is fixed to the first housing 13 or the second housing 14 with the right and left direction as an axial direction. The guide shafts 25 are disposed on an upper side with respect to the card conveying passage 17.

The cartridge 6 includes an ink ribbon cassette 26 having the supply roll 4 and the winding roll 5 and a cartridge main body part 27 to which the ink ribbon cassette 26 is detachably attached (see FIG. 3). The cartridge 6 is disposed on an upper side with respect to the card conveying passage 17 and is capable of being attached to and detached from the housing 15 from an upper side. The supply roll 4 and the winding roll 5 are disposed so that their axial directions and the right and left direction are coincided with each other. Further, the supply roll 4 is disposed on a front side with respect to the thermal head 9, and an ink ribbon 3 (unused ink ribbon 3) which is to be supplied toward the thermal head 9 is wound around the supply roll 4. The winding roll 5 is disposed on a rear side with respect to the thermal head 9 and an ink ribbon 3 (used ink ribbon 3) which has been supplied from the supply roll 4 and whose ink has been transferred to a card 2 by the thermal head 9 is wound around the winding roll 5. A specific structure of the cartridge 6 will be described below.

A ribbon feed mechanism 10 includes a ribbon feed roller 28 which is abutted with an ink ribbon 3 to feed the ink ribbon 3 and a pad roller which is oppositely disposed to the ribbon feed roller 28. Further, the ribbon feed mechanism 10 includes a ribbon feed motor 30 with which the ribbon feed roller 28 is connected and a power transmission mechanism 31 (see FIG. 4) for transmitting power of the ribbon feed motor 30 to the ribbon feed roller 28 and the like.

The ribbon feed roller 28 is disposed on an obliquely rear upper side with respect to the thermal head 9 and is disposed between the thermal head 9 and the winding roll 5. Further, the ribbon feed roller 28 is rotatably held by the first housing 13. A pad roller faces the ribbon feed roller 28 from a substantially rear side and is urged toward the ribbon feed roller 28. The power transmission mechanism 31 is structured of a power transmission mechanism 32 structuring a part of the main body part 7 and a power transmission mechanism 33 structuring a part of the cartridge 6.

In this embodiment, the ribbon feed mechanism 10 is capable of feeding the ink ribbon 3 in both directions, i.e., in a direction where the ink ribbon 3 is wound by the winding roll 5 (hereinafter, this direction is referred to as a "ribbon winding direction") and a direction where the ink ribbon 3 is wound by the supply roll 4 (hereinafter, this direction is referred to as a "ribbon rewinding direction"). When the ink ribbon 3 is fed in the ribbon winding direction, the ribbon feed roller 28, the supply roll 4 and the winding roll 5 are rotated in the counterclockwise direction and, when the ink ribbon 3 is fed in the ribbon rewinding direction, the ribbon feed roller 28, the supply roll 4 and the winding roll 5 are rotated in the clockwise direction. Specific structures of the power transmission mechanisms 32 and 33 will be described below.

When printing on a card 2 is performed by using the thermal head 9, a peeled trace of ink which has been transferred to the card 2 is formed on the ink ribbon 3. In this embodiment, the ribbon feed mechanism 10 successively feeds the ink ribbon 3 in the ribbon winding direction at the time of printing for one card 2 so that a peeled trace of ink which is the same shape as the image printed on the card 2 is formed on the used ink ribbon 3.

(Structure of Ink Ribbon Cassette)

Figure 6:
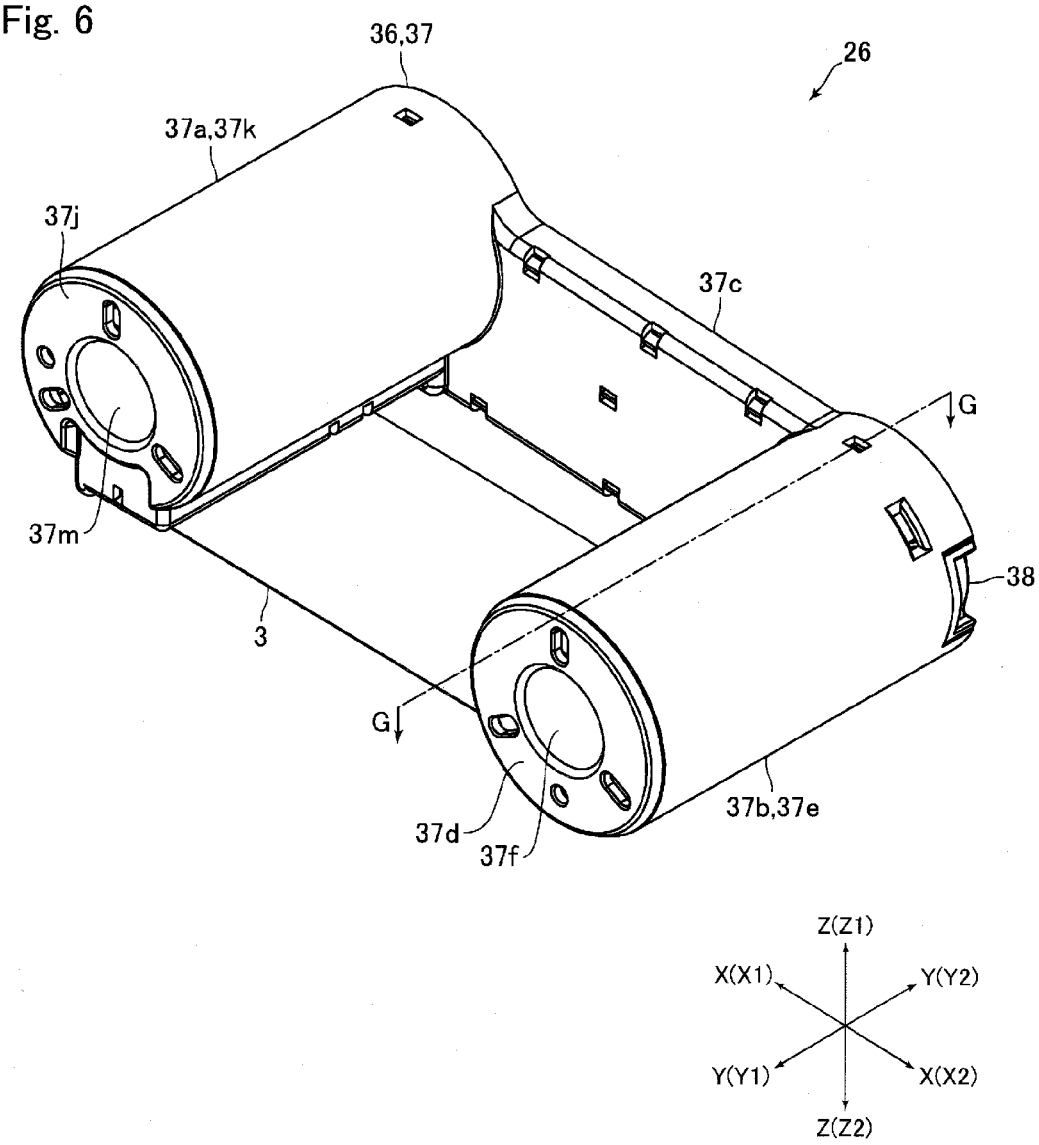
FIG. 6 is a perspective view showing an ink ribbon cassette in FIG. 3 which is viewed from another angle.
Figure 7:
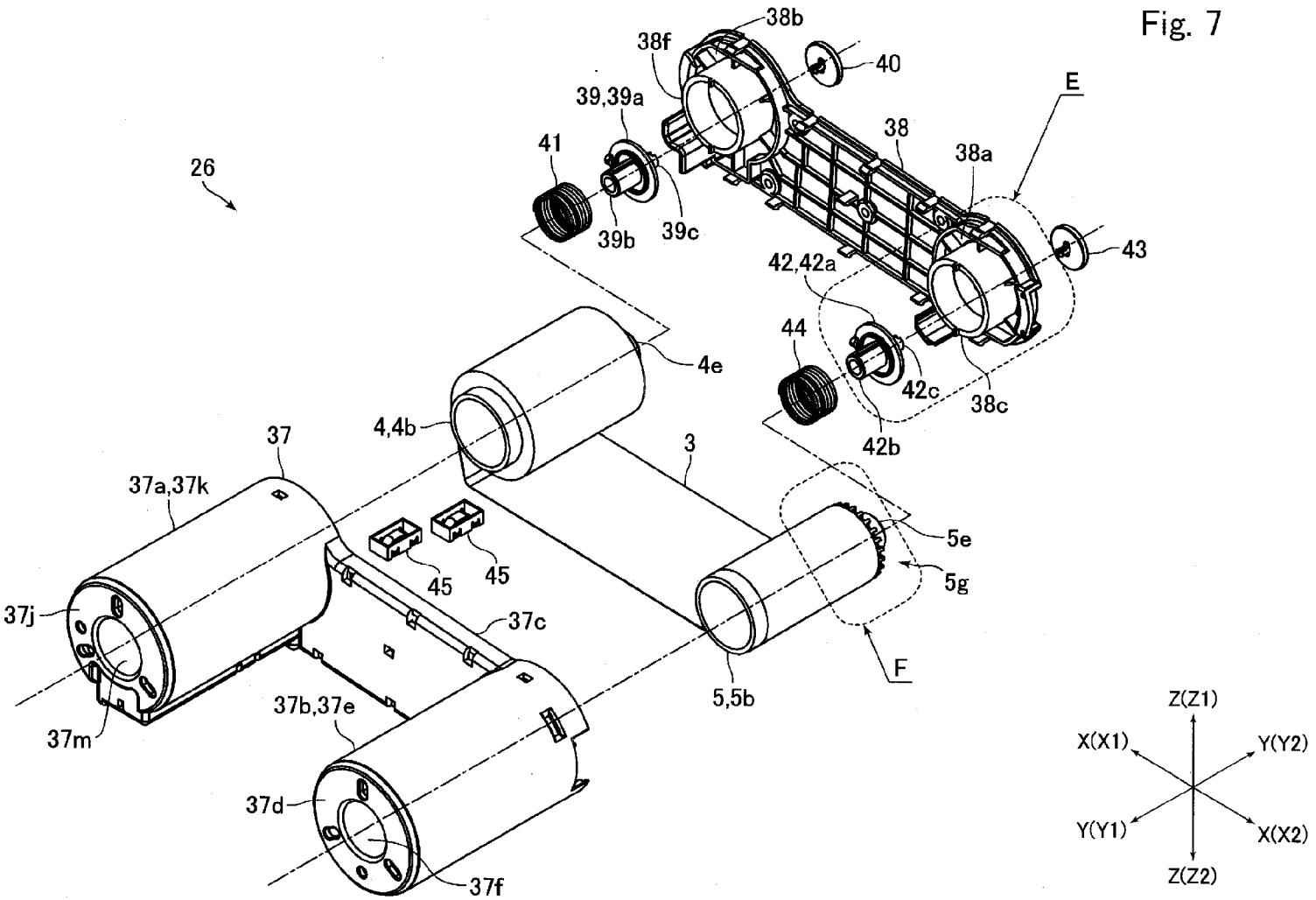
FIG. 7 is an exploded perspective view showing the ink ribbon cassette in FIG. 6.
Figure 8:
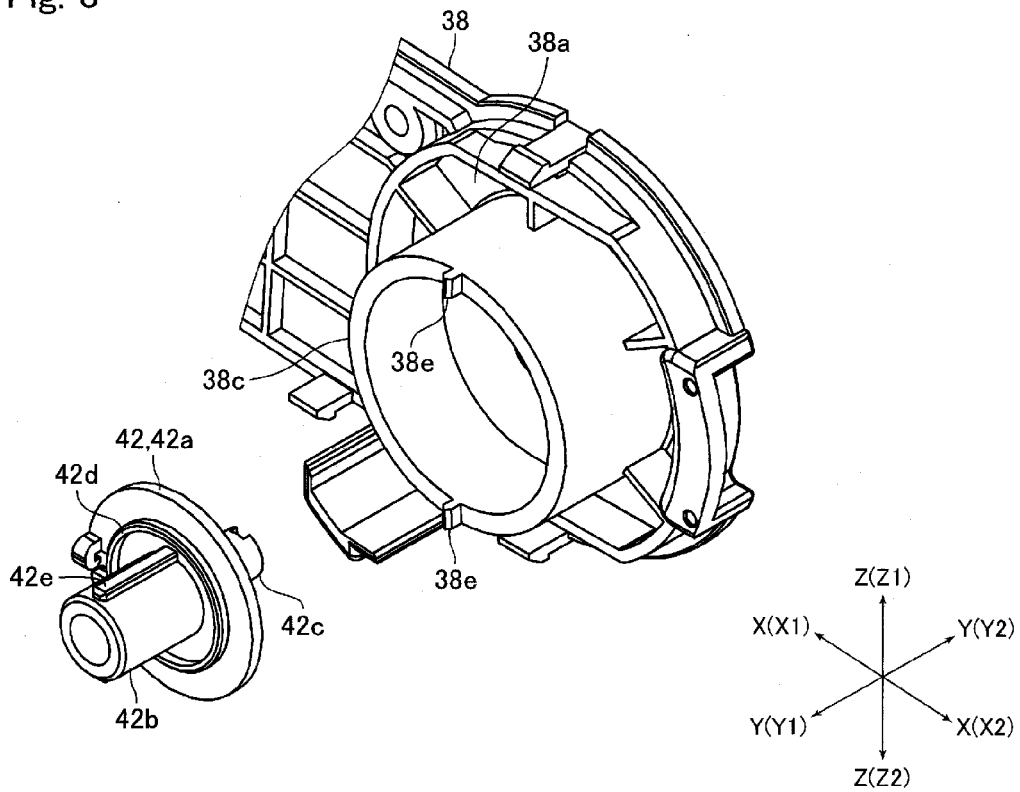
FIG. 8 is an enlarged view showing the "E" part in FIG. 7.
Figure 9:
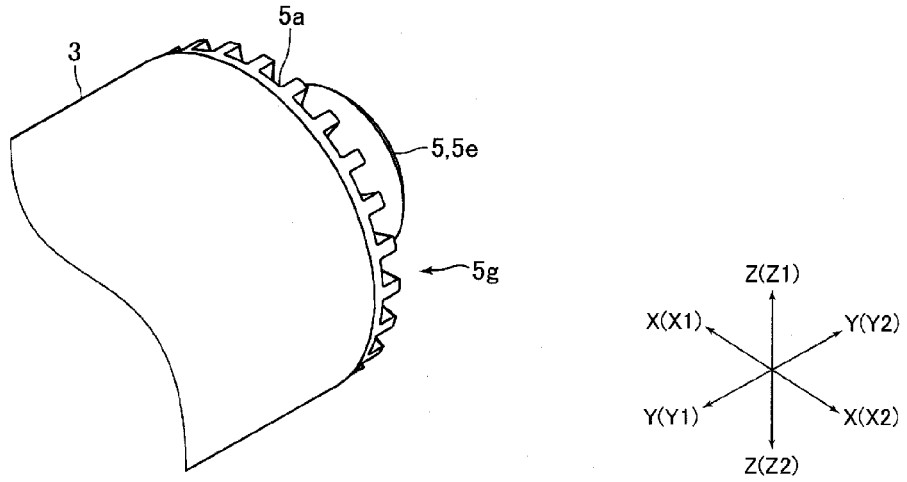
FIG. 9 is an enlarged view showing the "F" part in FIG. 7.
Figure 10:
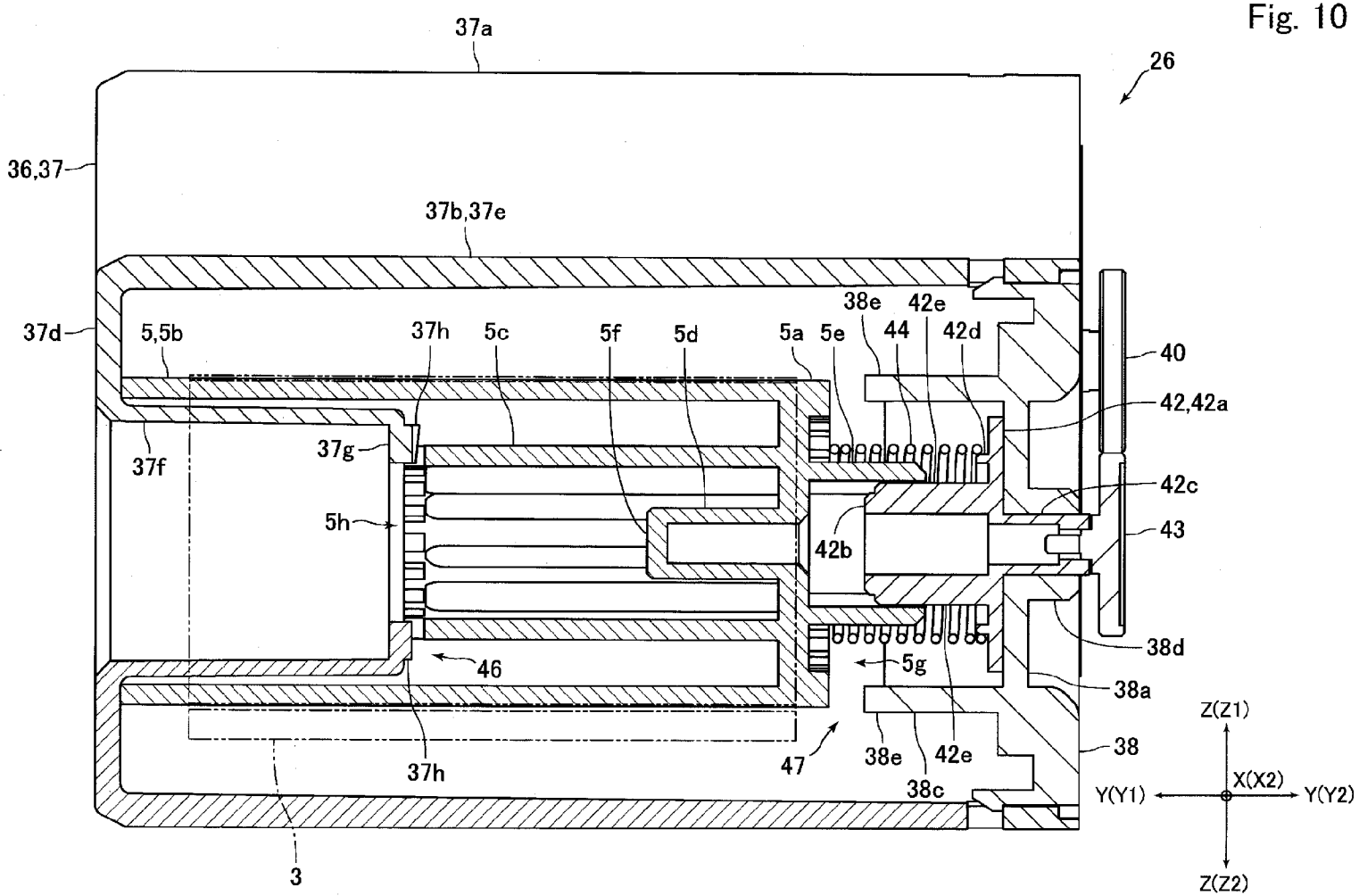
FIG. 10 is a cross-sectional view showing the "G-G" cross section in FIG. 6.
Figure 11:
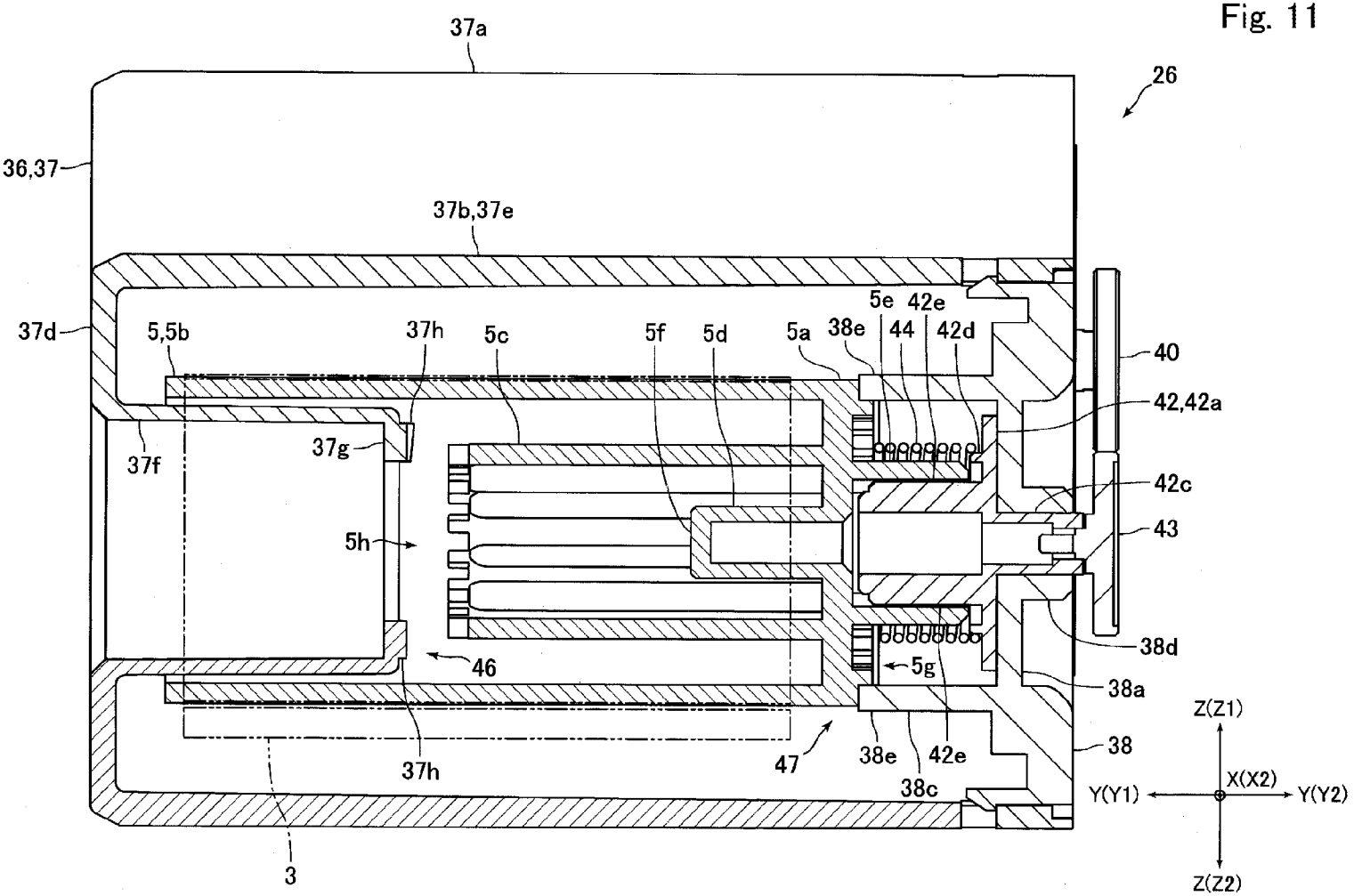
FIG. 11 is an explanatory cross-sectional view showing a state when a winding roll shown in FIG. 10 has been moved against an urging force of a compression coil spring.

FIG. 6 is a perspective view showing the ink ribbon cassette 26 shown in FIG. 3 which is viewed from another angle. FIG. 7 is an exploded perspective view showing the ink ribbon cassette 26 in FIG. 6. FIG. 8 is an enlarged view showing the "E" part in FIG. 7. FIG. 9 is an enlarged view showing the "F" part in FIG. 7. FIG. 10 is a cross-sectional view showing the "G-G" cross section in FIG. 6. FIG. 11 is an explanatory cross-sectional view showing a state when the winding roll 5 shown in FIG. 10 has been moved against an urging force of a compression coil spring 44.

The ink ribbon cassette 26 includes, in addition to the supply roll 4 and the winding roll 5, a case body 36 in which the supply roll 4 and the winding roll 5 are accommodated. The case body 36 includes a case main body 37 and a cover member 38 which is fixed to a right end side of the case main body 37. Further, the ink ribbon cassette 26 includes a sleeve 39 and a knob 40 for turning the supply roll 4 by a hand operation, a compression coil spring 41 as a second urging member which urges the supply roll 4 to a left side, a sleeve 42 and a knob 43 for turning the winding roll 5 by a hand operation, and a compression coil spring 44 as a first urging member which urges the winding roll 5 to a left side.

The case main body 37 includes a cover part 37*a* as a supply side cover part for covering a substantially entire ink ribbon 3 which is wound around the supply roll 4, a cover part 37*b* as a winding side cover part for covering a substantially entire ink ribbon 3 which is wound around the winding roll 5, and a connecting part 37*c* which connects the cover part 37*a* with the cover part 37*b*. The cover part 37*a* and the cover part 37*b* are formed in a substantially cylindrical tube shape. The cover part 37*a* and the cover part 37*b* formed in a substantially cylindrical tube shape are disposed with the right and left direction as an axial direction. Further, the cover part 37*a* and the cover part 37*b* are disposed in a separated state with a predetermined distance therebetween in the front and rear direction. The connecting part 37*c* connects a right rear end of the cover part 37*a* with a right front end of the cover part 37*b*. The ink ribbon 3 is exposed to an outer side of the case body 36 on a left side with respect to the connecting part 37*c* between the cover part 37*a* and the cover part 37*b*.

The cover part 37*b* is, as shown in FIG. 10, provided with a bottom part 37*d* which is formed in a circular ring shape and structures a left end of the cover part 37*b*, a tube part 37*e* which is formed in a substantially cylindrical shape so as to rise up from an outer peripheral end of the bottom part 37*d* to a right side, and an inner side tube part 37*f* which is formed in a cylindrical tube shape so as to rise up from an inner peripheral end of the bottom part 37*d* to the right side. A length of the inner side tube part 37*f* in the right and left direction (in other words, a length in an axial direction of the inner side tube part 37*f*) is shorter than a length of the tube part 37*e* in the right and left direction (in other words, a length in an axial direction of the tube part 37*e*). An outer peripheral side of the ink ribbon 3 which is wound around the winding roll 5 is covered by the tube part 37*e*. The tube part 37*e* is formed with a slit for drawing out the ink ribbon 3 which is wound around the winding roll 5.

A right end of the inner side tube part 37*f* is formed with a circular ring-shaped part 37*g* in a circular ring shape which slightly protrudes to an inner peripheral side relative to the inner side tube part 37*f*. A tooth stopper 37*h* which structures a rotation prevention mechanism 46 described below is formed on a right side face of the circular ring-shaped part 37*g*. The tooth stopper 37*h* is formed so as to protrude from the right side face of the circular ring-shaped part 37*g* to the right side. Further, the tooth stopper 37*h* is, for example, formed at two positions on the right side face of the circular ring-shaped part 37*g* at a pitch of 180°.

The cover part 37*a* is formed in the same shape as the cover part 37*b*. In other words, the cover part 37*a* is provided with a bottom part 37*j* corresponding to the bottom part 37*d*, a tube part 37*k* corresponding to the tube part 37*e*, and an inner side tube part 37*m* corresponding to the inner side tube part 37*f*. A right end of the inner side tube part 37*m* is formed with a circular ring-shaped part corresponding to the circular ring-shaped part 37*g* and a right side face of the circular ring-shaped part is formed with a tooth stopper corresponding to the tooth stopper 37*h*. Two prisms 45 (see FIG. 7) are fixed to a lower end side of the tube part 37*k*. The two prisms 45 are disposed in a displaced state from each other in the front and rear direction and the right and left direction.

The cover member 38 is provided with a fixed part 38*a* which is disposed and fixed to an inner peripheral side of the right end of the tube part 37*e* and a fixed part 38*b* which is disposed and fixed to an inner peripheral side of the right end of the tube part 37*k*. The fixed part 38*a* is concentrically formed with a cylindrical shaped tube part 38*c* which rises up toward the left side and a cylindrical shaped sleeve holding part 38*d* which rises up toward the right side. An inner diameter of the tube part 38*c* is set to be larger than an inner diameter of the sleeve holding part 38*d*. A left end of the tube part 38*c* is formed with a tooth stopper 38*e* structuring the rotation prevention mechanism 47 described below. The tooth stopper 38*e* is formed so as to protrude from a left end of the tube part 38*c* to the left side. Further, the tooth stopper 38*e* is, for example, formed at two positions on the left end of the tube part 38*c* at a pitch of 180°. The fixed part 38*a* is fixed to an inner peripheral side of the right end of the tube part 37*e* so that the tube part 37*e* of the cover part 37*b* and the tube part 38*c* are concentrically disposed with each other.

The fixed part 38*b* is formed in the same shape as the fixed part 38*a*. In other words, the fixed part 38*b* is formed with a tube part 38*f* corresponding to the tube part 38*c* and a sleeve holding part corresponding to the sleeve holding part 38*d*. Further, a left end of the tube part 38*f* is formed with a tooth stopper corresponding to the tooth stopper 38*e*. The fixed part 38*b* is fixed to an inner peripheral side of the right end of the tube part 37*k* so that the tube part 37*k* of the cover part 37*a* and the tube part 38*f* are concentrically disposed with each other.

The sleeve 42 is formed in a substantially bottomed cylindrical tube shape with a flange which is provided with a bottom part 42*a* formed in a substantially circular plate shape and a tube part 42*b* formed in a cylindrical tube shape. The bottom part 42*a* is connected with a right side end of the tube part 42*b*. Further, the sleeve 42 is provided with a cylindrical shaped tube part 42*c* which rises up from the bottom part 42*a* to the right side. The tube part 42*c* is concentrically formed with the tube part 42*b*.

An outer peripheral side portion of the bottom part 42*a* is enlarged to an outer peripheral side relative to the tube part 42*b*. The bottom part 42*a* is formed with a cylindrical shaped spring holding part 42*d* which slightly rises up toward a left side. The spring holding part 42*d* is concentrically formed with the tube part 42*b*. An inner diameter of the spring holding part 42*d* is set to be larger than an outer diameter of the tube part 42*b*. The bottom part 42*a* and the tube part 42*b* are disposed on an inner peripheral side relative to the tube part 38*c* of the cover member 38. An outer peripheral face of the tube part 42*b* is, as shown in FIG. 8, formed with a protruded part 42*e* which is protruded to an outer peripheral side relative to the tube part 42*b*. The protruded part 42*e* is formed in a rectangular solid shape which is long and thin in the right and left direction. Further, the protruded part 42*e* is, for example, formed at two positions at a pitch of 180°. The tube part 42*c* is rotatably held on an inner peripheral side of the sleeve holding part 38*d* of the cover member 38. A knob 43 is fixed to a right end of the tube part 42*c*. The knob 43 is fixed to the tube part 42*c* so as to protrude to the right side relative to a right side face of the cover member 38.

A sleeve 39 is formed in the same shape as the sleeve 42. In other words, the sleeve 39 is provided with a bottom part 39*a* corresponding to the bottom part 42*a*, a tube part 39*b* corresponding to the tube part 42*b*, and a tube part 39*c* corresponding to the tube part 42*c*. The bottom part 39*a* is formed with a spring holding part corresponding to the spring holding part 42*d*, and an outer peripheral face of the tube part 39*b* is formed with a protruded part corresponding to the protruded part 42*e*. The bottom part 39*a* and the tube part 39*b* are disposed on an inner peripheral side relative to the tube part 38*f* of the cover member 38. The tube part 39*c* is rotatably held on an inner peripheral side of the sleeve holding part of the fixed part 38*b*. A knob 40 is fixed to a right end of the tube part 39*c*. The knob 40 is fixed to the tube part 39*c* so as to protrude to the right side relative to a right side face of the cover member 38.

The winding roll 5 is, as shown in FIG. 10, formed in a substantially bottomed cylindrical tube shape which is provided with a bottom part 5*a* formed in a substantially circular plate shape and a tube part 5*b* formed in a cylindrical tube shape. The bottom part 5*a* is connected with a right side end of the tube part 5*b*. Further, the winding roll 5 is provided with a first inner side tube part 5*c* in a cylindrical tube shape which is disposed on an inner peripheral side relative to the tube part 5*b*, a second inner side tube part 5*d* in a bottomed cylindrical tube shape which is disposed on an inner peripheral side relative to the first inner side tube part 5*c*, and a spring holding tube part 5*e* in a cylindrical tube shape which rises up from the bottom part 5*a* to the right side. The first inner side tube part 5*c*, the second inner side tube part 5*d* and the spring holding tube part 5*e* are concentrically formed with the tube part 5*b*.

The first inner side tube part 5*c* and the second inner side tube part 5*d* are formed so as to rise up from the bottom part 5*a* toward a left side. A length of the first inner side tube part 5*c* in the right and left direction (in other words, a length in an axial direction of the first inner side tube part 5*c*) is set to be shorter than a length of the tube part 5*b* in the right and left direction (in other words, a length in the axial direction of the tube part 5*b*). A length of the second inner side tube part 5*d* in the right and left direction (in other words, a length in the axial direction of the second inner side tube part 5*d*) is set to be shorter than a length of the first inner side tube part 5*c* in the right and left direction. As described above, the second inner side tube part 5*d* is formed in a substantially bottomed cylindrical tube shape and a bottom part 5*f* of the second inner side tube part 5*d* is disposed on a left side end of the second inner side tube part 5*d*. An outer diameter of the spring holding tube part 5*e* is set to be smaller than an outer diameter of the tube part 5*b*. Further, the outer diameter of the spring holding tube part 5*e* is set to be smaller than an inner diameter of the compression coil spring 44.

An inner diameter of the spring holding tube part 5*e* is set to be slightly larger than an outer diameter of the tube part 42*b* of the sleeve 42 and the tube part 42*b* is disposed on an inner peripheral side of the spring holding tube part 5*e*. An inner peripheral face of the spring holding tube part 5*e* is formed with an engaging recessed part, which is engaged with the protruded part 42*e* formed on the tube part 42*b*, so as to be recessed to an outer side in the radial direction. Therefore, when the knob 43 is turned, the winding roll 5 is turned together with the sleeve 42. Further, the protruded part 42*e* is formed in a rectangular solid shape which is long and thin in the right and left direction and thus the winding roll 5 is relatively movable in the right and left direction with respect to the sleeve 42.

As shown in FIG. 10, an outer diameter of the tube part 5*b* is set to be smaller than an inner diameter of the tube part 37*e* of the cover part 37*b*. An inner diameter of the tube part 5*b* is set to be larger than an outer diameter of the inner side tube part 37*f* of the cover part 37*b*. The tube part 5*b* is disposed between the tube part 37*e* and the inner side tube part 37*f* in the radial direction of the tube part 5*b*. The ink ribbon 3 is wound around an outer peripheral face of the tube part 5*b*. Further, a distance in the right and left direction between a right side face of the bottom part 5*a* and a left side end face of the first inner side tube part 5*c* is set to be shorter than a distance in the right and left direction between a right end face of the inner side tube part 37*f* and a left side end of the tube part 38*c* of the fixed part 38*a*.

A left side end face of the first inner side tube part 5*c* is formed with a gear 5*h* which is capable of engaging with the tooth stopper 37*h* formed on the right end of the inner side tube part 37*f*. The gear 5*h* is formed so as to protrude to a left side of the first inner side tube part 5*c*. A plurality of teeth structuring the gear 5*h* and the tooth stopper 37*h* are formed so that, when the gear 5*h* and the tooth stopper 37*h* are engaged with each other, rotation of the winding roll 5 in the ribbon rewinding direction is prevented (in other words, so that rotation of the winding roll 5 in a clockwise direction is prevented).

In this embodiment, a rotation prevention mechanism 46 as a first rotation prevention mechanism for preventing rotation of the winding roll 5 in the ribbon rewinding direction is structured by the gear 5*h* and the tooth stopper 37*h*. The rotation prevention mechanism 46 is disposed on a left end side of the winding roll 5 which is one end side in an axial direction of the winding roll 5. Further, the rotation prevention mechanism 46 in this embodiment is a ratchet mechanism which prevents only rotation of the winding roll 5 in the ribbon rewinding direction and, even when the gear 5*h* and the tooth stopper 37*h* are engaged with each other, the winding roll 5 can be rotated in the ribbon winding direction. In this embodiment, the gear 5*h* is a first roll side engaging part which is provided in the winding roll 5 and the tooth stopper 37*h* is a first case side engaging part which is provided in the case body 36.

In other words, when a state that a gear of the first inner side tube part of the supply roll 4 and a tooth stopper of the inner side tube part 37*m* are engaged with each other is referred to as a third engaging state, a state that engagement of the gear of the first inner side tube part of the supply roll 4 with the tooth stopper of the inner side tube part 37*m* is released is referred to as a third engagement released state, a state that a gear of the bottom part of the supply roll 4 and a tooth stopper of the tube part 38*f* are engaged with each other is referred to as a fourth engaging state, and a state that engagement of the gear of the bottom part of the supply roll 4 with the tooth stopper of the tube part 38*f* is released is referred to as a fourth engagement released state, in this embodiment, the third engaging state and the fourth engagement released state are maintained by an urging force of the compression coil spring 41 and thereby rotation of the supply roll 4 in the ribbon winding direction is prevented. In this case, the supply roll 4 can be rotated in the ribbon rewinding direction. Further, when the supply roll 4 is moved to the right side against the urging force of the compression coil spring 41, the supply roll 4 is set in the third engagement released state and the fourth engagement released state and thus, the supply roll 4 is set in a third state in which the supply roll 4 is capable of rotating in the ribbon winding direction and the ribbon rewinding direction, or the supply roll 4 is set in the third engagement released state and the fourth engaging state and thus, the supply roll 4 is set in a fourth state in which rotation of the supply roll 4 in the ribbon winding direction and the ribbon rewinding direction is prevented.

An outer peripheral end side of the right side face of the bottom part 5*a* is formed with a gear 5*g* which is capable of engaging with a tooth stopper 38*e* formed on a left side end of the tube part 38*c* of the fixed part 38*a*. The gear 5*g* is formed so as to protrude to the right side of the bottom part 5*a*. A plurality of teeth structuring the gear 5*g* and the tooth stopper 38*e* are formed so as to prevent rotation of the winding roll 5 in the ribbon rewinding direction when the gear 5*g* and the tooth stopper 38*e* are engaged with each other.

In this embodiment, a rotation prevention mechanism 47 as a second rotation prevention mechanism for preventing rotation of the winding roll 5 in the ribbon rewinding direction is structured by the gear 5*g* and the tooth stopper 38*e*. The rotation prevention mechanism 47 is disposed on the right end side of the winding roll 5 which is the other end side in the axial direction of the winding roll 5. Further, in this embodiment, a plurality of teeth structuring the gear 5*g* and the tooth stopper 38*e* are formed so as to prevent rotation of the winding roll 5 in the ribbon winding direction when the gear 5*g* and the tooth stopper 38*e* are engaged with each other. In this embodiment, the gear 5*g* is a second roll side engaging part which is provided in the winding roll 5 and the tooth stopper 38*e* is a second case side engaging part which is provided in the case body 36.

The spring holding tube part 5*e* is inserted into an inner peripheral side of the left end side of the compression coil spring 44 and the spring holding part 42*d* of the sleeve 42 is inserted into an inner peripheral side of the right end side of the compression coil spring 44. The winding roll 5 is urged to a left side by an urging force of the compression coil spring 44. When the winding roll 5 is urged to a left side by the urging force of the compression coil spring 44, as shown in FIG. 10, a left side end of the tube part 5*b* is abutted with a right side face of the bottom part 37*d* of the cover part 37*b*. Further, in this case, the gear 5*h* and the tooth stopper 37*h* are engaged with each other. Therefore, in this case, the winding roll 5 can be rotated in the ribbon winding direction but the winding roll 5 is unable to be rotated in the ribbon rewinding direction by the operation of the rotation prevention mechanism 46.

When the winding roll 5 is moved to the right side against the urging force of the compression coil spring 44, an engaging state of the gear 5*h* with the tooth stopper 37*h* is released. In this state, the winding roll 5 can be rotated in both directions, i.e., the ribbon winding direction and the ribbon rewinding direction. On the other hand, when the winding roll 5 is further moved to the right side against the urging force of the compression coil spring 44, as shown in FIG. 11, the gear 5*g* and the tooth stopper 38*e* are engaged with each other. Therefore, in this state, the winding roll 5 is unable to be rotated in the ribbon rewinding direction and the ribbon winding direction by the operation of the rotation prevention mechanism 47.

In other words, when a state that the gear 5*h* and the tooth stopper 37*h* are engaged with each other is referred to as a first engaging state, a state that engagement of the gear 5*h* with the tooth stopper 37*h* is released is referred to as a first engagement released state, a state that the gear 5*g* and the tooth stopper 38*e* are engaged with each other is referred to as a second engaging state, and a state that engagement of the gear 5*g* with the tooth stopper 38*e* is released is referred to as a second engagement released state, in this embodiment, the first engaging state and the second engagement released state are maintained by the urging force of the compression coil spring 44 and thereby rotation of the winding roll 5 in the ribbon rewinding direction is prevented. In this case, the winding roll 5 is capable of rotating in the ribbon winding direction. Further, when the winding roll 5 is moved to the right side against the urging force of the compression coil spring 44, the winding roll 5 is set in the first engagement released state and the second engagement released state and thus, the winding roll 5 is set in a first state in which the winding roll 5 is capable of rotating in the ribbon winding direction and the ribbon rewinding direction, or the winding roll 5 is set in the first engagement released state and the second engaging state and thus, the winding roll 5 is set in a second state in which rotation of the winding roll 5 in the ribbon winding direction and the ribbon rewinding direction is prevented.

The supply roll 4 is formed in the same shape as the winding roll 5. In other words, the supply roll 4 is provided with a bottom part corresponding to the bottom part 5*a*, a tube part 4*b* corresponding to the tube part 5*b*, a first inner side tube part corresponding to the first inner side tube part 5*c*, a second inner side tube part corresponding to the second inner side tube part 5*d*, and a spring holding tube part 4*e* corresponding to the spring holding tube part 5*e*.

An inner diameter of the spring holding tube part 4*e* is set to be slightly larger than an outer diameter of the tube part 39*b* of the sleeve 39 and the tube part 39*b* is disposed on an inner peripheral side relative to the spring holding tube part 4*e*. An inner peripheral face of the spring holding tube part 4*e* is formed with an engaging recessed part engaged with a protruded part formed on the tube part 39*b* so as to be recessed to an outer side in the radial direction. Therefore, the supply roll 4 is capable of being turned together with the sleeve 39 by turning the knob 40. Further, the protruded part of the tube part 39*b* is formed in a rectangular solid shape which is long and thin in the right and left direction and thus, the supply roll 4 is relatively movable in the right and left direction with respect to the sleeve 39.

An outer diameter of the tube part 4*b* is set to be smaller than an inner diameter of the tube part 37*k* of the cover part 37*a*. An inner diameter of the tube part 4*b* is set to be larger than an outer diameter of the inner side tube part 37*m* of the cover part 37*a*. The tube part 4*b* is disposed between the tube part 37*k* and the inner side tube part 37*m* in the radial direction of the tube part 4*b*. The ink ribbon 3 is wound around the outer peripheral face of the tube part 4*b*. Further, a distance in the right and left direction between a right side face of the bottom part of the supply roll 4 and a left side end face of the first inner side tube part is set to be shorter than a distance in the right and left direction between a right end face of the inner side tube part 37*m* and a left side end of the tube part 38*f* of the fixed part 38*b*.

A left side end face of the first inner side tube part of the supply roll 4 is, similarly to the first inner side tube part 5*c*, formed with a gear which is capable of engaging with a tooth stopper formed on a left side end of the inner side tube part 37*m*. The gear is formed so as to protrude to a left side of the first inner side tube part of the supply roll 4. A plurality of teeth which structure the gear and the tooth stopper of the inner side tube part 37*m* are formed so as to prevent rotation of the supply roll 4 in the ribbon winding direction (in other words, so as to prevent rotation of the supply roll 4 in a counterclockwise direction) when the gear and the tooth stopper of the inner side tube part 37*m* are engaged with each other.

In this embodiment, a third rotation prevention mechanism for preventing rotation of the supply roll 4 in the ribbon winding direction is structured by the gear of the first inner side tube part of the supply roll 4 and the tooth stopper of the inner side tube part 37*m*. The third rotation prevention mechanism is disposed on a left end side of the supply roll 4 which is one end side in the axial direction of the supply roll 4. Further, the third rotation prevention mechanism is a ratchet mechanism which prevents only rotation of the supply roll 4 in the ribbon winding direction and thus, even when the gear of the first inner side tube part of the supply roll 4 and the tooth stopper of the inner side tube part 37*m* are engaged with each other, the supply roll 4 is capable of rotating in the ribbon rewinding direction. In this embodiment, the gear of the first inner side tube part of the supply roll 4 is a third roll side engaging part which is provided in the supply roll 4 and the tooth stopper of the inner side tube part 37*m* is a third case side engaging part which is provided in the case body 36.

An outer peripheral end side of a right side face of the bottom part of the supply roll 4 is formed with a gear which is capable of engaging with a tooth stopper formed on a left side end of the tube part 38*f* of the fixed part 38*b*. The gear is formed so as to protrude to the right side of the bottom part of the supply roll 4. A plurality of teeth structuring the gear and the tooth stopper of the tube part 38*f* are formed so as to prevent rotation of the supply roll 4 in the ribbon winding direction when the gear and the tooth stopper of the tube part 38*f* are engaged with each other.

In this embodiment, a fourth rotation prevention mechanism which prevents rotation of the supply roll 4 in the ribbon winding direction is structured by the gear of the bottom part of the supply roll 4 and the tooth stopper of the tube part 38*f*. The fourth rotation prevention mechanism is disposed on the right end side of the supply roll 4 which is the other end side in the axial direction of the supply roll 4. Further, in this embodiment, a plurality of teeth structuring the gear of the bottom part of the supply roll 4 and the tooth stopper of the tube part 38*f* are formed so as to also prevent rotation of the supply roll 4 in the ribbon rewinding direction when the gear of the bottom part of the supply roll 4 and the tooth stopper of the tube part 38*f* are engaged with each other. In this embodiment, the gear of the bottom part of the supply roll 4 is a fourth roll side engaging part which is provided in the supply roll 4 and the tooth stopper of the tube part 38*f* is a fourth case side engaging part which is provided in the case body 36.

A spring holding tube part 4*e* is inserted into an inner peripheral side of the left end side of the compression coil spring 41 and a spring holding part of the sleeve 39 is inserted into an inner peripheral side of the right end side of the compression coil spring 41. The supply roll 4 is urged to the left side by an urging force of the compression coil spring 41. When the supply roll 4 is urged to the left side by the urging force of the compression coil spring 41, a left side end of the tube part 4*b* is abutted with a right side face of the bottom part 37*j* of the cover part 37*a*. Further, in this case, the gear of the first inner side tube part of the supply roll 4 and the tooth stopper of the inner side tube part 37*m* are engaged with each other and thus, the supply roll 4 can be rotated in the ribbon rewinding direction but the supply roll 4 is unable to be rotated in the ribbon winding direction.

When the supply roll 4 is moved to the right side against the urging force of the compression coil spring 41, engagement of the gear of the first inner side tube part of the supply roll 4 with the tooth stopper of the inner side tube part 37*m* is released. In this state, the supply roll 4 can be rotated in both directions, i.e., the ribbon winding direction and the ribbon rewinding direction. On the other hand, when the supply roll 4 is further moved to the right side against the urging force of the compression coil spring 41, the gear of the bottom part of the supply roll 4 and the tooth stopper of the tube part 38*f* are engaged with each other and thus, in this state, the supply roll 4 is unable to be rotated in the ribbon winding direction and the ribbon rewinding direction.

In other words, when a state that the gear of the first inner side tube part of the supply roll 4 and the tooth stopper of the inner side tube part 37*m* are engaged with each other is referred to as a third engaging state, a state that engagement of the gear of the first inner side tube part of the supply roll 4 with the tooth stopper of the inner side tube part 37*m* is released is referred to as a third engagement released state, a state that the gear of the bottom part of the supply roll 4 and the tooth stopper of the tube part 38*f* are engaged with each other is referred to as a fourth engaging state, and a state that engagement of the gear of the bottom part of the supply roll 4 with the tooth stopper of the tube part 38*f* is released is referred to as a fourth engagement released state, in this embodiment, the third engaging state and the fourth engagement released state are maintained by the urging force of the compression coil spring 41 and thereby rotation of the supply roll 4 in the ribbon winding direction is prevented. In this case, the supply roll 4 can be rotated in the ribbon rewinding direction. Further, when the supply roll 4 is moved to the right side against the urging force of the compression coil spring 41, the supply roll 4 is set in the third engagement released state and the fourth engagement released state and thus, the supply roll 4 is set in a third state in which the supply roll 4 is capable of rotating in the ribbon winding direction and the ribbon rewinding direction, or the supply roll 4 is set in the third engagement released state and the fourth engaging state and thus, the supply roll 4 is set in a fourth state in which rotation of the supply roll 4 in the ribbon winding direction and the ribbon rewinding direction is prevented.

In this embodiment, all components structuring the ink ribbon cassette 26 are formed of resin.

(Structure of Cartridge Main Body Part)

Figure 12:
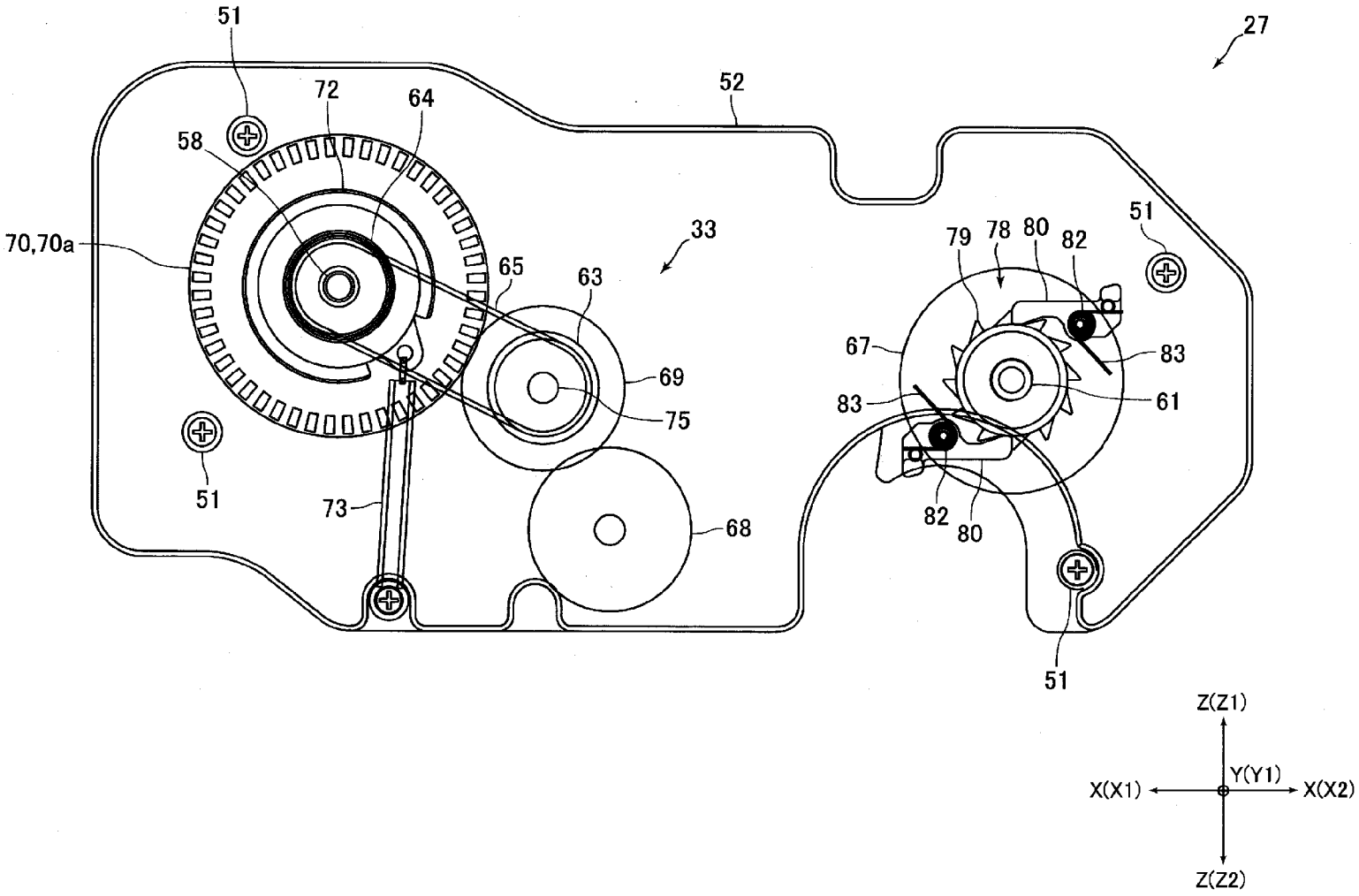
FIG. 12 is an explanatory side view showing a structure of a cartridge main body part shown in FIG. 3.
Figure 13:
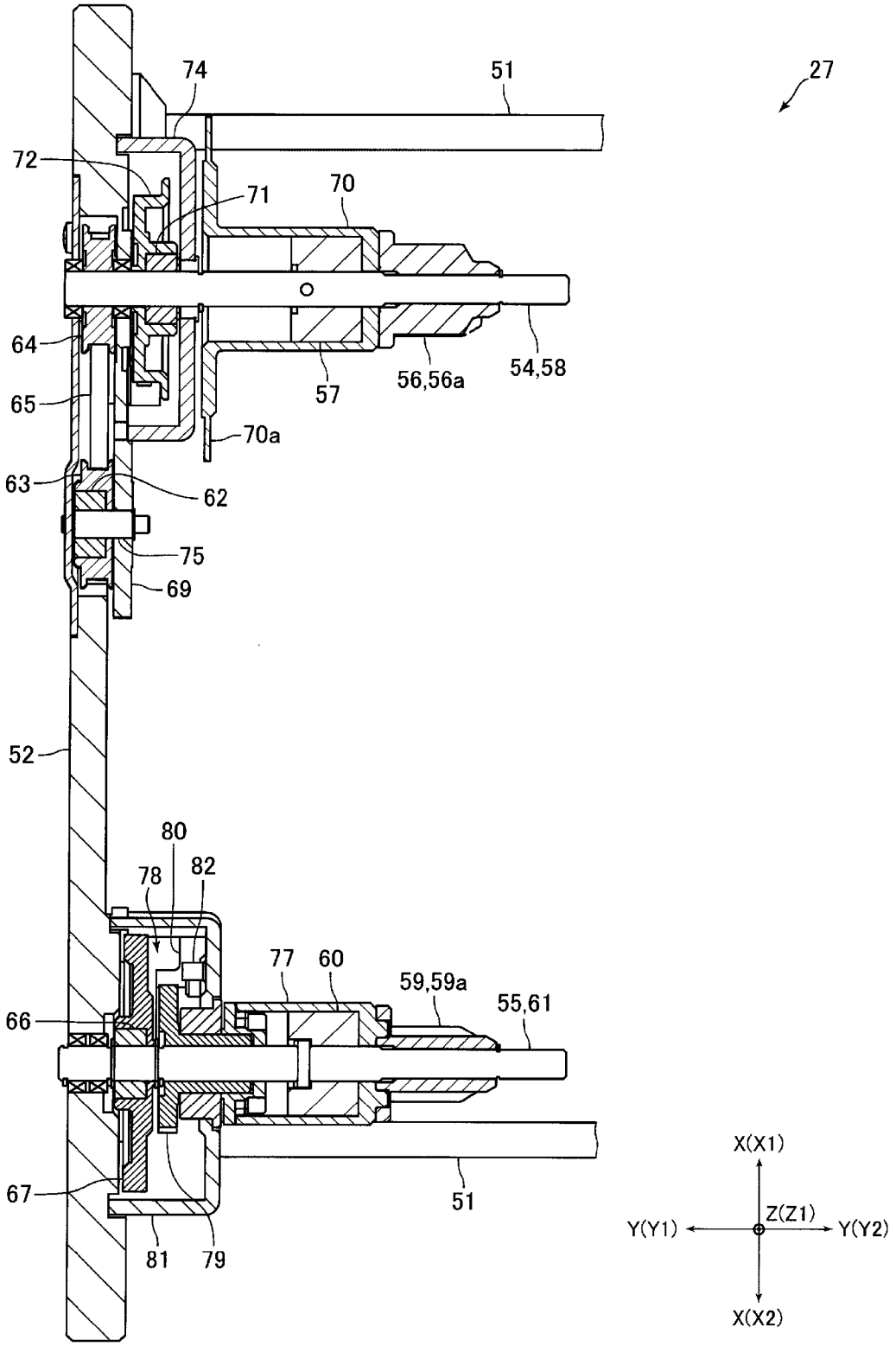
FIG. 13 is an explanatory cross-sectional view showing the structure of the cartridge main body part shown in FIG. 3.
Figure 14:
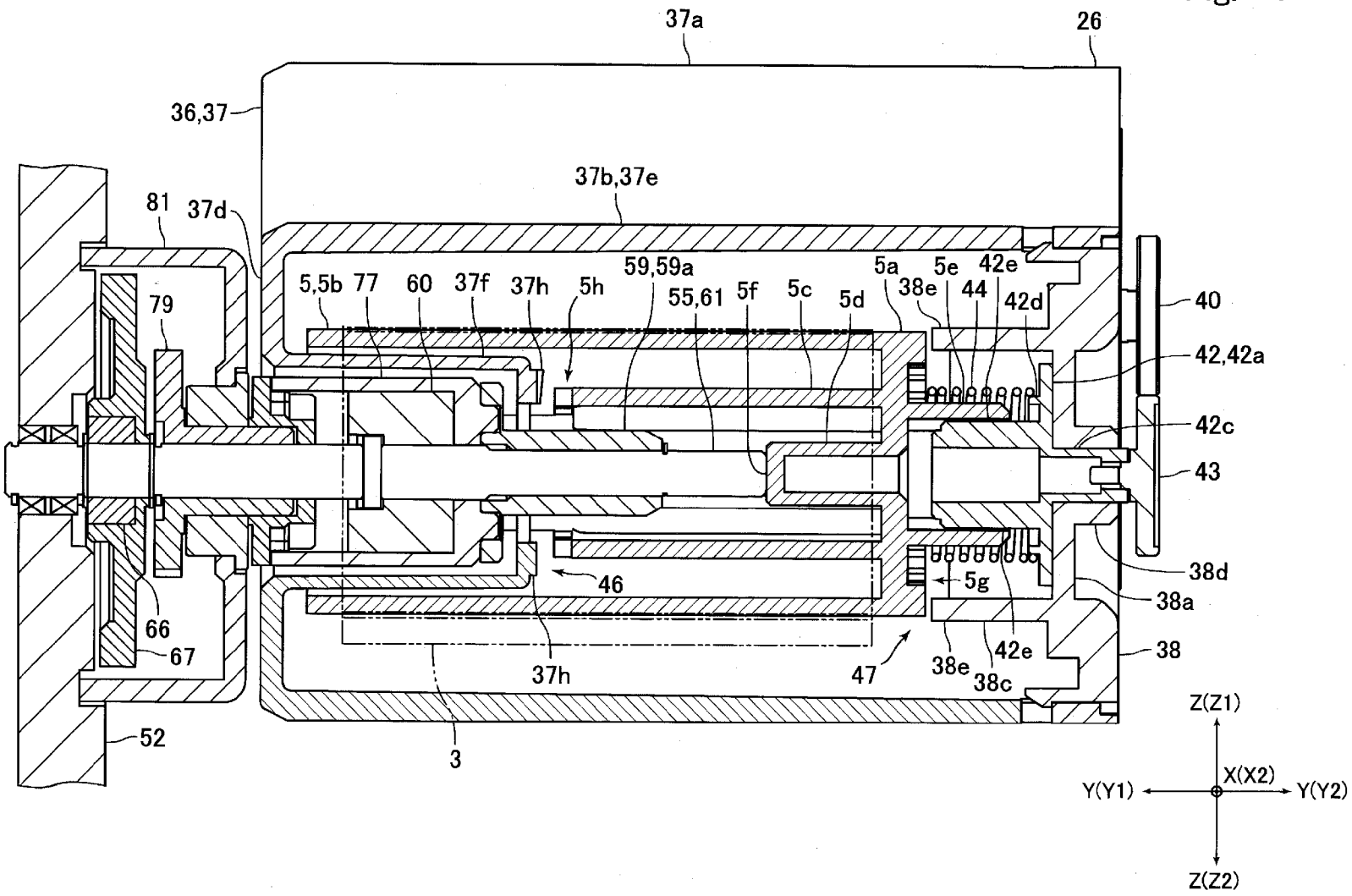
FIG. 14 is an explanatory cross-sectional view showing a winding roll and its surrounding portion when the ink ribbon cassette has been attached to the cartridge main body part shown in FIG. 3.

FIG. 12 is an explanatory side view showing a structure of the cartridge main body part 27 shown in FIG. 3. FIG. 13 is an explanatory cross-sectional view showing the structure of the cartridge main body part 27 shown in FIG. 3. FIG. 14 is an explanatory cross-sectional view showing the winding roll 5 and its surrounding portion when the ink ribbon cassette 26 is attached to the cartridge main body part 27 shown in FIG. 3.

The cartridge main body part 27 includes a plurality of shafts 51 which are disposed with the right and left direction as an axial direction and a pair of frames 52 and 53 which are connected with each other through a plurality of the shafts 51. Further, the cartridge main body part 27 includes the above-mentioned power transmission mechanism 33 which structures a part of the power transmission mechanism 31.

The frame 52 structures a left side face of the cartridge main body part 27. The frame 53 structures a right side face of the cartridge main body part 27. In this embodiment, the ink ribbon cassette 26 is attached to the cartridge main body part 27 from the right side and is detached from the cartridge main body part 27 to the right side.

The frame 53 is, as shown in FIG. 3, formed with a through-hole 53*a* for attaching and detaching the ink ribbon cassette 26 to and from the cartridge main body part 27. The through-hole 53*a* is formed in a shape corresponding to a shape of a right end side portion of the ink ribbon cassette 26 and, when the ink ribbon cassette 26 is attached to the cartridge main body part 27, the right end side portion of the ink ribbon cassette 26 is disposed within the through-hole 53*a*. Further, when the ink ribbon cassette 26 is attached to the cartridge main body part 27, the through-hole 53*a* is closed by the right end side portion of the ink ribbon cassette 26. Further, the frame 53 is attached with a lock mechanism 50 for locking the ink ribbon cassette 26 which has been attached to the cartridge main body part 27. The lock mechanism 50 is disposed on both sides with respect to the through-hole 53*a* in the front and rear direction.

The power transmission mechanism 33 is disposed on the right side relative to the frame 52. The power transmission mechanism 33 includes a supply side engaging part 54, which is engaged with the supply roll 4 from the left side for rotating the supply roll 4, and a winding side engaging part 55 which is engaged with the winding roll 5 from the left side for rotating the winding roll 5. The supply side engaging part 54 includes a connecting part 56, which is to be connected with the supply roll 4, and a rotation shaft 58 which is connected with the connecting part 56 through a torque limiter 57. The winding side engaging part 55 includes a connecting part 59 which is to be connected with the winding roll 5 and a rotation shaft 61 connected with the connecting part 59 through a torque limiter 60. In this embodiment, the connecting part 56 is a supply side connecting part, the torque limiter 57 is a supply side torque limiter, the rotation shaft 58 is a supply side rotation shaft, the connecting part 59 is a winding side connecting part, the torque limiter 60 is a winding side torque limiter, and the rotation shaft 61 is a winding side rotation shaft.

The power transmission mechanism 33 includes, as shown in FIGS. 12 and 13, a gear 68, a gear 69 engaged with the gear 68, a pulley 63 connected with the gear 69 through a one-way clutch 62, a pulley 64 fixed to the rotation shaft 58, a belt 65 which is stretched over the pulley 63 and the pulley 64, and a gear 67 connected with the rotation shaft 61 through a one-way clutch 66. In this embodiment, the pulley 64 is a first pulley, the one-way clutch 62 is a supply side one-way clutch, the pulley 63 is the second pulley, the gear 69 is a supply side gear, the one-way clutch 66 is a winding side one-way clutch, and the gear 67 is a winding side gear.

A left end side of the rotation shaft 58 is rotatably supported by the frame 52 and the rotation shaft 58 is protruded from the frame 52 to the right side. The torque limiter 57 is attached to a substantially center position of the rotation shaft 58 in the right and left direction. An outer peripheral face of the torque limiter 57 is fixed with a sleeve 70 which is formed in a substantially bottomed cylindrical tube shape with a flange. The connecting part 56 is formed in a substantially cylindrical tube shape with a flange. The connecting part 56 is attached to the torque limiter 57 through the sleeve 70. In other words, the connecting part 56 and the rotation shaft 58 are connected with each other through the torque limiter 57 and the sleeve 70. The connecting part 56 is disposed on the right end side of the rotation shaft 58. A right end side of the rotation shaft 58 is protruded to the right side relative to the right end of the connecting part 56.

An outer peripheral face of the connecting part 56 is formed with a plurality of protruded parts 56*a* which are protruded to an outer side in the radial direction. The protruded part 56*a* is formed in a rectangular solid shape which is long and thin in the right and left direction. Further, a plurality of the protruded parts 56*a* is formed at a predetermined pitch in a circumferential direction of the connecting part 56. The sleeve 70 is formed with a slit part 70*a* for detecting a rotation amount of the supply roll 4. The slit part 70*a* is formed on an outer peripheral end side of a circular ring-shaped flange part which structures a left end side portion of the sleeve 70.

A left end side of the rotation shaft 58 is attached with a rotational member 72 formed in a substantially cylindrical tube shape through a one-way clutch 71. In other words, the one-way clutch 71 is disposed between the rotation shaft 58 and the rotational member 72 and the rotational member 72 is relatively rotatably held on the left end side of the rotation shaft 58.

The one-way clutch 71 functions to transmit a rotating force of the rotation shaft 58 in the ribbon winding direction (in other words, a rotating force of the rotation shaft 58 in a counterclockwise direction) to the rotational member 72, and functions to cut off transmission of a rotating force of the rotation shaft 58 in the ribbon rewinding direction (in other words, a rotating force of the rotation shaft 58 in a clockwise direction) to the rotational member 72. The one-way clutch 71 in this embodiment is a second supply side one-way clutch.

An outer peripheral side of the rotational member 72 is attached with one end of a tension coil spring 73 as an urging member. The other end of the tension coil spring 73 is attached to the frame 52. The rotational member 72 is urged in the ribbon rewinding direction (in other words, a clockwise direction) around the rotation shaft 58 by an urging force of the tension coil spring 73. In this embodiment, a turnable range of the rotational member 72 is restricted by a turning restriction mechanism not shown. Further, the rotational member 72 is covered by a cover 74 which is fixed to a right side face of the frame 52.

A pulley 64 is fixed to a left end side of the rotation shaft 58. The gear 68 is rotatably supported by the frame 52. The gear 69 is fixed to a right end side of the rotation shaft 75 which is rotatably supported by the frame 52. A one-way clutch 62 is attached to the left end side of the rotation shaft 75. A pulley 63 is attached to the one-way clutch 62. The one-way clutch 62 functions to transmit a rotating force of the rotation shaft 75 in the ribbon rewinding direction (in other words, a rotating force of the rotation shaft 75 in a clockwise direction) to the pulley 63, and functions to cut off transmission of a rotating force of the rotation shaft 75 in the ribbon winding direction (in other words, a rotating force of the rotation shaft 75 in a counterclockwise direction) to the pulley 63.

A left end side of the rotation shaft 61 is rotatably supported by the frame 52 and the rotation shaft 61 is protruded from the frame 52 to the right side. A torque limiter 60 is attached to a substantially center position of the rotation shaft 61 in the right and left direction. An outer peripheral face of the torque limiter 60 is fixed with a sleeve 77 which is formed in a substantially bottomed cylindrical tube shape. A connecting part 59 is formed in a substantially cylindrical tube shape with a flange. The connecting part 59 is attached to the torque limiter 60 through the sleeve 77. In other words, the connecting part 59 and the rotation shaft 61 are connected with each other through the torque limiter 60 and the sleeve 77. The connecting part 59 is disposed on the right end side of the rotation shaft 61. A right end side of the rotation shaft 61 is protruded to the right side relative to the right side end of the connecting part 59. An outer peripheral face of the connecting part 59 is, similarly to the connecting part 56, formed with a plurality of protruded parts 59*a* which are protruded to an outer side in the radial direction. A plurality of the protruded parts 59*a* is formed similarly to a plurality of the protruded parts 56*a*.

A rotation prevention mechanism 78 as a fifth rotation prevention mechanism for preventing rotation of the winding roll 5 in the ribbon rewinding direction is provided on the left end side of the rotation shaft 61. The rotation prevention mechanism 78 includes a gear 79 which is fixed to a left end side of the rotation shaft 61 and two pawl members 80 which are engaged with the gear 79. A plurality of teeth structuring the gear 79 and the pawl member 80 are formed so as to prevent rotation of the winding roll 5 in the ribbon rewinding direction when the gear 79 and the pawl member 80 are engaged with each other. The rotation prevention mechanism 78 in this embodiment is a ratchet mechanism for preventing only rotation of the winding roll 5 in the ribbon rewinding direction and, even when the gear 79 and the pawl member 80 are engaged with each other, the winding roll 5 is capable of rotating in the ribbon winding direction.

The pawl member 80 is turnably held by a fixed shaft 82. The fixed shaft 82 is fixed to a cover 81 which covers the gear 67 and the gear 79. The two pawl members 80 are disposed so as to be capable of respectively engaging with an upper end side and a lower end side of the gear 79. Further, the pawl member 80 is urged in a direction for engaging with the gear 79 with the fixed shaft 82 as a turning center (specifically, a counterclockwise direction around the fixed shaft 82) by a torsion coil spring 83 as an urging member. In this embodiment, the cover 81 is fixed to a right side face of the frame 52.

The one-way clutch 66 is attached to a left end side of the rotation shaft 61. The gear 67 is attached to the one-way clutch 66. The one-way clutch 66 functions to transmit a rotating force of the gear 67 in the ribbon winding direction (in other words, a rotating force of the gear 67 in a counterclockwise direction) to the rotation shaft 61, and functions to cut off transmission of a rotating force of the gear 67 in the ribbon rewinding direction (in other words, a rotating force of the gear 67 in a clockwise direction) to the rotation shaft 61.

When the ink ribbon cassette 26 is attached to the cartridge main body part 27, as shown in FIG. 14, the connecting part 59 and the rotation shaft 61 are inserted into an inner peripheral side relative to the first inner side tube part 5*c* and a plurality of the protruded parts 59*a* formed on the outer peripheral face of the connecting part 59 is engaged with the engaging recessed parts formed on the inner peripheral face of the first inner side tube part 5*c*. Therefore, a rotating force can be transmitted between the connecting part 59 and the winding roll 5.

Further, when the rotation shaft 61 is inserted into the inner peripheral side relative to the first inner side tube part 5*c*, a right end of the rotation shaft 61 is abutted with the bottom part 5*f* of the second inner side tube part 5*d* to push the winding roll 5 to the right side. The winding roll 5 pushed by the rotation shaft 61 is moved to the right side against the urging force of the compression coil spring 44 until engagement of the gear 5*h* with the tooth stopper 37*h* is released and, in addition, to a position where the gear 5*g* and the tooth stopper 38*e* are not engaged with each other. In other words, when the ink ribbon cassette 26 is attached to the cartridge main body part 27 and the winding side engaging part 55 is engaged with the winding roll 5, engagement of the gear 5*h* with the tooth stopper 37*h* is released and a state that engagement of the gear 5*g* with the tooth stopper 38*e* is released is maintained and thereby the winding roll 5 is set in the above-mentioned first state. However, in the state that the ink ribbon cassette 26 is attached to the cartridge main body part 27, the two pawl members 80 are engaged with the gear 79 and thus, the winding roll 5 is capable of rotating in the ribbon winding direction but does not rotate in the ribbon rewinding direction.

Further, when the ink ribbon cassette 26 is attached to the cartridge main body part 27, the connecting part 56 and the rotation shaft 58 are inserted into an inner peripheral side relative to the first inner side tube part of the supply roll 4 and a plurality of the protruded parts 56*a* formed on the outer peripheral face of the connecting part 56 is engaged with the engaging recessed parts formed on the inner peripheral face of the first inner side tube part of the supply roll 4. Therefore, a rotating force can be transmitted between the connecting part 56 and the supply roll 4.

Further, when the rotation shaft 58 is inserted into the inner peripheral side relative to the first inner side tube part of the supply roll 4, a right side end of the rotation shaft 58 is abutted with the bottom part of the second inner side tube part of the supply roll 4 to push the supply roll 4 to the right side. The supply roll 4 pushed by the rotation shaft 58 is moved to the right side against the urging force of the compression coil spring 41 until engagement of the gear of the first inner side tube part of the supply roll 4 with the tooth stopper of the inner side tube part 37*m* is released and, in addition, to a position where the gear of the bottom part of the supply roll 4 and the tooth stopper of the tube part 38*f* are not engaged with each other. In other words, when the ink ribbon cassette 26 is attached to the cartridge main body part 27 and the supply side engaging part 54 is engaged with the supply roll 4, engagement of the gear of the first inner side tube part of the supply roll 4 with the tooth stopper of the inner side tube part 37*m* is released and a state that engagement of the gear of the bottom part of the supply roll 4 with the tooth stopper of the tube part 38*f* is released is maintained and thereby the supply roll 4 is set in the above-mentioned third state. Therefore, when the ink ribbon cassette 26 is attached to the cartridge main body part 27, the supply roll 4 is rotatable in both directions, i.e., the ribbon winding direction and the ribbon rewinding direction.

In this embodiment, the supply side engaging part 54 is a supply side rotating part for rotating the supply roll 4 and the winding side engaging part 55 is a winding side rotating part for rotating the winding roll 5. Further, the gear 79 in this embodiment is a first engaging part provided on the winding side engaging part 55 side which is a winding side rotating part, and the pawl member 80 is a second engaging part which is engaged with the gear 79 that is the first engaging part to prevent rotation of the winding roll 5 in the ribbon rewinding direction.

(Structure for Releasing Engaging State of Gear with Pawl Member)

Figure 15A:
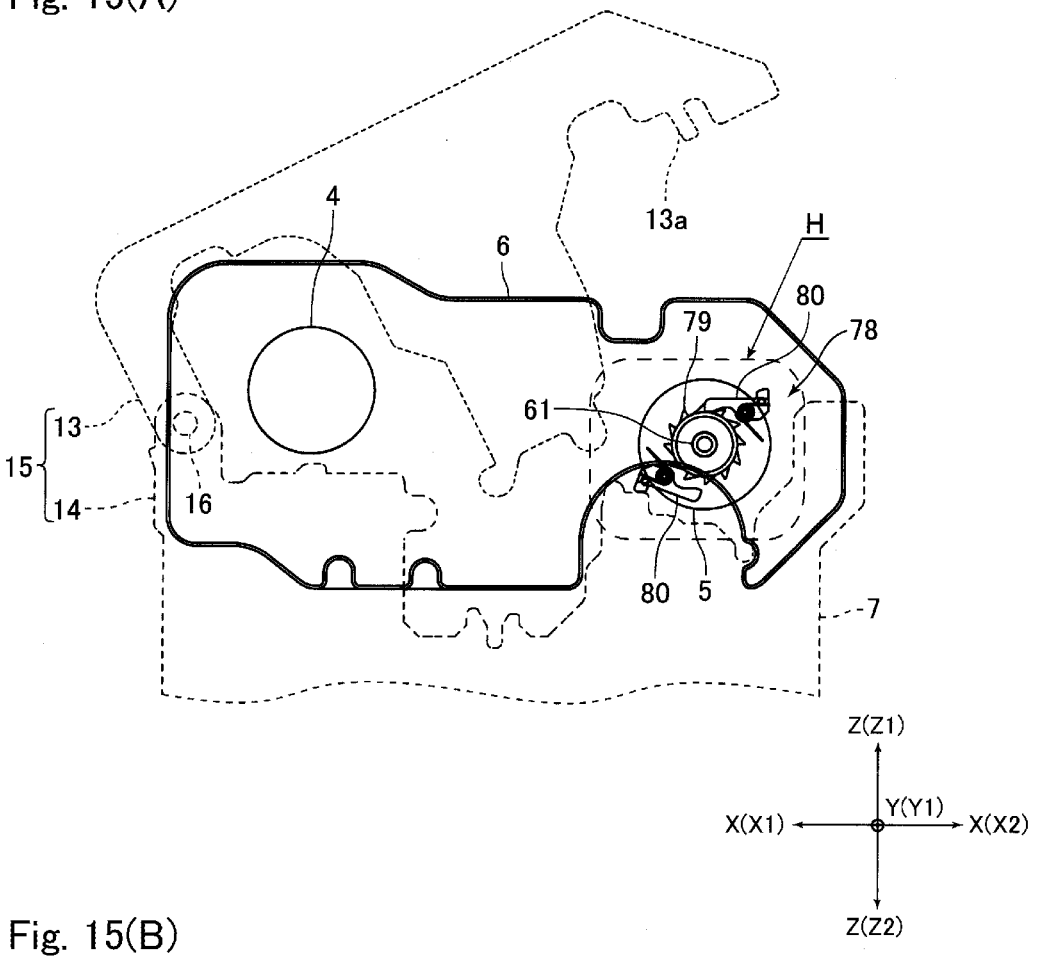
FIG. 15(A) is an explanatory view showing a state when a cartridge shown in FIG. 1 has been mounted on a second housing.
Figure 15B:
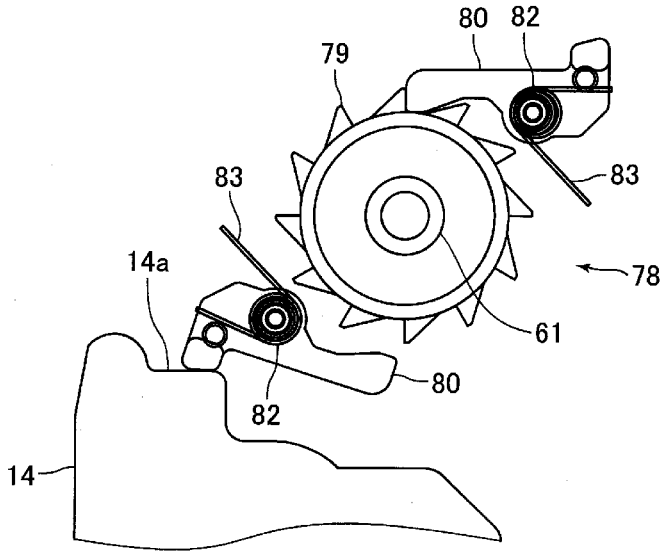
FIG. 15(B) is an enlarged view showing the "H" part in FIG. 15(A).
Figure 16A:
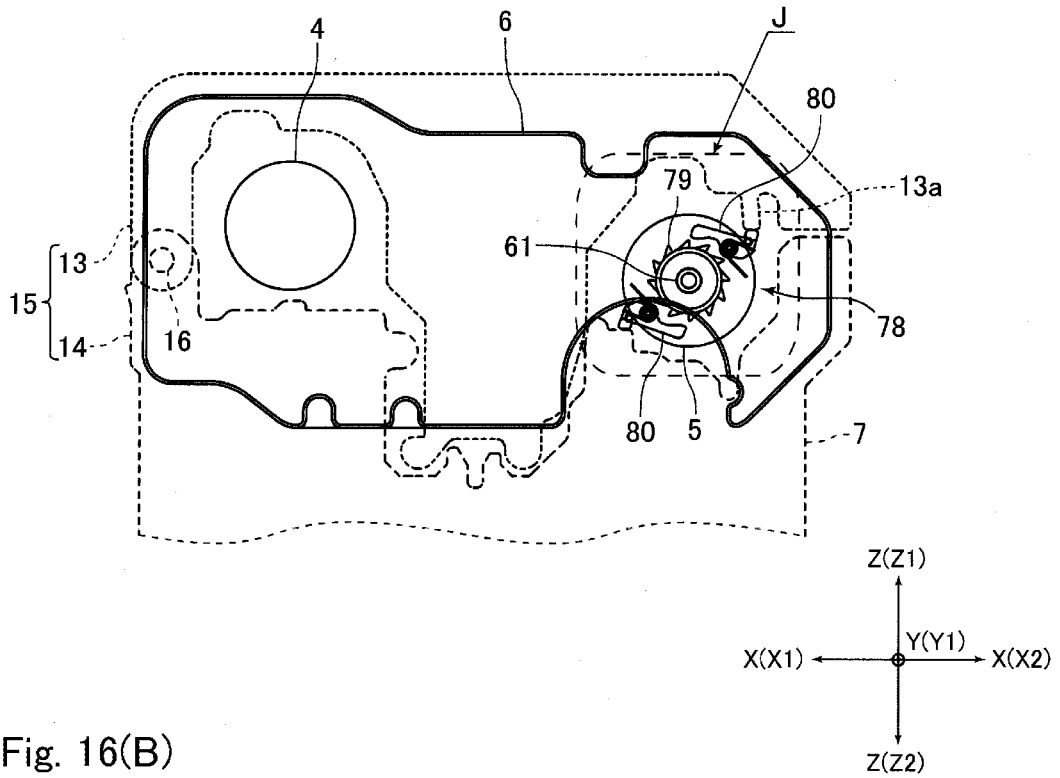
FIG. 16(A) is an explanatory view showing a state that a cartridge shown in FIG. 1 has been attached to a housing.
Figure 16B:
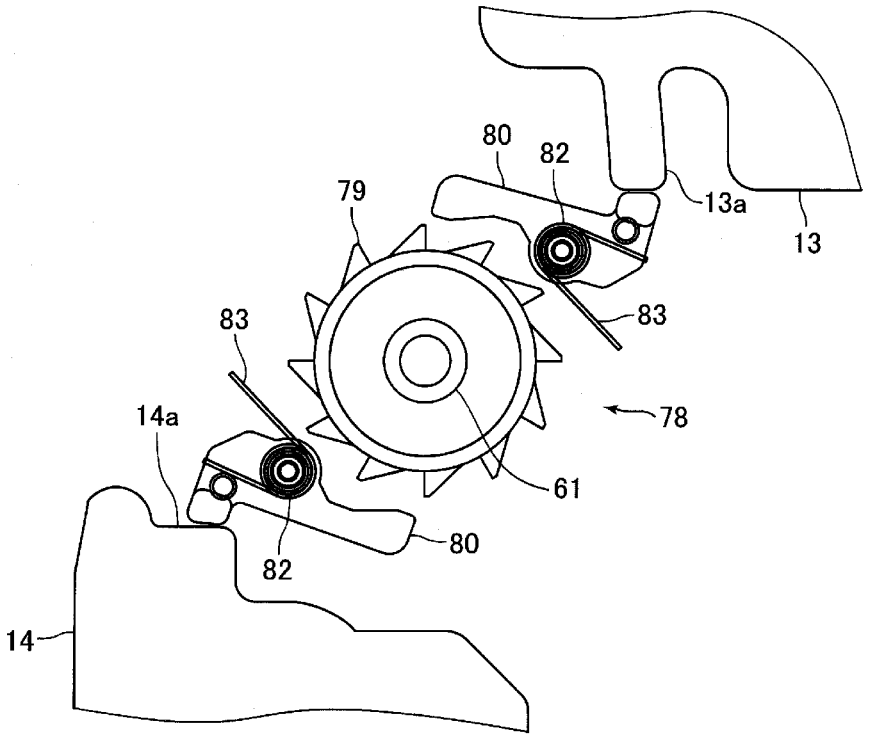
FIG. 16(B) is an enlarged view showing the "J" part in FIG. 16(A).

FIG. 15(A) is an explanatory view showing a state when the cartridge 6 shown in FIG. 1 is mounted on the second housing 14 and FIG. 15(B) is an enlarged view showing the "H" part in FIG. 15(A). FIG. 16(A) is an explanatory view showing a state that the cartridge 6 shown in FIG. 1 is attached to the housing 15 and FIG. 16(B) is an enlarged view showing the "J" part in FIG. 16(A).

The second housing 14 is formed with an engagement release part 14*a* for releasing an engaging state of the gear 79 with one of the two pawl members 80 which is engaged with a lower end side of the gear 79. As shown in FIGS. 15(A) and 15(B), when the cartridge 6 is mounted on the second housing 14, the engagement release part 14*a* is contacted with the pawl member 80 which is engaged with the lower end side of the gear 79 and the pawl member 80 is turned in a clockwise direction around the fixed shaft 82 against an urging force of the torsion coil spring 83. When the pawl member 80 is turned in the clockwise direction, the engaging state of the pawl member 80 with the gear 79 is released.

Further, the first housing 13 is formed with an engagement release part 13*a* for releasing an engaging state of the gear 79 with the other of the two pawl members 80 which is engaged with the upper end side of the gear 79. As shown in FIGS. 16(A) and 16(B), when the cartridge 6 mounted on the second housing 14 is covered by the first housing 13 from an upper side and is attached to the housing 15, the engagement release part 13*a* is contacted with the pawl member 80 engaged with the upper end side of the gear 79 and thus the pawl member 80 is turned in the clockwise direction around the fixed shaft 82 against an urging force of the torsion coil spring 83. When the pawl member 80 is turned in the clockwise direction, the engaging state of the pawl member 80 with the gear 79 is released.

As described above, when the cartridge 6 is mounted on the second housing 14 and is attached to the housing 15 in a state that the cartridge 6 is covered from an upper side by the first housing 13, the engaging states of the two pawl members 80 with the gear 79 are released. Therefore, when the cartridge 6 is attached to the housing 15 (in other words, when the cartridge 6 is attached to the main body part 7), the winding roll 5 is capable of rotating in both directions, i.e., the ribbon winding direction and the ribbon rewinding direction.

In a process that the cartridge 6 mounted on the second housing 14 is covered from an upper side by the first housing 13, the thermal head and the like are abutted with an upper face of an ink ribbon 3 which is exposed to an outer side of the case body 36 between the supply roll 4 and the winding roll 5. In this embodiment, as described above, when the ink ribbon cassette 26 is attached to the cartridge main body part 27, the supply roll 4 is capable of rotating in both directions, i.e., the ribbon winding direction and the ribbon rewinding direction and thus, in the process that the cartridge 6 mounted on the second housing 14 is covered from an upper side by the first housing 13, the ink ribbon 3 is drawn out from the supply roll 4.

As shown in FIGS. 15(A) and 15(B) and FIGS. 16(A) and 16(B), the second housing 14 is formed with the engagement release part 14*a* for releasing the engaging state of the gear 79 with one of the two pawl members 80 which is engaged with the lower end side of the gear 79. Further, the first housing 13 is formed with the engagement release part 13*a* for releasing the engaging state of the gear 79 with the other of the two pawl members 80 which is engaged with the upper end side of the gear 79. When the cartridge 6 is detached from the main body part 7, the two pawl members 80 and the gear 79 are engaged with each other by the urging forces of the torsion coil springs 83 as shown in FIG. 12.

When the cartridge 6 is mounted on the second housing 14, as shown in FIGS. 15(A) and 15(B), the engagement release part 14*a* is contacted with the pawl member 80 which is engaged with the lower end side of the gear 79. When the engagement release part 14*a* is contacted with the pawl member 80, the pawl member 80 is turned in a clockwise direction around the fixed shaft 82 against an urging force of the torsion coil spring 83 and thus the engaging state of the pawl member 80 with the gear 79 is released.

Further, as shown in FIGS. 16(A) and 16(B), when the cartridge 6 mounted on the second housing 14 is covered from an upper side by the first housing 13 and is attached to the housing 15, the engagement release part 13*a* is contacted with the pawl member 80 which is engaged with the upper end side of the gear 79. When the engagement release part 13*a* is contacted with the pawl member 80, the pawl member 80 is turned in a clockwise direction around the fixed shaft 82 against an urging force of the torsion coil spring 83 and thus, the engaging state of the pawl member 80 with the gear 79 is released.

(Structure of Power Transmission Mechanism and Operation of Ribbon Feed Mechanism)

Figure 17A:
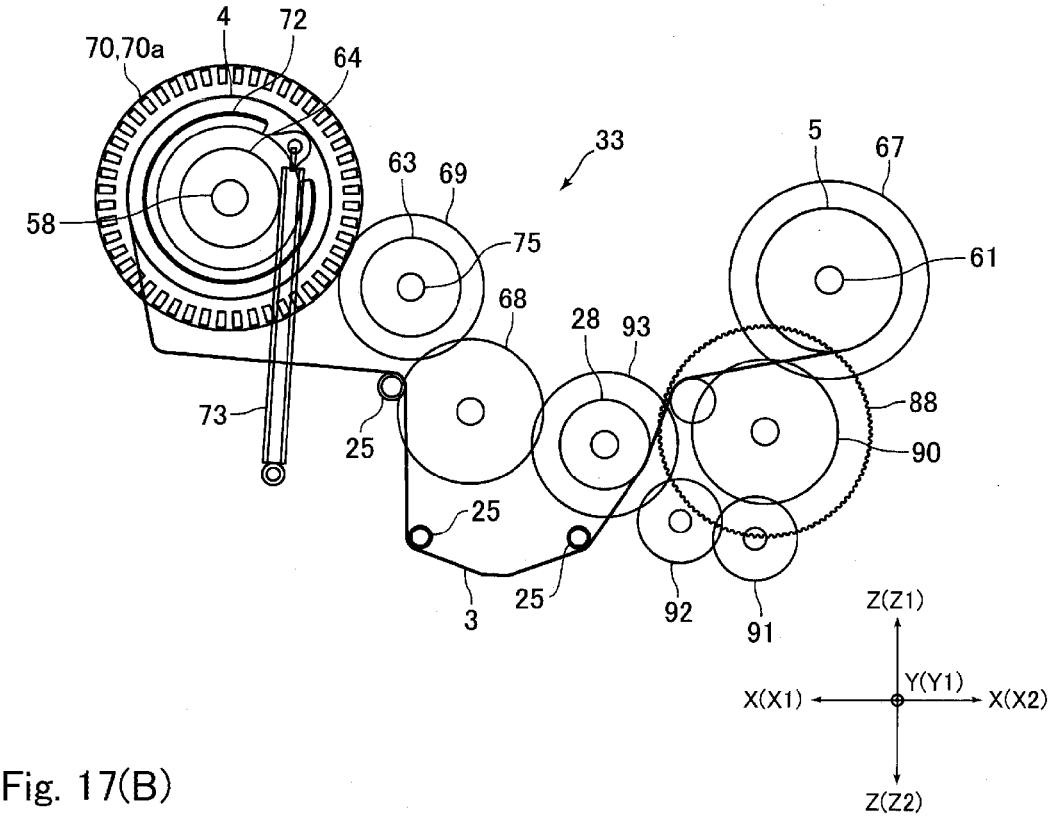
FIGS. 17(A) and 17(B) are views for explaining operation of a rotational member and a tension coil spring shown in FIG. 12.
Figure 17B:
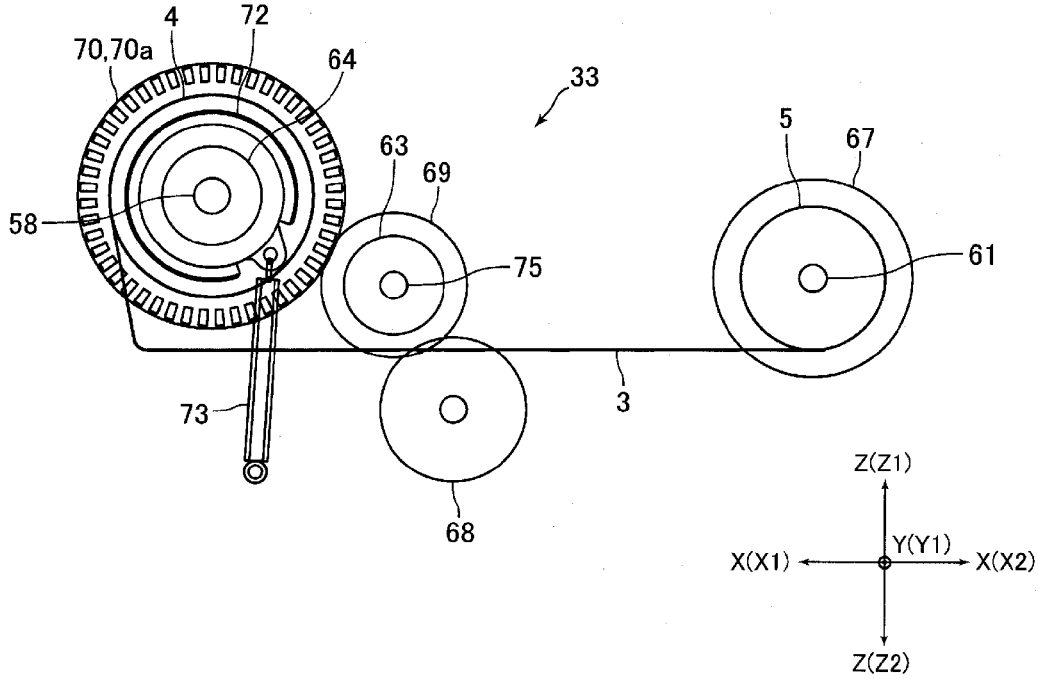

FIGS. 17(A) and 17(B) are views for explaining operations of the rotational member 72 and the tension coil spring 73 shown in FIG. 12.

The ribbon feed mechanism 10 includes the power transmission mechanism 32 which structures a part of the main body part 7 as described above. The power transmission mechanism 32 includes a pulley 87 fixed to an output shaft of a ribbon feed motor 30, a pulley 88 rotatably supported by the second housing 14, a belt 89 stretched over the pulley 87 and the pulley 88, a gear 90 which is coaxially disposed with the pulley 88 and is rotated together with the pulley 88, a gear 91 engaged with the gear 90, a gear 92 engaged with the gear 91, and a gear 93 engaged with the gear 92. The gears 91 and 92 are rotatably supported by the second housing 14. The gear 93 is rotatably supported by the first housing 13. Further, the gear 93 is coaxially disposed with the ribbon feed roller 28 and is rotated together with the ribbon feed roller 28.

When the cartridge 6 is attached to the main body part 7, the gear 68 on the cartridge 6 side and the gear 93 on the main body part 7 side are engaged with each other. Further, when the cartridge 6 is attached to the main body part 7, the gear 67 on the cartridge 6 side and the gear 90 on the main body part 7 side are engaged with each other.

When the ribbon feed motor 30 is rotated in a clockwise direction in a state that the cartridge 6 has been attached to the main body part 7, power of the ribbon feed motor 30 is transmitted to the winding roll 5 and the ribbon feed roller 28 and the winding roll 5 and the ribbon feed roller 28 are rotated in the counterclockwise direction. In other words, when the ribbon feed motor 30 is rotated in the clockwise direction, the winding roll 5 and the ribbon feed roller 28 feed the ink ribbon 3 in the ribbon winding direction.

In this embodiment, a winding speed of the ink ribbon 3 which is wound by the winding roll 5 is set to be faster than a feed speed of the ink ribbon 3 which is fed by the ribbon feed roller 28. Therefore, when the ribbon feed motor 30 is rotated in the clockwise direction, the torque limiter 60 is operated and a difference between the winding speed of the ink ribbon 3 which is wound by the winding roll 5 and the feed speed of the ink ribbon 3 which is fed by the ribbon feed roller 28 is adjusted.

On the other hand, when the ribbon feed motor 30 is rotated in the clockwise direction, transmission of power of the ribbon feed motor 30 to the supply roll 4 is cut off by operation of the one-way clutch 62. In other words, the rotation shaft 75 is idled with respect to the pulley 63 and transmission of power of the ribbon feed motor 30 to the supply roll 4 is cut off.

In this embodiment, when the ribbon feed motor 30 is rotated in the clockwise direction, the ink ribbon 3 is fed in the ribbon winding direction by the winding roll 5 and the ribbon feed roller 28 and thus the supply roll 4 is rotated in the ribbon winding direction (in other words, counterclockwise direction). When the supply roll 4 is rotated in the counterclockwise direction, the connecting part 56, the rotation shaft 58, the pulleys 63 and 64 are also rotated in the counterclockwise direction together with the supply roll 4. In this embodiment, an outer diameter of the tube part 4*b* of the supply roll 4 is larger than an outer diameter of the ribbon feed roller 28, and a rotating speed of the pulley 63 rotated in the counterclockwise direction together with the supply roll 4 is slower than a rotating speed of the rotation shaft 75 rotated by the power of the ribbon feed motor 30. Therefore, an interference of the driving forces does not occur between the pulley 63 and the rotation shaft 75.

Further, when the supply roll 4 is rotated in the counterclockwise direction, the rotational member 72 is turned in the counterclockwise direction together with the supply roll 4, the connecting part 56 and the rotation shaft 58. A turnable range of the rotational member 72 is restricted by a turning restriction mechanism (not shown) and thus, when the rotational member 72 is turned by a predetermined angle in the counterclockwise direction, the rotational member 72 and the rotation shaft 58 are stopped. Even when the rotational member 72 and the rotation shaft 58 are stopped, the supply roll 4 continues to rotate in the counterclockwise direction together with the connecting part 56 by operation of the torque limiter 57.

When the rotational member 72 is turned in the counterclockwise direction, as shown in FIG. 17(A), the tension coil spring 73 is extended and the rotational member 72 is urged in the clockwise direction. Therefore, in a case that the ink ribbon 3 is fed in the ribbon winding direction, when the ink ribbon 3 is loosened on the supply roll 4 side, the supply roll 4 is turned together with the rotational member 72, the rotation shaft 58 and the connecting part 56 by the urging force of the tension coil spring 73 in the clockwise direction (in other words, the ribbon winding direction) to eliminate slacking of the ink ribbon 3. Further, in a state that the rotational member 72 is urged in the clockwise direction, when the cartridge 6 is detached from the main body part 7, the supply roll 4 is turned in the clockwise direction together with the rotational member 72, the rotation shaft 58 and the connecting part 56 by the urging force of the tension coil spring 73. Therefore, slacking of the ink ribbon 3 which may occur in the cartridge 6 is eliminated while the cartridge 6 is detached from the main body part 7 and, as shown in FIG. 17(B), even after the cartridge 6 has been detached, slacking of the ink ribbon 3 is not occurred in the cartridge 6.

Further, in a state that the cartridge 6 has been attached to the main body part 7, when the ribbon feed motor 30 is rotated in the counterclockwise direction, power of the ribbon feed motor 30 is transmitted to the supply roll 4 and the ribbon feed roller 28 and thus the supply roll 4 and the ribbon feed roller 28 are rotated in the clockwise direction. In other words, when the ribbon feed motor 30 is rotated in the counterclockwise direction, the supply roll 4 and the ribbon feed roller 28 feed the ink ribbon 3 in the ribbon rewinding direction.

In this embodiment, a winding speed of the ink ribbon 3 which is wound by the supply roll 4 is set to be faster than a feed speed of the ink ribbon 3 which is fed by the ribbon feed roller 28. Therefore, when the ribbon feed motor 30 is rotated in the counterclockwise direction, the torque limiter 57 is operated and a difference between the winding speed of the ink ribbon 3 which is wound by the supply roll 4 and the feed speed of the ink ribbon 3 fed by the ribbon feed roller 28 is adjusted. In this embodiment, even when the rotation shaft 58 is rotated in the clockwise direction by power of the ribbon feed motor 30, the rotational member 72 does not turn by operation of the one-way clutch 71. However, when the rotational member 72 is urged in the clockwise direction by the urging force of the tension coil spring 73, the rotational member 72 is turned in the clockwise direction to a position restricted by the turning restriction mechanism.

On the other hand, when the ribbon feed motor 30 is rotated in the counterclockwise direction, transmission of power of the ribbon feed motor 30 to the winding roll 5 is cut off by operation of the one-way clutch 66. In other words, the gear 67 is idled with respect to the rotation shaft 61 and transmission to the winding roll 5 of power of the ribbon feed motor 30 is cut off.

When the ribbon feed motor 30 is rotated in the counterclockwise direction, the ink ribbon 3 is fed in the ribbon rewinding direction by the supply roll 4 and the ribbon feed roller 28 and thus the winding roll 5 is rotated in the ribbon rewinding direction (in other words, the clockwise direction). When the winding roll 5 is rotated in the clockwise direction, the connecting part 59 and the rotation shaft 61 are also rotated in the clockwise direction together with the winding roll 5. In this embodiment, an outer diameter of the tube part 5*b* of the winding roll 5 is larger than an outer diameter of the ribbon feed roller 28 and a rotating speed of the rotation shaft 61 rotated in the clockwise direction together with the winding roll 5 is slower than a rotating speed of the gear 67 rotated by power of the ribbon feed motor 30. Therefore, an interference of the driving forces does not occur between the gear 67 and the rotation shaft 61.

The ribbon feed motor 30 in this embodiment is a drive source for rotating the supply roll 4 and the winding roll 5. Further, in this embodiment, the torque limiter 57 is disposed between the one-way clutch 62 and the supply roll 4 in a power transmission path from the ribbon feed motor 30 to the supply roll 4, and the torque limiter 60 is disposed between the one-way clutch 66 and the winding roll 5 in a power transmission path from the ribbon feed motor 30 to the winding roll 5.

(Structure of Detection Mechanism of Ink Ribbon)

Figure 18A:
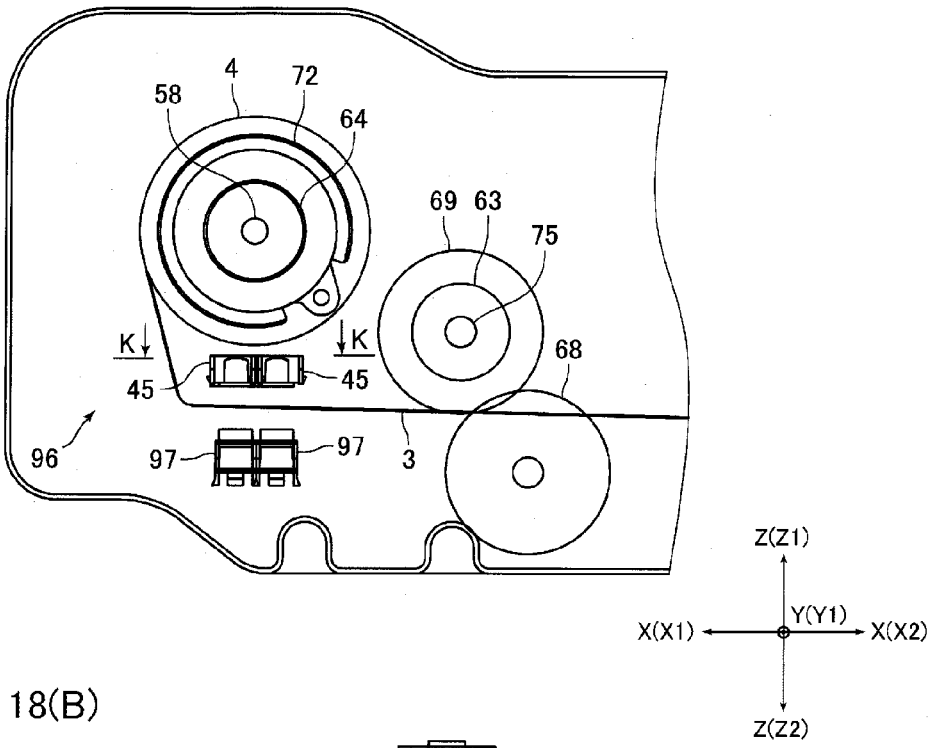
FIG. 18(A) is an explanatory side view showing a structure of a detection mechanism for an ink ribbon shown in FIG. 5.
Figure 18B:
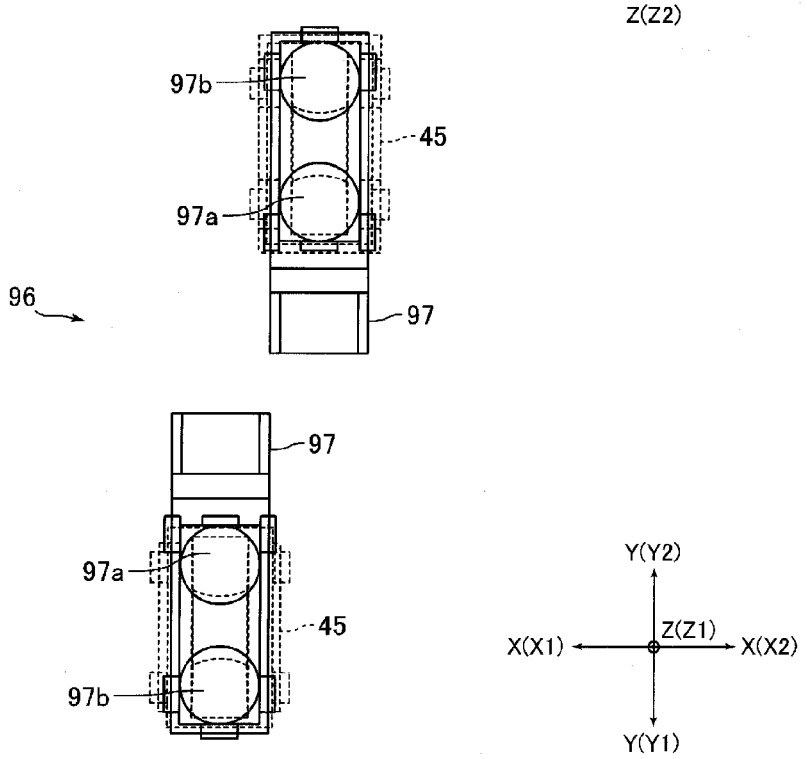
FIG. 18(B) is a view showing the detection mechanism which is viewed in the "K-K" direction in FIG. 18(A).

FIG. 18(A) is an explanatory side view showing a structure of a detection mechanism 96 for the ink ribbon 3 shown in FIG. 5, and FIG. 18(B) is a view showing the detection mechanism 96 which is viewed in the "K-K" direction in FIG. 18(A).

The printing device 1 includes a detection mechanism 96 for detecting the ink ribbon 3. The detection mechanism 96 includes two prisms 45 fixed to the cover part 37*a* of the case main body 37 structuring the ink ribbon cassette 26 and two sensors 97 attached to the main body part 7. The sensor 97 is an optical type sensor having a light emitting part 97*a* and a light receiving part 97*b* which receives the light which is emitted from the light emitting part 97*a* and is reflected by the prism 45. The light emitting part 97*a* and the light receiving part 97*b* are disposed so as to be adjacent to each other in the right and left direction.

The sensor 97 is disposed on a lower side with respect to the prism 45 in a state that the cartridge 6 has been attached to the main body part 7. When the cartridge 6 is attached to the main body part 7, the ink ribbon 3 drawn out from the supply roll 4 is interposed between the prism 45 and the sensor 97 in the upper and lower direction. In this embodiment, the ink ribbon 3 is detected based on a light receiving amount in the light receiving part 97*b*.

(Control Method for Ribbon Feed Mechanism)

When printing on one card 2 by the thermal head 9 is finished, the ribbon feed mechanism 10 feeds the ink ribbon 3 in the ribbon winding direction until a peeled trace of the ink having been formed on the ink ribbon 3 at the time of printing on the card 2 is entered in an inside of the cover part 37*b* of the ink ribbon cassette 26 (ribbon forward feeding step). Further, when the next one card 2 is to be printed, the ribbon feed mechanism 10 feeds the ink ribbon 3 in the ribbon rewinding direction by a feed amount not more than the feed amount after the printing on the former one card 2 has been finished (in other words, the feed amount by the ribbon forward feeding step).

In this embodiment, printing on one card 2 is performed by using one printing region 3*c* and, after printing on the one card 2 is finished, the ribbon feed mechanism 10 feeds the ink ribbon 3 in the ribbon winding direction by a feed amount which is a length of one printing region 3*c* or more. For example, after printing on one card 2 is finished, the ribbon feed mechanism 10 feeds the ink ribbon 3 in the ribbon winding direction by a feed amount of one or two printing regions 3*c*. Further, when a next one card 2 is to be printed, the ribbon feed mechanism 10 feeds the ink ribbon 3 in the ribbon rewinding direction so that a reference position of the next card 2 and a reference position of one printing region 3*c* are coincided with each other. Specifically, when the next one card 2 is to be printed, the ribbon feed mechanism 10 feeds the ink ribbon 3 in the ribbon rewinding direction so that a reference position of the next card 2 is coincided with a reference position of the unused printing region 3*c* subsequent to the printing region 3*c* which has been used for printing of the former card 2.

In this embodiment, a feed control for the ink ribbon 3 by the ribbon feed mechanism 10 is performed by a control section not shown. The control section is connected with the ribbon feed motor 30, the sensor 97, a sensor (not shown) having a light emitting element and a light receiving element which are oppositely disposed so as to interpose the slit part 70*a*, and the like. Further, the control section stores a feed amount of the ink ribbon 3 in the ribbon forward feeding step and, in a ribbon backward feeding step, the ink ribbon 3 is fed in the ribbon rewinding direction based on the stored feed amount in the ribbon forward feeding step.

(Principal Effects in this Embodiment)

As described above, in this embodiment, power of the ribbon feed motor 30 is capable of transmitting to the supply roll 4 and the winding roll 5 by the power transmission mechanisms 32 and 33. Therefore, according to this embodiment, the ink ribbon 3 can be fed in both directions between the supply roll 4 and the winding roll 5 by one ribbon feed motor 30. Accordingly, in this embodiment, the ink ribbon 3 can be fed in both directions between the supply roll 4 and the winding roll 5 while simplifying the structure of the printing device 1.

In this embodiment, the gear 69 and the pulley 63 are connected with each other through the one-way clutch 62, and the gear 67 and the rotation shaft 61 are connected with each other through the one-way clutch 66. Further, in a case that the ink ribbon 3 is wound by the winding roll 5, transmission of power of the ribbon feed motor 30 to the supply roll 4 is cut off and the supply roll 4 is followed according to rotation of the ribbon feed roller 28. Further, in a case that the ink ribbon 3 is wound by the supply roll 4, transmission of power of the ribbon feed motor 30 to the winding roll 5 is cut off and the winding roll 5 is followed according to rotation of the ribbon feed roller 28. Therefore, according to this embodiment, when the ink ribbon 3 is fed between the supply roll 4 and the winding roll 5 in both directions, the ink ribbon 3 is prevented from being excessively pulled or prevented from being excessively slackened. As a result, in this embodiment, the ink ribbon 3 can be appropriately fed between the supply roll 4 and the winding roll 5 in both directions.

In this embodiment, the connecting part 56 and the rotation shaft 58 are connected with each other through the torque limiter 57, and the connecting part 59 and the rotation shaft 61 are connected with each other through the torque limiter 60. Therefore, in this embodiment, as described above, when the ribbon feed motor 30 is rotated in a clockwise direction, a difference between a winding speed of the ink ribbon 3, which is wound by the winding roll 5, and a feed speed of the ink ribbon 3 which is fed by the ribbon feed roller 28 is adjusted by operation of the torque limiter 60. Further, when the ribbon feed motor 30 is rotated in a counterclockwise direction, a difference between a winding speed of the ink ribbon 3, which is wound by the supply roll 4, and a feed speed of the ink ribbon 3 which is fed by the ribbon feed roller 28 is adjusted by operation of the torque limiter 57. Therefore, according to this embodiment, even when a winding speed of the ink ribbon 3 by the supply roll 4 or the winding roll 5 is set to be faster than a feed speed of the ink ribbon 3 by the ribbon feed roller 28 to prevent slacking of the ink ribbon 3 which is fed between the supply roll 4 and the winding roll 5, excessive tension of the ink ribbon 3 can be prevented. In other words, in this embodiment, excessive tension of the ink ribbon 3 can be prevented while preventing slacking of the ink ribbon 3 which is fed between the supply roll 4 and the winding roll 5.

In this embodiment, when the rotational member 72 is turned in a counterclockwise direction, as described above, the tension coil spring 73 is extended and the rotational member 72 is urged in the clockwise direction. Therefore, according to this embodiment, as described above, even in a case that the ink ribbon 3 is loosened on the supply roll 4 side when the ink ribbon 3 is fed in the ribbon winding direction, slacking of the ink ribbon 3 is eliminated. Further, in this embodiment, when the cartridge 6 is detached from the main body part 7 in a state that the rotational member 72 is urged in the clockwise direction, the supply roll 4 is turned in the clockwise direction by the urging force of the tension coil spring 73 and thus, as described above, slacking of the ink ribbon 3 occurred in the cartridge 6 is eliminated while the cartridge 6 is detached from the main body part 7. Therefore, in this embodiment, damage of the ink ribbon 3 when the cartridge 6 is detached from the main body part 7 can be restrained and handling of the cartridge 6 is also easy. Further, in this embodiment, the rotation shaft 58 and the rotational member 72 are connected with each other through the one-way clutch 71 and thus, in a case that the ink ribbon 3 is wound by the supply roll 4, even when the rotation shaft 58 is rotated in the clockwise direction by power of the ribbon feed motor 30, the rotational member 72 is not turned by operation of the one-way clutch 71. Therefore, according to this embodiment, the tension coil spring 73 does not hinder winding of the ink ribbon 3 by the supply roll 4.

Further, in this embodiment, in a state that the ink ribbon cassette 26 has been detached from the cartridge main body part 27, the gear 5*h* and the tooth stopper 37*h* are engaged with each other by an urging force of the compression coil spring 44 and thus, the winding roll 5 is unable to rotate in the ribbon rewinding direction. Therefore, in this embodiment, in a state that the ink ribbon cassette 26 has been detached from the cartridge main body part 27, the used ink ribbon 3 wound around the winding roll 5 (in other words, the ink ribbon 3 formed with a peeled trace of ink) is unable to be drawn out from the inside of the cover part 37*b*.

In this embodiment, when the winding roll 5 is moved to the right side against the urging force of the compression coil spring 44, an engaging state of the gear 5*h* with the tooth stopper 37*h* is released and the winding roll 5 is capable of rotating in both directions, i.e., the ribbon winding direction and the ribbon rewinding direction. However, when the winding roll 5 is further moved to the right side, the gear 5*g* and the tooth stopper 38*e* are engaged with each other and thus, the winding roll 5 is unable to rotate in the ribbon rewinding direction and the ribbon winding direction. Therefore, in this embodiment, in a case that the ink ribbon cassette 26 has been detached from the cartridge main body part 27, even if the winding roll 5 is moved to the right side by using a certain member, unless the winding roll 5 is moved so that the gear 5*g* and the tooth stopper 38*e* are not engaged with each other, the used ink ribbon 3 wound around the winding roll 5 cannot be drawn out from the inside of the cover part 37*b*. Accordingly, in this embodiment, in a state that the ink ribbon cassette 26 has been detached from the cartridge main body part 27, it is difficult to draw out the used ink ribbon 3 wound around the winding roll 5 from the inside of the cover part 37*b* in comparison with a conventional technique. As a result, in this embodiment, its security can be enhanced in comparison with a conventional technique.

In this embodiment, in a state that the ink ribbon cassette 26 has been detached from the cartridge main body part 27, the gear of the first inner side tube part of the supply roll 4 and the tooth stopper of the inner side tube part 37*m* are engaged with each other by an urging force of the compression coil spring 41 and thus, the supply roll 4 is unable to rotate in the ribbon winding direction. In other words, in this embodiment, in a state that the ink ribbon cassette 26 has been detached from the cartridge main body part 27, unless the supply roll 4 is moved to the right side by a specified quantity by using a certain member, the ink ribbon 3 wound around the supply roll 4 cannot be drawn out. Therefore, according to this embodiment, slacking of the ink ribbon 3 when the ink ribbon cassette 26 has been detached from the cartridge main body part 27 can be prevented.

In this embodiment, the rotation prevention mechanism 46 structured of the gear 5*h* and the tooth stopper 37*h* is a ratchet mechanism and, even when the gear 5*h* and the tooth stopper 37*h* are engaged with each other by an urging force of the compression coil spring 44, the winding roll 5 is capable of rotating in the ribbon winding direction. Further, in this embodiment, the third rotation prevention mechanism structured of the gear of the first inner side tube part of the supply roll 4 and the tooth stopper of the inner side tube part 37*m* is a ratchet mechanism and, even when the gear of the first inner side tube part of the supply roll 4 and the tooth stopper of the inner side tube part 37*m* are engaged with each other by the urging force of the compression coil spring 41, the supply roll 4 is capable of rotating in the ribbon rewinding direction. Therefore, in this embodiment, in a state that the ink ribbon cassette 26 has been detached from the cartridge main body part 27, even if the ink ribbon 3 is slackened between the supply roll 4 and the winding roll 5, slacking of the ink ribbon 3 can be eliminated by turning the winding roll 5 in the ribbon winding direction or by turning the supply roll 4 in the ribbon rewinding direction.

In this embodiment, when the ink ribbon cassette 26 is attached to the cartridge main body part 27 and the winding side engaging part 55 is engaged with the winding roll 5, engagement of the gear 5*h* with the tooth stopper 37*h* is released. In other words, in this embodiment, when the ink ribbon cassette 26 is attached to the cartridge main body part 27, engagement of the gear 5*h* with the tooth stopper 37*h* is released automatically. Therefore, in this embodiment, engagement of the gear 5*h* with the tooth stopper 37*h* is easily released. Further, in this embodiment, when the ink ribbon cassette 26 is attached to the cartridge main body part 27 and the supply side engaging part 54 is engaged with the supply roll 4, engagement of the gear of the first inner side tube part of the supply roll 4 and the tooth stopper of inner side tube part 37*m* is released automatically. Therefore, in this embodiment, engagement of the gear of the first inner side tube part of the supply roll 4 with the tooth stopper of the inner side tube part 37*m* is easily released.

In this embodiment, engagement of the gear 5*h* with the tooth stopper 37*h* can be released by using the winding side engaging part 55 for rotating the winding roll 5 and thus, another member for releasing engagement of the gear 5*h* with the tooth stopper 37*h* is not required to provide separately. Further, engagement of the gear of the first inner side tube part of the supply roll 4 with the tooth stopper of the inner side tube part 37*m* can be released by using the supply side engaging part 54 for rotating the supply roll 4 and thus, another member for releasing engagement of the gear of the first inner side tube part of the supply roll 4 with the tooth stopper of the inner side tube part 37*m* is not required to provide separately. Therefore, in this embodiment, the structure of the cartridge 6 can be simplified.

In this embodiment, the cartridge main body part 27 includes the rotation prevention mechanism 78 which prevents rotation of the winding roll 5 in the ribbon rewinding direction. Therefore, in this embodiment, even when engagement of the gear 5*h* with the tooth stopper 37*h* is automatically released by attaching the ink ribbon cassette 26 to the cartridge main body part 27, the used ink ribbon 3 wound around the winding roll 5 is prevented from being drawn out from the inside of the cover part 37*b*. In other words, in this embodiment, even in a state that the ink ribbon cassette 26 has been attached to the cartridge main body part 27, the used ink ribbon 3 can be prevented from being drawn out from the inside of the cover part 37*b*.

Further, in this embodiment, when the cartridge 6 has been detached from the main body part 7, two pawl members 80 and the gear 79 are engaged with each other by an urging force of the torsion coil spring 83 and thus, rotation of the winding roll 5 in the ribbon rewinding direction is prevented. Therefore, in this embodiment, in a state that the cartridge 6 has been detached from the main body part 7, the used ink ribbon 3 wound around the winding roll 5 can be prevented from being easily drawn out from the cover part 37*b*. Especially, in this embodiment, two pawl members 80 are engaged with the gear 79 and thus, unless the engaging states of respective two pawl members 80 with the gear 79 are released, the used ink ribbon 3 wound around the winding roll 5 cannot be drawn out from the cover part 37*b* in the state that the cartridge 6 has been detached from the main body part 7. Therefore, in this embodiment, the used ink ribbon 3 is further hard to be drawn out from the cover part 37*b*. As a result, according to this embodiment, the security in the printing device 1 can be enhanced.

In this embodiment, the engagement release part 13*a* is formed in the first housing 13 and the engagement release part 14*a* is formed in the second housing 14 and, when the cartridge 6 is mounted on the second housing 14 from an upper side and the cartridge 6 mounted on the second housing 14 is covered by the first housing 13 from the upper side, the engaging states of the two pawl members 80 with the gear 79 are released. Therefore, in this embodiment, even when the cartridge 6 is attached to and detached from the main body part 7 from an upper side with respect to the printing device 1, the engaging states of the two pawl members 80 with the gear 79 can be released. Accordingly, in this embodiment, in a state that the cartridge 6 has been detached from the main body part 7, the used ink ribbon 3 wound around the winding roll 5 is prevented from being easily drawn out from the cover part 37*b* and, in addition, the cartridge 6 can be attached to and detached from the main body part 7 from an upper side with respect to the printing device 1. As a result, according to this embodiment, in a state that the cartridge 6 has been detached from the main body part 7, the used ink ribbon 3 wound around the winding roll 5 is prevented from being easily drawn out from the cover part 37*b* and, in addition, in a host device on which the printing device 1 is mounted, flexibility of layout of the printing device 1 can be enhanced.

In this embodiment, the engagement release part 13*a* is formed in the first housing 13 and, unless the cartridge 6 is covered by the first housing 13 from an upper side, the engaging state of the pawl member 80 with the gear 79 is not released. Therefore, according to this embodiment, in a case that the cartridge 6 is mounted on the second housing 14 but an upper side of cartridge 6 is not covered by the first housing 13, the used ink ribbon 3 wound around the winding roll 5 can be prevented from being drawn out from the cover part 37*b*.

In this embodiment, the rotation prevention mechanism 78 is a ratchet mechanism and, even when the gear 79 and the pawl member 80 are engaged with each other by an urging force of the torsion coil spring 83, the winding roll 5 is capable of being rotated in the ribbon winding direction. Therefore, according to this embodiment, in a state that the cartridge 6 has been detached from the main body part 7, even if the ink ribbon 3 between the supply roll 4 and the winding roll 5 is slacked, slacking of the ink ribbon 3 can be eliminated by turning the winding roll 5 in the ribbon winding direction.

Further, in this embodiment, when printing on one card 2 by the thermal head 9 is finished, the ribbon feed mechanism 10 feeds the ink ribbon 3 in the ribbon winding direction until a peeled trace of ink on the ink ribbon 3 which is formed at the time of printing on the card 2 is entered into the cover part 37*b* of the ink ribbon cassette 26. Therefore, according to this embodiment, when the cartridge 6 is detached from the housing 15, a peeled trace of ink left on the used ink ribbon 3 is entered into the cover part 37*b* and thus, in the cartridge 6 detached from the housing 15, a peeled trace left on the ink ribbon 3 is unable to be confirmed by visual observation. Accordingly, in this embodiment, in a state that the cartridge 6 has been detached from the housing 15, an image printed on the card 2 is prevented from being acquired through a peeled trace of ink which is left on the used ink ribbon 3.

In this embodiment, when a next one card 2 is to be printed, the ribbon feed mechanism 10 feeds the ink ribbon 3 in the ribbon rewinding direction so that a reference position of the next card 2 and a reference position of one printing region 3*c* are coincided with each other. Therefore, according to this embodiment, after printing on one card 2 is finished, even when the ink ribbon 3 is fed in the ribbon winding direction until a peeled trace of ink which is formed on the ink ribbon 3 at the time of printing on the card 2 is entered into the cover part 37*b*, an used amount of the ink ribbon 3 can be reduced. Especially, in this embodiment, when a next one card 2 is to be printed, the ribbon feed mechanism 10 feeds the ink ribbon 3 in the ribbon rewinding direction so that a reference position of the next card 2 is coincided with a reference position of the next unused printing region 3*c* subsequent to the printing region 3*c* which has been used for printing of the former card 2. Therefore, printing can be performed on a card 2 by using the printing regions 3*c* arranged in a longitudinal direction of the ink ribbon 3 in order. Accordingly, in this embodiment, a used amount of the ink ribbon 3 can be reduced effectively.

In this embodiment, in a state that the cartridge 6 has been detached from the housing 15, the two pawl members 80 and the gear 79 are engaged with each other by an urging force of the torsion coil spring 83 and rotation of the winding roll 5 in the ribbon rewinding direction is prevented. Therefore, according to this embodiment, in a state that the cartridge 6 has been detached from the housing 15, the used ink ribbon 3 wound around the winding roll 5 can be prevented from being easily drawn out from the cover part 37*b*. Accordingly, in this embodiment, in a state that the cartridge 6 has been detached from the housing 15, an image printed on the card 2 can be effectively prevented from being acquired through a peeled trace of ink which is left on the used ink ribbon 3.

(Other Embodiments)

Although the present invention has been shown and described with reference to a specific embodiment, various changes and modifications will be apparent to those skilled in the art from the teachings herein.

In the embodiment described above, the one-way clutch 62 is disposed between the gear 69 and the pulley 63. However, the present invention is not limited to this embodiment. For example, instead of disposing the one-way clutch 62 between the gear 69 and the pulley 63, a one-way clutch may be disposed between the pulley 64 and the rotation shaft 58. Further, in the embodiment described above, the one-way clutch 62 is provided on the cartridge 6 side, which functions to transmit power in the ribbon rewinding direction of the ribbon feed motor 30 to the supply roll 4 and functions to cut off transmission of power in the ribbon winding direction of the ribbon feed motor 30 to the supply roll 4. However, a one-way clutch which performs these functions may be provided on the main body part 7 side. Similarly, in the embodiment described above, the one-way clutch 66 is provided on the cartridge 6 side, which functions to transmit power in the ribbon winding direction of the ribbon feed motor 30 to the winding roll 5 and functions to cut off transmission of power in the ribbon rewinding direction of the ribbon feed motor 30 to the winding roll 5. However, a one-way clutch which performs these functions may be provided on the main body part 7 side.

In the embodiment described above, the ribbon feed mechanism 10 successively feeds the ink ribbon 3 in the ribbon winding direction at the time of printing on a card 2 so that a peeled trace of ink in the same shape as an image printed on the card 2 is formed on the used ink ribbon 3. However, the present invention is not limited to this embodiment. For example, at the time of printing on a card 2, the ribbon feed mechanism 10 may feed the ink ribbon 3 so that feeding of the ink ribbon 3 in the ribbon winding direction and feeding of the ink ribbon 3 in the ribbon rewinding direction are performed at random and thereby a peeled trace of ink in a shape different from the image printed on the card 2 is formed on the used ink ribbon 3. In other words, the printing device 1 may perform a so-called random printing.

In the embodiment described above, in the cartridge 6, an ink ribbon 3 wound around the supply roll 4 is covered by the cover part 37*a* and an ink ribbon 3 wound around the winding roll 5 is covered by the cover part 37*b*. However, the present invention is not limited to this embodiment. For example, in the cartridge 6, an ink ribbon 3 wound around the supply roll 4 and an ink ribbon 3 wound around the winding roll 5 may be exposed without being covered by a cover part. Further, in the embodiment described above, the ink ribbon cassette 26 having the supply roll 4 and the winding roll 5 is capable of being detachably attached to the cartridge main body part 27. However, the cartridge main body part may be structured so that a supply roll 4 and a winding roll 5 are capable of being individually attached and detached.

In the embodiment described above, an ink ribbon 3 is used by which printing of a single color is performed but an ink ribbon 3 capable of printing of plural colors may be used. Further, in the embodiment described above, the ink ribbon 3 is provided with the overcoat region 3*b* but the ink ribbon 3 may be provided with no overcoat region 3*b*. Further, in the embodiment described above, a printing medium which is printed in the printing device 1 is a card 2, but a printing medium which is printed in the printing device 1 may be another medium such as a printing paper other than a card 2.

In the embodiment described above, the rotation prevention mechanism 46 is a ratchet mechanism which prevents only rotation of the winding roll 5 in the ribbon rewinding direction, and a plurality of teeth structuring the gear 5*h* and the tooth stopper 37*h* are formed so that, even when the gear 5*h* and the tooth stopper 37*h* are engaged with each other, the winding roll 5 is capable of rotating in the ribbon winding direction. However, the present invention is not limited to this embodiment. For example, a plurality of teeth structuring the gear 5*h* and the tooth stopper 37*h* may be formed so that, when the gear 5*h* and the tooth stopper 37*h* are engaged with each other, rotation of the winding roll 5 in the ribbon winding direction is prevented.

Similarly, in the embodiment described above, the third rotation prevention mechanism which is structured of the gear of the first inner side tube part of the supply roll 4 and the tooth stopper of the inner side tube part 37*m* is a ratchet mechanism which prevents only rotation of the supply roll 4 in the ribbon winding direction. The gear of the first inner side tube part of the supply roll 4 and the tooth stopper of the inner side tube part 37*m* are formed so that, even when the gear and the tooth stopper are engaged with each other, the supply roll 4 is capable of rotating in the ribbon rewinding direction. However, the gear of the first inner side tube part of the supply roll 4 and the tooth stopper of the inner side tube part 37*m* may be formed so that, when the gear and the tooth stopper are engaged with each other, rotation of the supply roll 4 in the ribbon rewinding direction is prevented.

Further, in the embodiment described above, the rotation prevention mechanism 78 is a ratchet mechanism which prevents only rotation of the winding roll 5 in the ribbon rewinding direction, and the gear 79 and the pawl member 80 are formed so that, even when the gear 79 and the pawl member 80 are engaged with each other, the winding roll 5 is capable of rotating in the ribbon winding direction. However, the gear 79 and the pawl member 80 may be formed so that, when the gear 79 and the pawl member 80 are engaged with each other, rotation of the winding roll 5 in the ribbon winding direction is prevented.

In the embodiment described above, a plurality of teeth structuring the gear 5*g* and the tooth stopper 38*e* of the rotation prevention mechanism 47 are formed so that, when the gear 5*g* and the tooth stopper 38*e* are engaged with each other, rotation of the winding roll 5 in the ribbon rewinding direction and the ribbon winding direction is prevented. However, the present invention is not limited to this embodiment. For example, the rotation prevention mechanism 47 is a ratchet mechanism, and a plurality of teeth structuring the gear 5*g* and the tooth stopper 38*e* may be formed so that, when the gear 5*g* and the tooth stopper 38*e* are engaged with each other, rotation of the winding roll 5 in the ribbon rewinding direction is prevented but rotation of the winding roll 5 in the ribbon winding direction is permitted.

In the embodiment described above, the rotation prevention mechanism 78 includes two pawl members 80 which are engaged with the gear 79. However, the present invention is not limited to this embodiment. For example, the rotation prevention mechanism 78 may include three or more pawl members 80 which are engaged with the gear 79. Further, the rotation prevention mechanism 78 may include one pawl member 80 which is engaged with the gear 79. In this case, it may be structured that one pawl member 80 is disposed so as to engage with the upper end side of the gear 79 and an engaging state of the gear 79 with the pawl member 80 is released by the engagement release part 13*a* of the first housing 13. Alternatively, it may be structured that one pawl member 80 is disposed so as to engage with the lower end side of the gear 79 and an engaging state of the gear 79 with the pawl member 80 is released by the engagement release part 14*a* of the second housing 14. However, in order to prevent the used ink ribbon 3 wound around the winding roll 5 from being drawn out from the cover part 37*b* when the cartridge 6 is mounted on the second housing 14 and an upper side of the cartridge 6 is not covered by the first housing 13, it is preferable that one pawl member 80 is disposed so as to engage with the upper end side of the gear 79 and an engaging state of the gear 79 with the pawl member 80 is released by the engagement release part 13*a* of the first housing 13.

In the embodiment described above, the rotation prevention mechanism 78 is a ratchet mechanism which prevents only rotation of the winding roll 5 in the ribbon rewinding direction, and the gear 79 and the pawl member 80 are formed so that, even when the gear 79 and the pawl member 80 are engaged with each other, the winding roll 5 is capable of rotating in the ribbon winding direction. However, the present invention is not limited to this embodiment. For example, the gear 79 and the pawl member 80 may be formed so that, when the gear 79 and the pawl member 80 are engaged with each other, rotation of the winding roll 5 in the ribbon winding direction is prevented. Further, in the embodiment described above, the cartridge 6 includes the rotation prevention mechanism 78 but the cartridge 6 may include no rotation prevention mechanism 78.

In the embodiment described above, the ink ribbon 3 wound around the supply roll 4 is covered by the cover part 37*a*. However, the ink ribbon 3 wound around the supply roll 4 may be exposed without being covered by the cover part 37*a*. Further, in the embodiment described above, the ink ribbon cassette 26 attached to the cartridge main body part 27 is capable of being detachably attached to the main body part 7. However, the main body part 7 may be structured so that the ink ribbon cassette 26 is capable of being directly attached to and detached from the main body part 7.

In the embodiment described above, the first housing 13 is capable of turning with respect to the second housing 14 with the shaft 16 as a center and, when the cartridge 6 is attached and detached, the first housing 13 is turned with respect to the second housing 14. However, the present invention is not limited to this embodiment. For example, it may be structured that the first housing 13 is capable of being detachably attached to the second housing 14 and, when the cartridge 6 is to be detachably attached, the first housing 13 is detachably attached to the second housing 14.

In the embodiment described above, the pawl member 80 is urged by the torsion coil spring 83 in a direction engaging with the gear 79 with the fixed shaft 82 as a center. However, the present invention is not limited to this embodiment. For example, the pawl member 80 may be urged in a direction engaging with the gear 79 with the fixed shaft 82 as a center by another spring member such as a tension coil spring or a plate spring.

In the embodiment described above, the supply roll 4 and the winding roll 5 are capable of being rotated by one ribbon feed motor 30. However, the present invention is not limited to this embodiment. For example, a motor for rotating the supply roll 4 and a motor for rotating the winding roll 5 may be provided individually.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. An ink ribbon cartridge comprising:

a supply roll around which an ink ribbon is wound;

a winding roll around which the ink ribbon supplied from the supply roll is wound; and a power transmission mechanism structured to transmit power from a drive source to the supply roll and the winding roll;

wherein when a direction in which the ink ribbon is wound by the winding roll is defined as a ribbon winding direction and a direction in which the ink ribbon is wound by the supply roll is defined as a ribbon rewinding direction, the power transmission mechanism comprises:

a winding side one-way clutch structured to transmit a driving force in the ribbon winding direction of the drive source to the winding roll and cut off transmission of the driving force in the ribbon rewinding direction of the drive source to the winding roll;

a winding side torque limiter which is disposed between the winding side one-way clutch and the winding roll in a power transmission path from the drive source to the winding roll;

a supply side one-way clutch structured to transmit the driving force in the ribbon rewinding direction of the drive source to the supply roll and cut off transmission of the driving force in the ribbon winding direction of the drive source to the supply roll; and a supply side torque limiter which is disposed between the supply side one-way clutch and the supply roll in a power transmission path from the drive source to the supply roll.

2. The ink ribbon cartridge according to claim 1, wherein the power transmission mechanism comprises:

a supply side connecting part which is connected with the supply roll;

a supply side rotation shaft which is connected with the supply side connecting part through the supply side torque limiter;

a rotational member which is relatively turnably held by the supply side rotation shaft;

an urging member for urging the rotational member in the ribbon rewinding direction with the supply side rotation shaft as a center;

a turning restriction mechanism structured to restrict a turnable range of the rotational member; and a second supply side one-way clutch which is disposed between the supply side rotation shaft and the rotational member and structured to transmit a rotating force of the supply side rotation shaft in the ribbon winding direction to the rotational member and cut off transmission of the rotating force of the supply side rotation shaft in the ribbon rewinding direction to the rotational member.

3. The ink ribbon cartridge according to claim 2, wherein the power transmission mechanism comprises:

a first pulley which is fixed to the supply side rotation shaft;

a second pulley and a supply side gear which are connected with each other through the supply side one-way clutch; and a belt which is stretched over the first pulley and the second pulley.

4. The ink ribbon cartridge according to claim 1, wherein the power transmission mechanism comprises a winding side rotation shaft and a winding side gear, which are connected with each other through the winding side one-way clutch, and a winding side connecting part which is connected with the winding roll, and the winding side rotation shaft and the winding side connecting part are connected with each other through the winding side torque limiter.

5. A printing device comprising:

the ink ribbon cartridge as defined in claim 1; and a main body part to which the ink ribbon cartridge is detachably attached;

wherein the main body part comprises:

a medium conveying passage where a printing medium is conveyed;

a thermal head configured to heat the ink ribbon supplied from the supply roll to transfer and print ink of the ink ribbon on the printing medium passing the medium conveying passage;

the drive source; and a ribbon feed roller which is rotated by power of the drive source to feed the ink ribbon.

6. The printing device according to claim 5, wherein the drive source is a ribbon feed motor, when the ribbon feed motor is rotated in one direction, the ink ribbon is fed in the ribbon winding direction, and when the ribbon feed motor is rotated in the other direction, the ink ribbon is fed in the ribbon rewinding direction.

7. A printing device comprising:

a medium conveying passage where a printing medium is conveyed;

a thermal head configured to heat an ink ribbon to transfer and print ink of the ink ribbon on the printing medium passing the medium conveying passage;

a supply roll around which the ink ribbon supplied toward the thermal head is wound;

a winding roll around which the ink ribbon after ink has been transferred to the printing medium by the thermal head is wound;

a drive source structured to rotate the supply roll and the winding roll; and a power transmission mechanism structured to transmit power from the drive source to the supply roll and the winding roll;

wherein when a direction in which the ink ribbon is wound by the winding roll is defined as a ribbon winding direction and a direction in which the ink ribbon is wound by the supply roll is defined as a ribbon rewinding direction, the power transmission mechanism comprises:

a winding side one-way clutch structured to transmit a driving force of the drive source in the ribbon winding direction to the winding roll and cut off transmission of the driving force of the drive source in the ribbon rewinding direction to the winding roll;

a winding side torque limiter which is disposed between the winding side one-way clutch and the winding roll in a power transmission path from the drive source to the winding roll;

a supply side one-way clutch structured to transmit the driving force of the drive source in the ribbon rewinding direction to the supply roll and cuts off transmission of the driving force of the drive source in the ribbon winding direction to the supply roll; and a supply side torque limiter which is disposed between the supply side one-way clutch and the supply roll in a power transmission path from the drive source to the supply roll.

8. The printing device according to claim 7, further comprising a ribbon feed roller which is rotated by power of the drive source to feed the ink ribbon.

9. The printing device according to claim 7, wherein the drive source is a ribbon feed motor, when the ribbon feed motor is rotated in one direction, the ink ribbon is fed in the ribbon winding direction, and when the ribbon feed motor is rotated in the other direction, the ink ribbon is fed in the ribbon rewinding direction.

10. An ink ribbon cassette comprising:

a supply roll around which an ink ribbon is wound;

a winding roll around which the ink ribbon supplied from the supply roll is wound;

a case body which comprises a winding side cover part which covers a substantially entire ink ribbon wound around the winding roll and in which the winding roll is accommodated, a first rotation prevention mechanism which is provided on one end side in an axial direction of the winding roll and which is structured to prevent at least rotation of the winding roll in a ribbon rewinding direction which is a direction in which the ink ribbon is wound by the supply roll;

a second rotation prevention mechanism which is provided on the other end side in the axial direction of the winding roll and which is structured to prevent at least rotation of the winding roll in the ribbon rewinding direction; and a first urging member structured to urge the winding roll to one end side in the axial direction;

wherein the first rotation prevention mechanism comprises:

a first roll side engaging part which is provided on a winding roll side; and a first case side engaging part which is provided on a case body side and which is structured to engage with the first roll side engaging part to prevent at least rotation of the winding roll in the ribbon rewinding direction;

wherein the second rotation prevention mechanism comprises:

a second roll side engaging part which is provided on the winding roll side; and a second case side engaging part which is provided on the case body side and which is structured to engage with the second roll side engaging part to prevent at least rotation of the winding roll in the ribbon rewinding direction;

wherein when a state that the first roll side engaging part and the first case side engaging part are engaged with each other is defined as a first engaging state, a state that engagement of the first roll side engaging part with the first case side engaging part is released is defined as a first engagement released state, a state that the second roll side engaging part and the second case side engaging part are engaged with each other is defined as a second engaging state, and a state that engagement of the second roll side engaging part with the second case side engaging part is released is defined as a second engagement released state, the first engaging state and the second engagement released state are maintained by an urging force of the first urging member and at least rotation of the winding roll in the ribbon rewinding direction is prevented, when the winding roll is moved to the other end side in the axial direction against the urging force of the first urging member, the winding roll is set in a first state, which is the first engagement released state and the second engagement released state, in which the winding roll is capable of rotating in a ribbon winding direction, which is a direction in which the ink ribbon is wound by the winding roll, and the ribbon rewinding direction, or set in a second state which is the first engagement released state and the second engaging state, in which at least rotation of the winding roll in the ribbon rewinding direction is prevented.

11. The ink ribbon cassette according to claim 10, wherein the first rotation prevention mechanism is a ratchet mechanism, and when the first engaging state and the second engagement released state are maintained by the urging force of the first urging member, the winding roll is capable of rotating in the ribbon winding direction.

12. The ink ribbon cassette according to claim 10, further comprising:

a third rotation prevention mechanism which is provided on one end side in an axial direction of the supply roll and which is structured to prevent at least rotation of the supply roll in the ribbon winding direction;

a fourth rotation prevention mechanism which is provided on the other end side in the axial direction of the supply roll and which is structured to prevent at least rotation of the supply roll in the ribbon winding direction; and a second urging member structured to urge the supply roll to one end side in the axial direction;

wherein the case body comprises a supply side cover part which covers a substantially entire ink ribbon which is wound around the supply roll, and the supply roll is accommodated in the case body, wherein the third rotation prevention mechanism comprises:

a third roll side engaging part which is provided on a supply roll side; and a third case side engaging part which is provided on a case body side and which is structured to engage with the third roll side engaging part to prevent at least rotation of the supply roll in the ribbon winding direction;

wherein the fourth rotation prevention mechanism comprises:

a fourth roll side engaging part which is provided on the supply roll side; and a fourth case side engaging part which is provided on the case body side and which is structured to engage with the fourth roll side engaging part to prevent at least rotation of the supply roll in the ribbon winding direction;

wherein when a state that the third roll side engaging part and the third case side engaging part are engaged with each other is defined as a third engaging state, a state that engagement of the third roll side engaging part with the third case side engaging part is released is defined as a third engagement released state, a state that the fourth roll side engaging part and the fourth case side engaging part are engaged with each other is defined as a fourth engaging state, and a state that engagement of the fourth roll side engaging part with the fourth case side engaging part is released is defined as a fourth engagement released state, the third engaging state and the fourth engagement released state are maintained by an urging force of the second urging member and at least rotation of the supply roll in the ribbon winding direction is prevented, when the supply roll is moved to the other end side in the axial direction against the urging force of the second urging member, the supply roll is set in a third state, which is the third engagement released state and the fourth engagement released state, in which the supply roll is capable of rotating in the ribbon winding direction and the ribbon rewinding direction, or set in a fourth state which is the third engagement released state and the fourth engaging state, in which at least rotation of the supply roll in the ribbon winding direction is prevented.

13. An ink ribbon cartridge comprising:

the ink ribbon cassette as defined in claim 12;

a cartridge main body part to which the ink ribbon cassette is detachably attached;

wherein the cartridge main body part comprises a supply side engaging part which is engaged with the supply roll from one end side in the axial direction of the supply roll for rotating the supply roll; and wherein when the ink ribbon cassette is attached to the cartridge main body part and the supply side engaging part is engaged with the supply roll, the ink ribbon cassette is set in the third state.

14. An ink ribbon cartridge comprising:

the ink ribbon cassette as defined claim 10; and a cartridge main body part to which the ink ribbon cassette is detachably attached;

wherein the cartridge main body part comprises a winding side engaging part which is engaged with the winding roll from one end side in the axial direction of the winding roll for rotating the winding roll; and wherein when the ink ribbon cassette is attached to the cartridge main body part and the winding side engaging part is engaged with the winding roll, the ink ribbon cassette is set in the first state.

15. The ink ribbon cartridge according to claim 14, wherein the cartridge main body part comprises a fifth rotation prevention mechanism which prevents at least rotation of the winding roll in the ribbon rewinding direction.

16. A printing device comprising:

the ink ribbon cartridge as defined claim 14; and a main body part to which the ink ribbon cartridge is detachably attached;

wherein the main body part comprises:

a medium conveying passage where a printing medium is conveyed; and a thermal head configured to heat the ink ribbon supplied from the supply roll to transfer and print ink of the ink ribbon on the printing medium passing the medium conveying passage.

* * * * *